US005091246A

United States Patent [19]

Yasui et al.

[11] Patent Number: 5,091,246

[45] Date of Patent: Feb. 25, 1992

[54] THREE DIMENSIONAL FABRIC AND METHOD FOR MAKING THE SAME

[75] Inventors: Yoshiharu Yasui; Meiji Anahara; Hiroshi Omori, all of Kariya, Japan

[73] Assignee: Kabushiki Kaisha Toyoda Jidoshokki Seisakusho, Kariya, Japan

[21] Appl. No.: 482,345

[22] Filed: Feb. 20, 1990

[30] Foreign Application Priority Data

Feb. 20, 1989 [JP] Japan ..... 1-40479
Feb. 27, 1989 [JP] Japan ..... 1-47987
May 26, 1989 [JP] Japan ..... 1-133693

[51] Int. Cl.[5] ..... D03D 3/00

[52] U.S. Cl. ..... 428/224; 139/16; 139/387 R; 428/257

[58] Field of Search ..... 139/387 R, 388, 457, 139/16; 428/224, 157

[56] References Cited

FOREIGN PATENT DOCUMENTS 56-142053 11/1981 Japan .
61-201063 9/1986 Japan .

*Primary Examiner*—James J. Bell
*Attorney, Agent, or Firm*—Brooks Haidt Haffner & Delahunty

[57] ABSTRACT

A three dimensional fabric of substantially columnar shape having an axis. A plurality of substantially cylindrical axial yarn layers are arranged concentrically about and outward from the axis. Each of the axial yarn layers includes a plurality of axial yarns extending longitudinally relative to the axis. Circumferential yarn turns are inserted to extend circumferentially around the axis at several positions including outside of the outermost axial yarn layer. Inside of the innermost axial yarn layer, and between the inner and outer axial yarn layers. A plurality of radial yarns are woven between the circumferential yarn turns to extend zigzag succesively in the longitudinal and radial directions relative to the axis. The radial yarns are woven substantially perpendicular to the circumferential yarns, between the circumferential yarns, each of the radial yarns are woven in a particular plane that extends through the axis.

18 Claims, 43 Drawing Sheets

Fig.7 (g2)
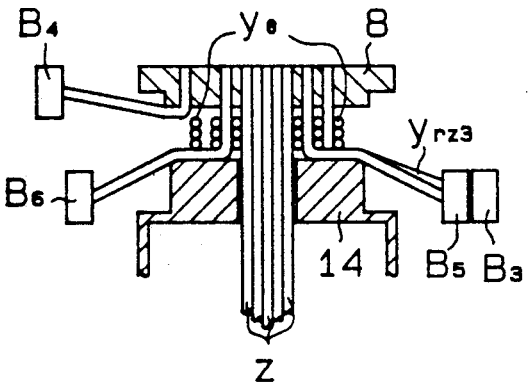
Fig.7 (g1)
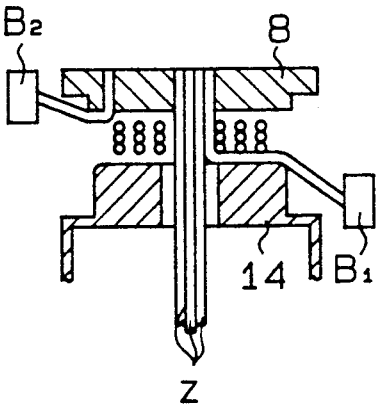
Fig.7 (h2)
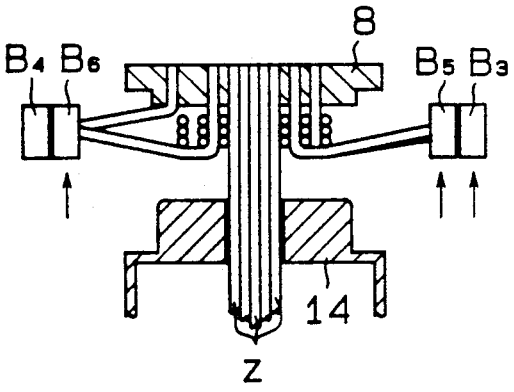
Fig.7 (h1)
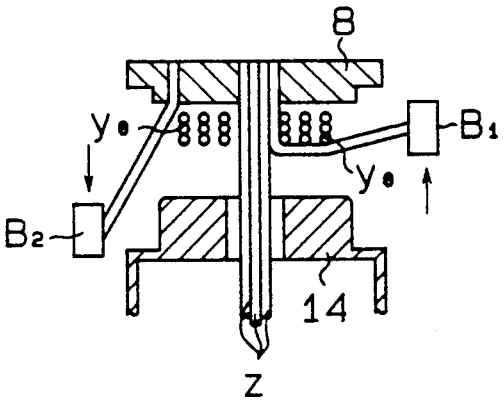
Fig.7 (i2)
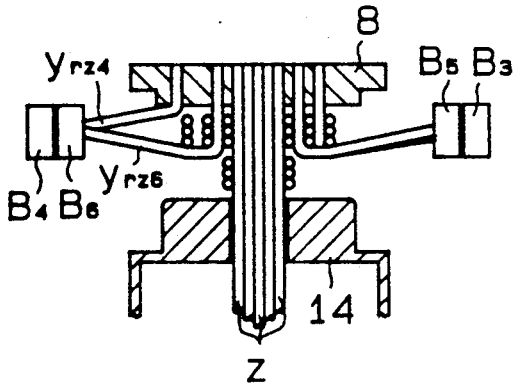
Fig.7 (i1)
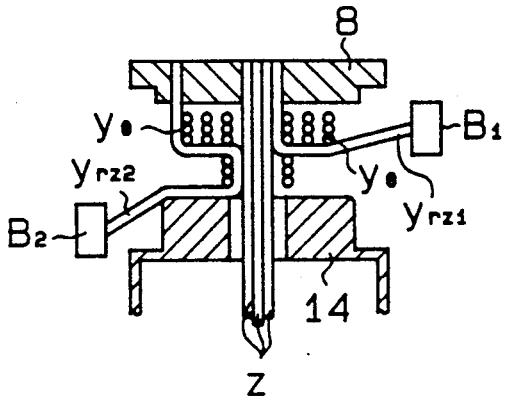

Fig.7 (j2)
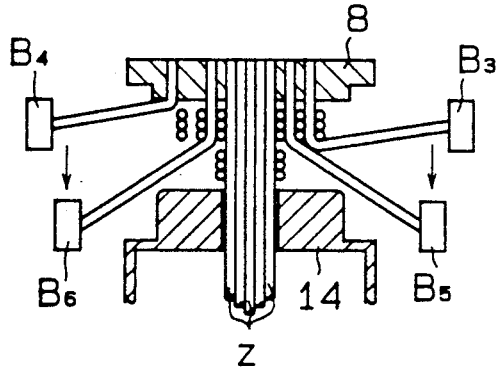
Fig.7 (j1)
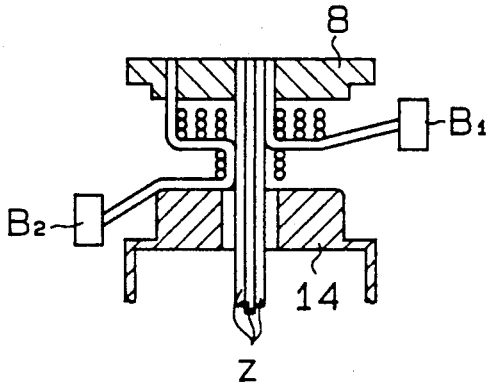
Fig.7 (k2)
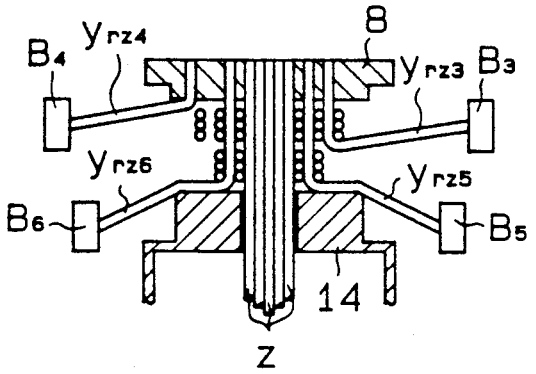
Fig.7 (k1)
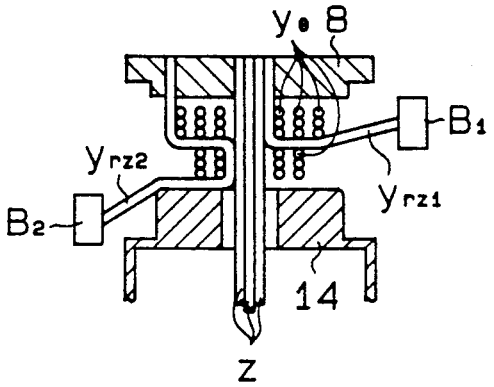
Fig.7 (ℓ2)
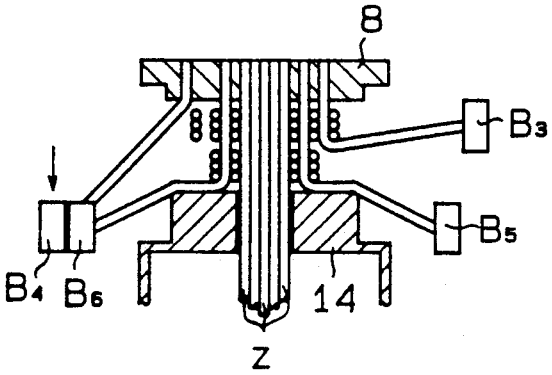
Fig.7 (ℓ1)
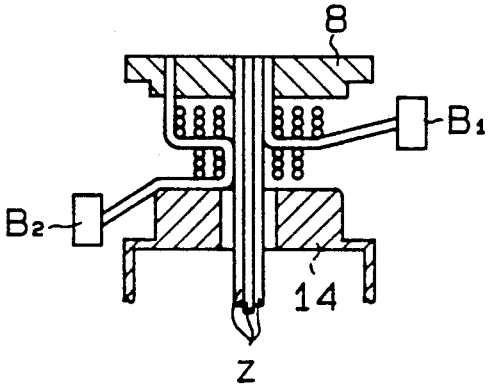

Fig.7 (m2)
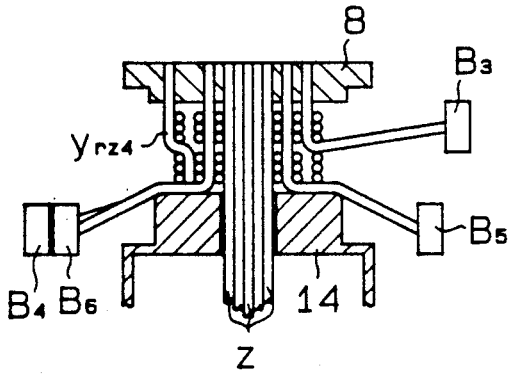
Fig.7 (m1)
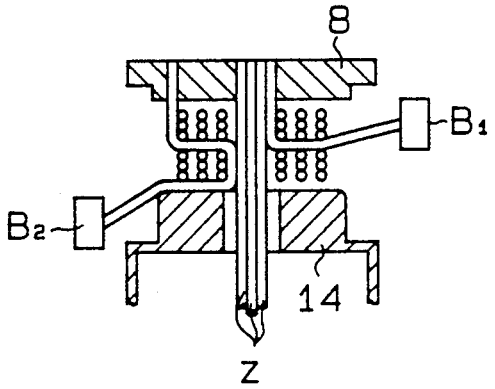
Fig.7 (n2)
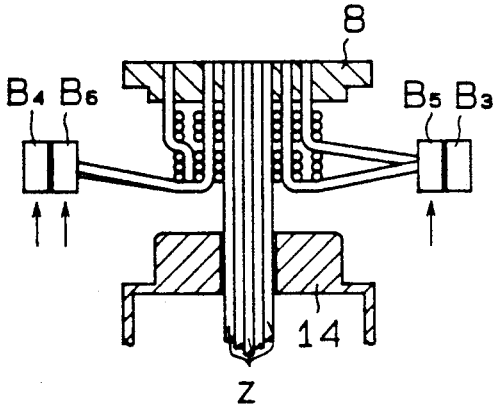
Fig.7 (n1)
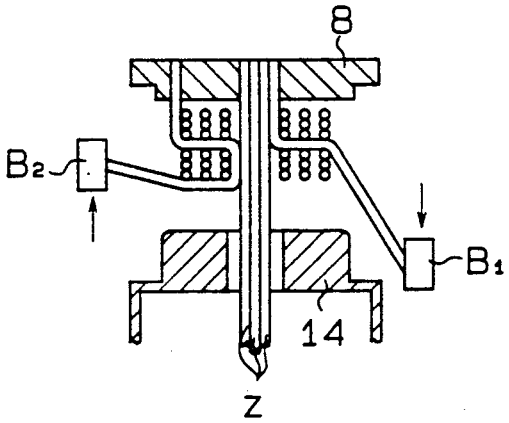
Fig.7. (o2)
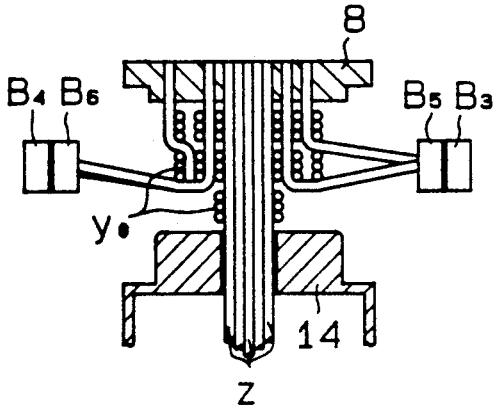
Fig.7 (o1)
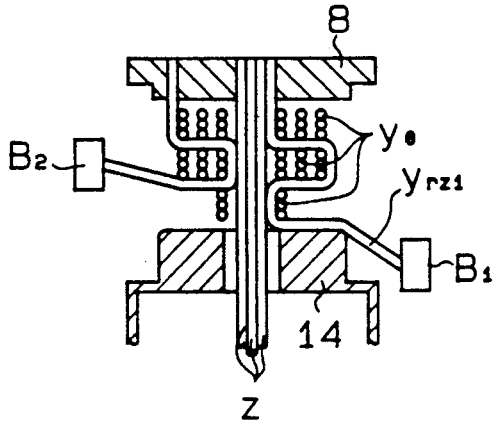

Fig.7 (s2)
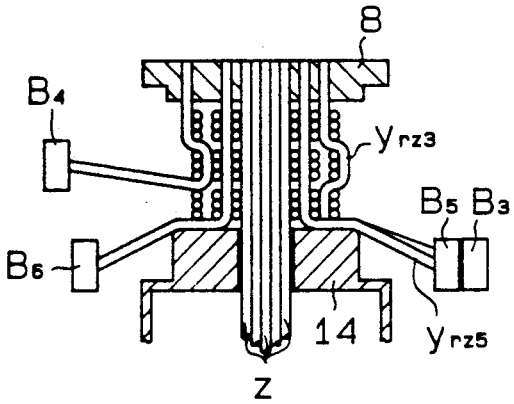
Fig.7 (s1)
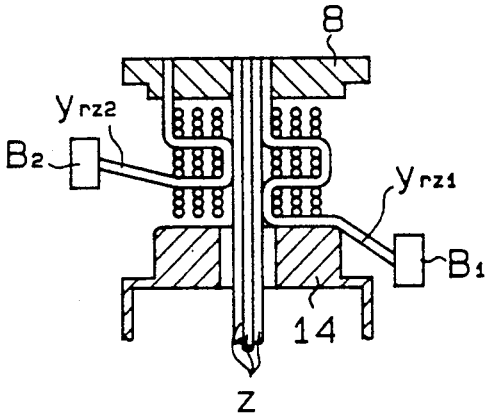
Fig. 8
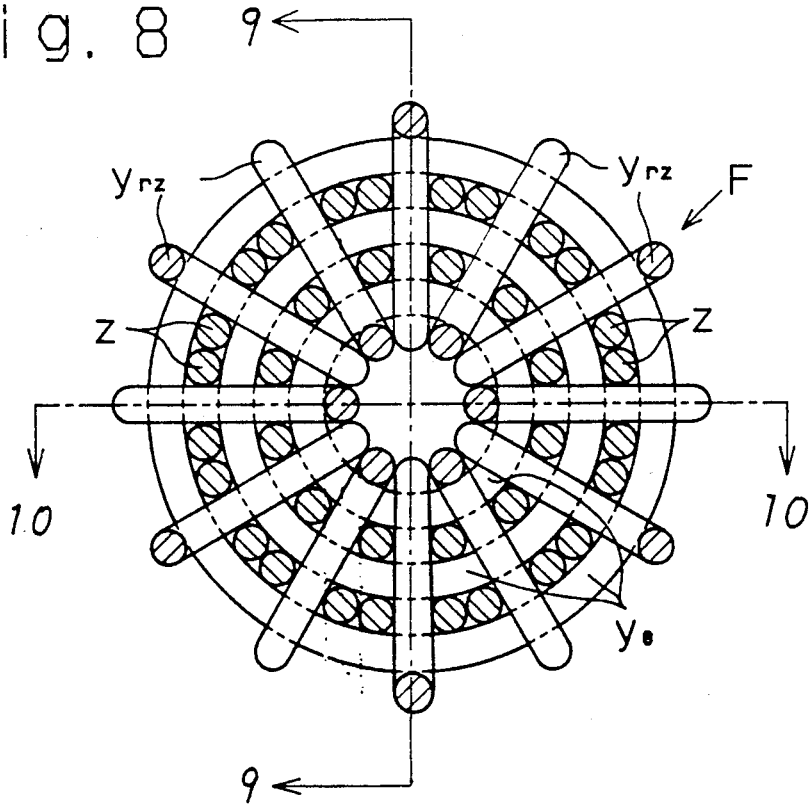

Fig. 16 (a2)
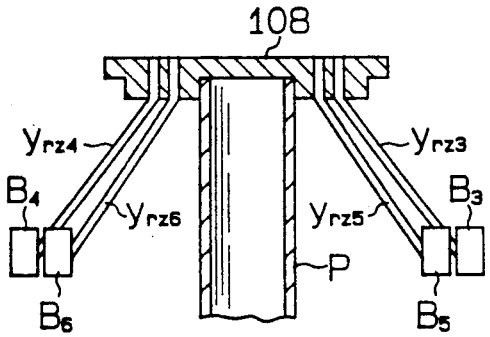
Fig. 16 (a1)
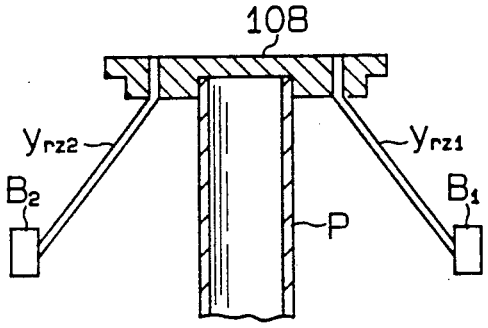
Fig. 16 (b2)
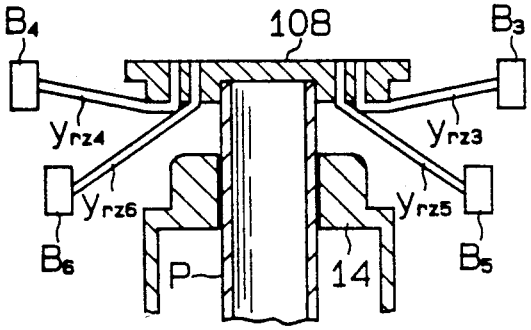
Fig. 16 (b1)
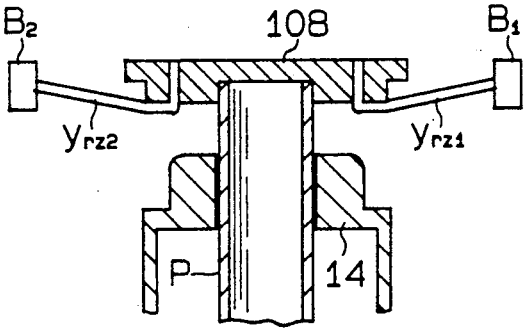
Fig. 16 (c2)
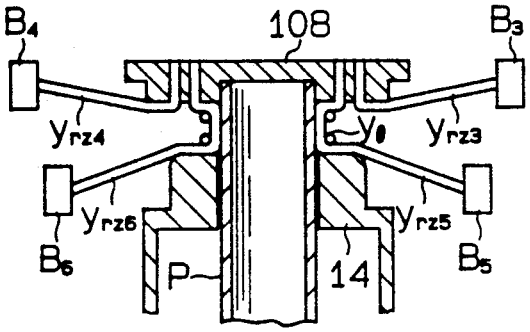
Fig. 16 (c1)
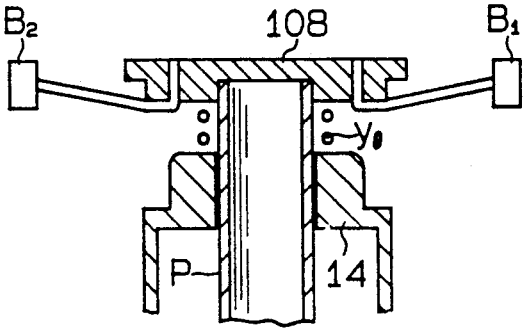

Fig. 16 (d2)
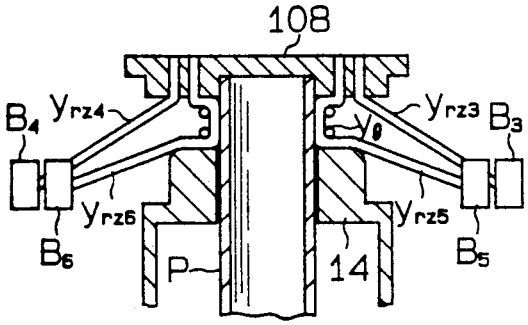
Fig. 16 (d1)
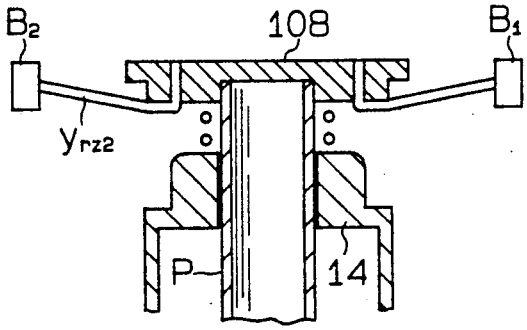
Fig. 16 (e2)
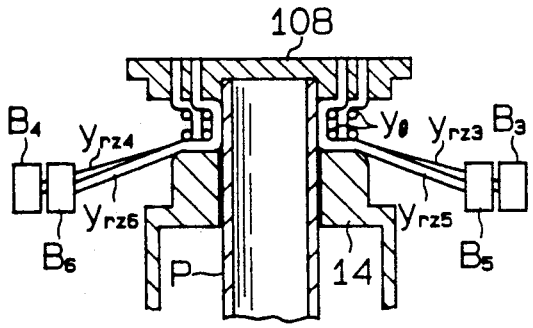
Fig. 16 (e1)
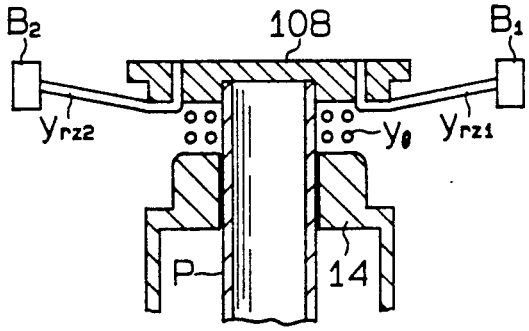
Fig. 16 (f2)
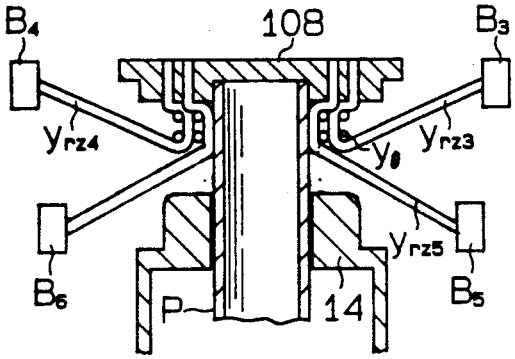
Fig. 16 (f1)
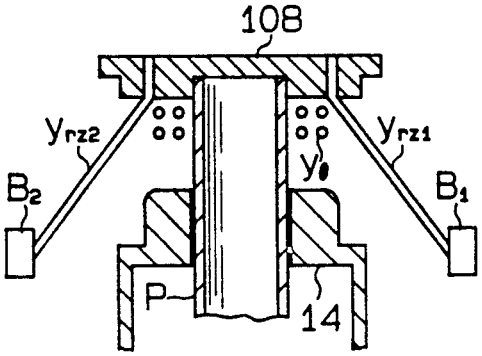

Fig. 16 (g2)
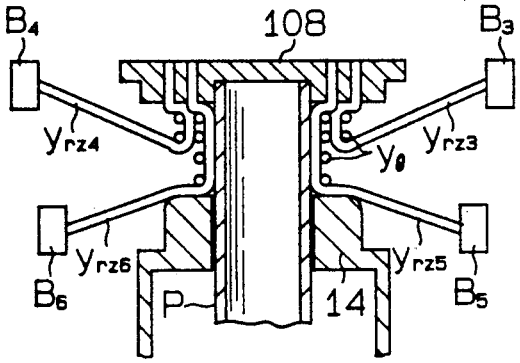
Fig. 16 (g1)
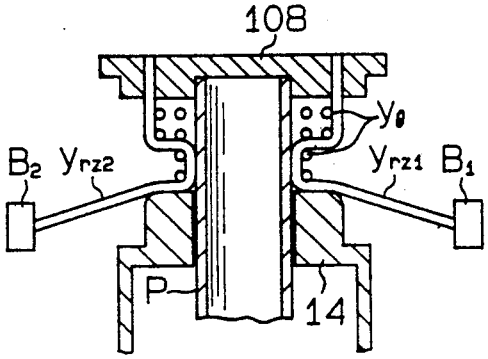
Fig. 16 (h2)
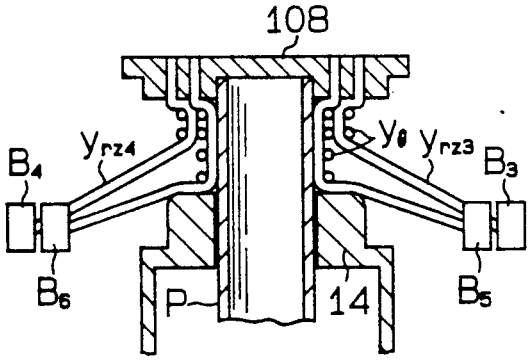
Fig. 16 (h1)
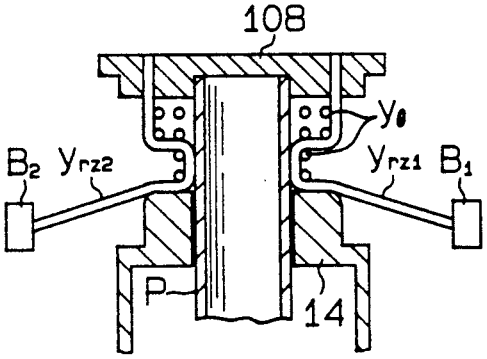
Fig. 16 (i2)
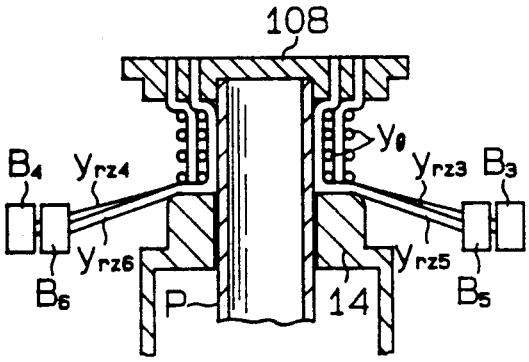
Fig. 16 (i1)
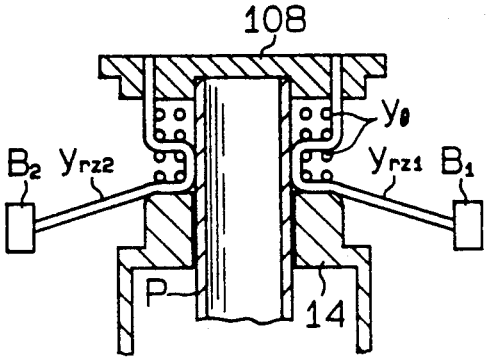

Fig. 16 (j2)
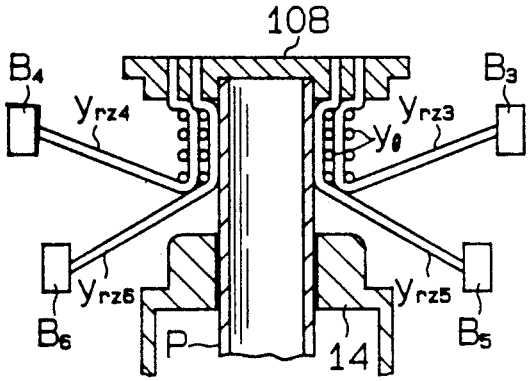
Fig. 16 (j1)
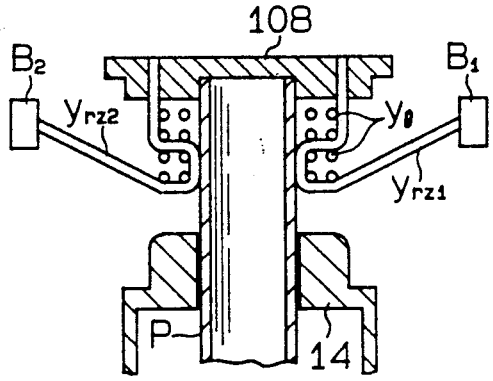
Fig. 16 (k2)
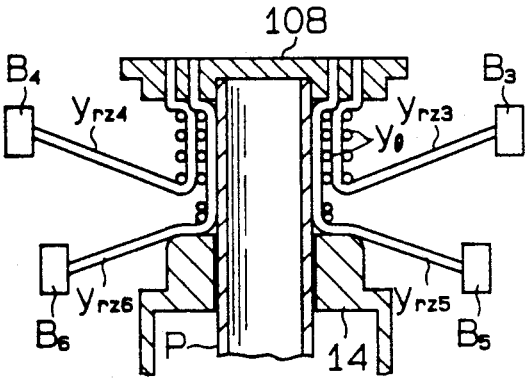
Fig. 16 (k1)
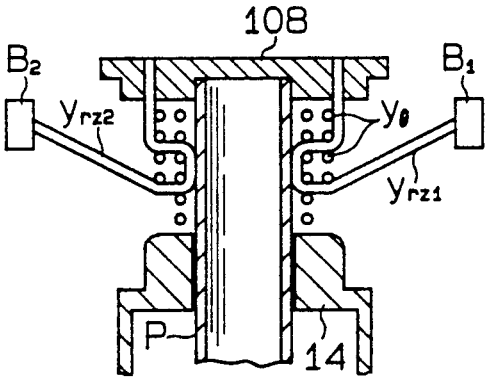
Fig. 16 (ℓ2)
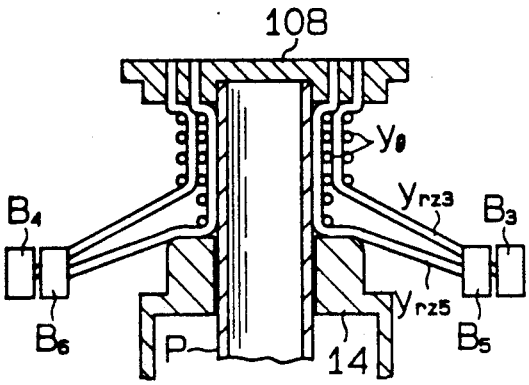
Fig. 16 (ℓ1)
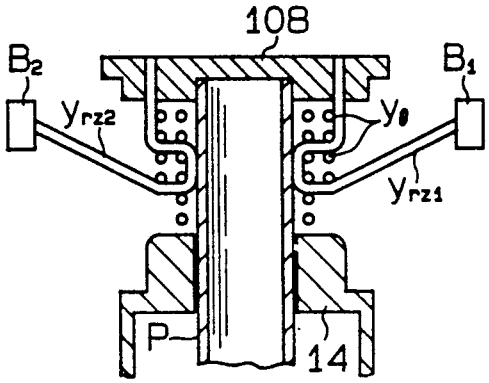

Fig. 16 (m2)
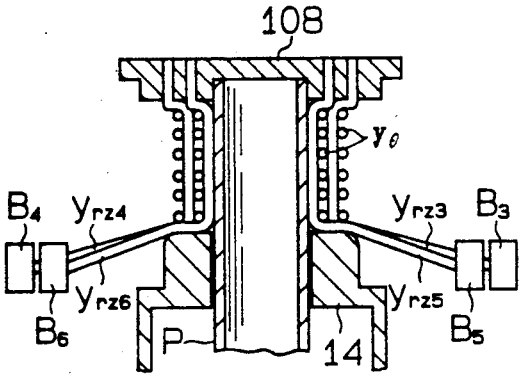
Fig. 16 (m1)
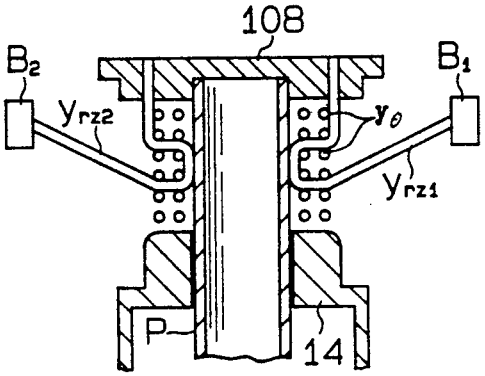
Fig. 17
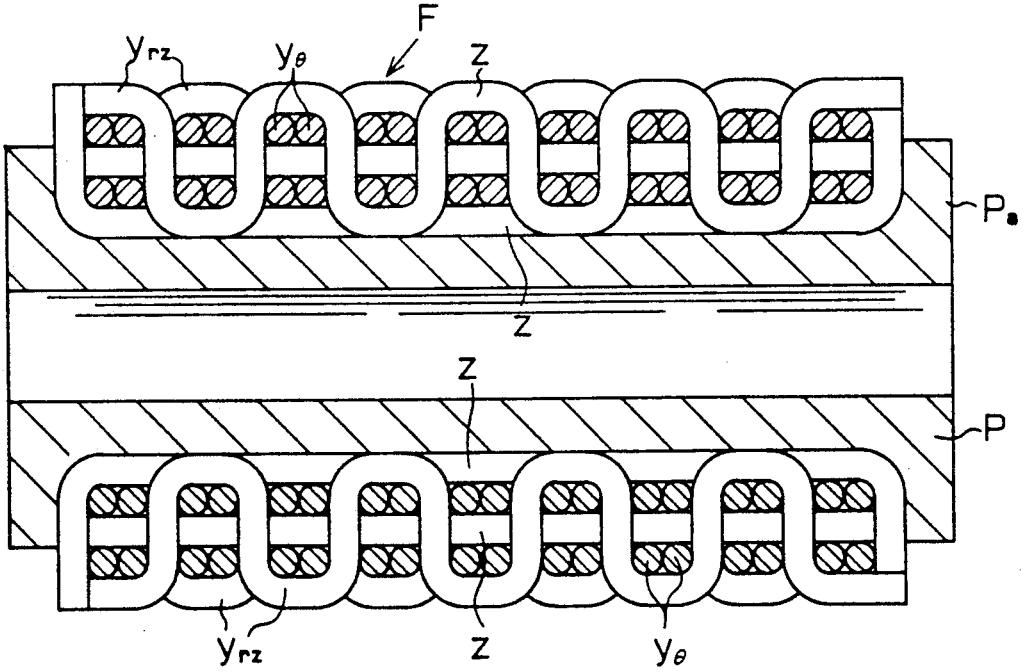

Fig.20 (b1)
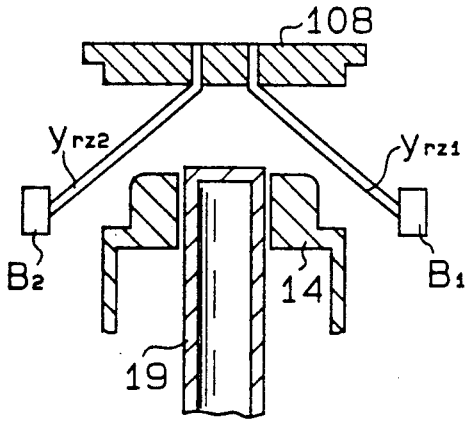
Fig.20 (a1)
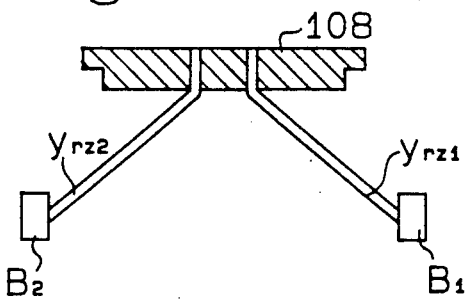
Fig.20 (b2)
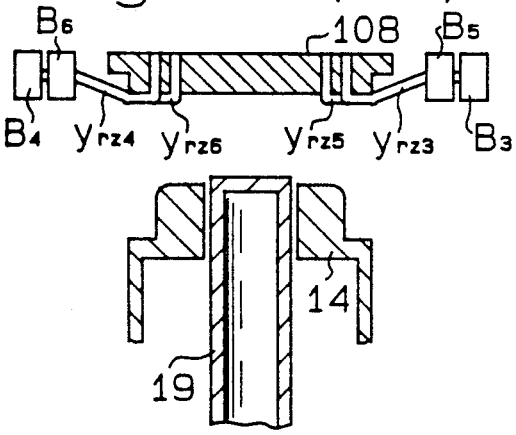
Fig.20 (a2)
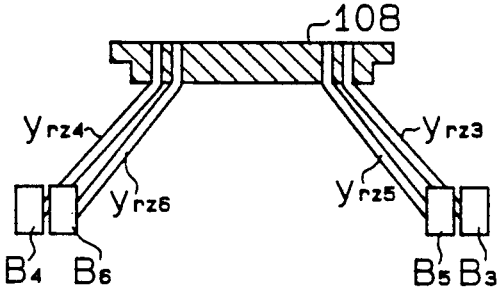
Fig.20 (b3)
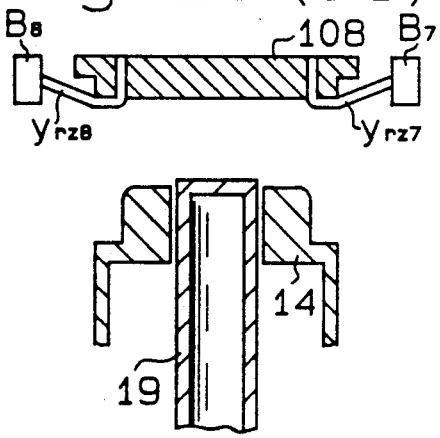
Fig.20 (a3)
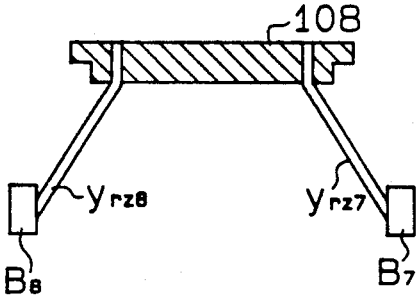

Fig. 20 (d1)
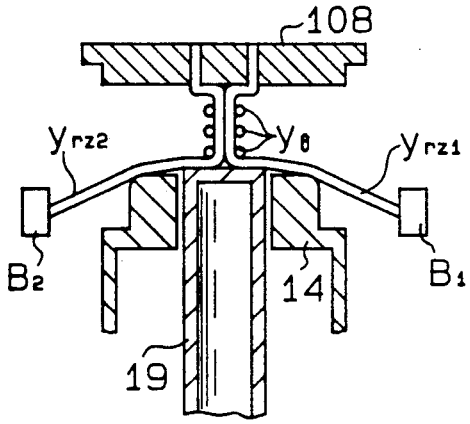
Fig. 20 (c1)
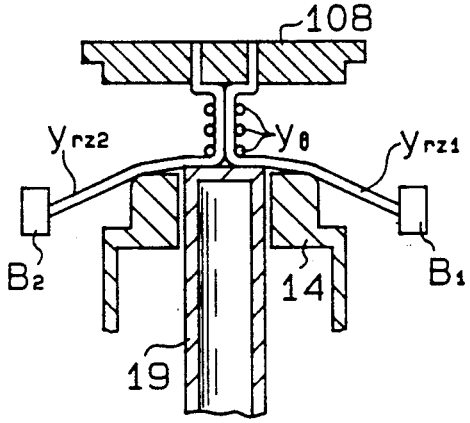
Fig. 20 (d2)
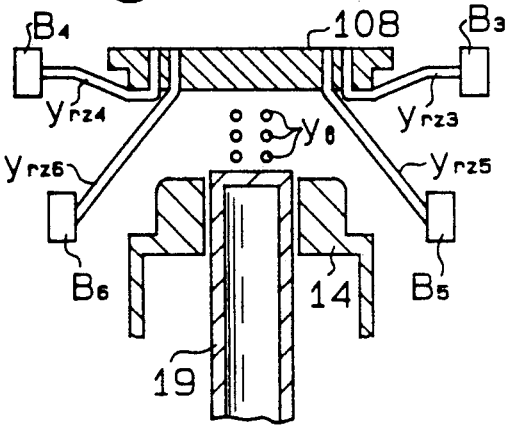
Fig. 20 (c2)
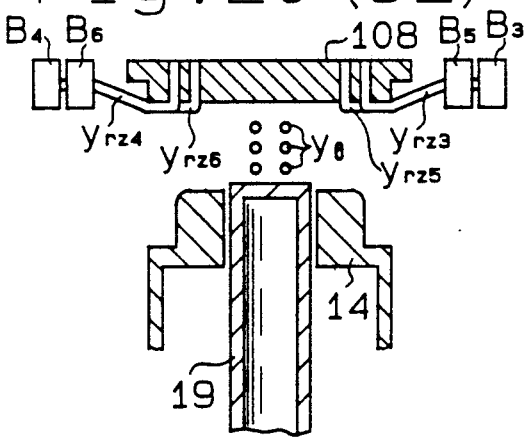
Fig. 20 (d3)
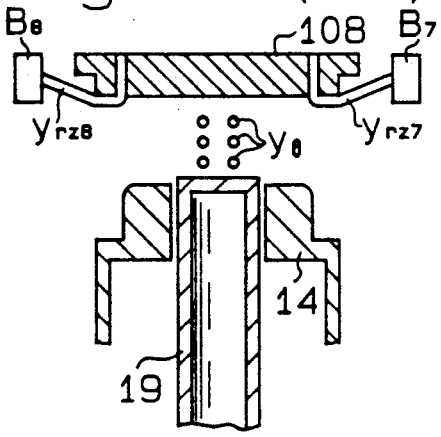
Fig. 20 (c3)
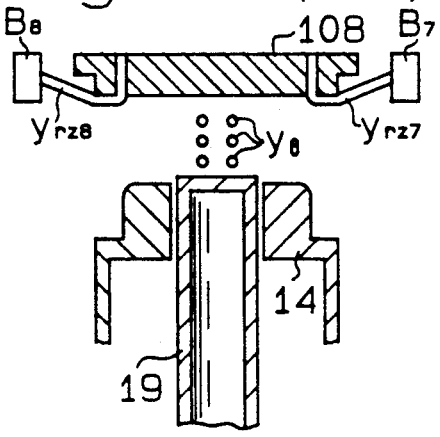

Fig.20 (f1)
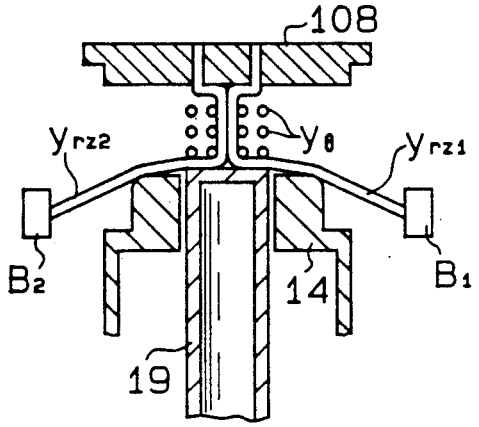
Fig.20 (e1)
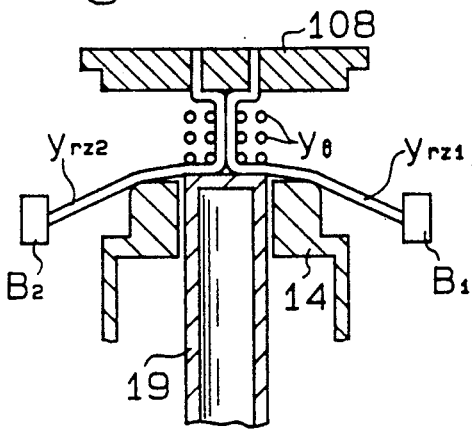
Fig.20 (f2)
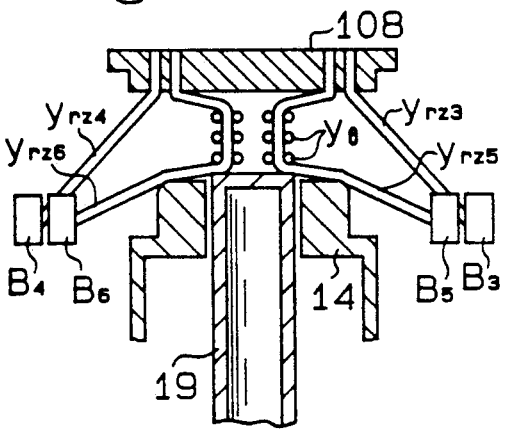
Fig.20 (e2)
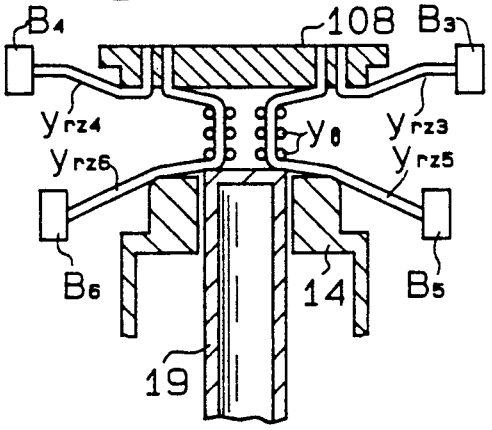
Fig.20 (f3)
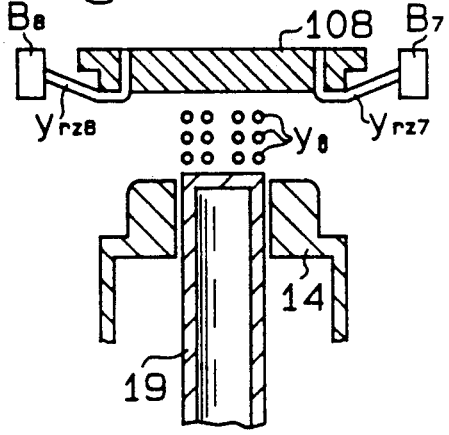
Fig.20 (e3)
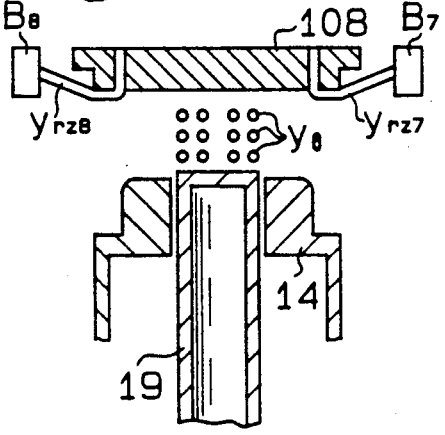

Fig.20 (h1)
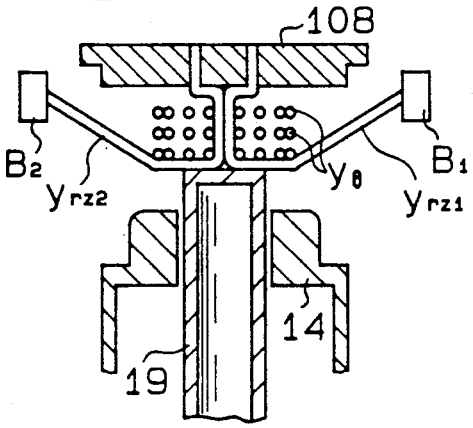
Fig.20 (g1)
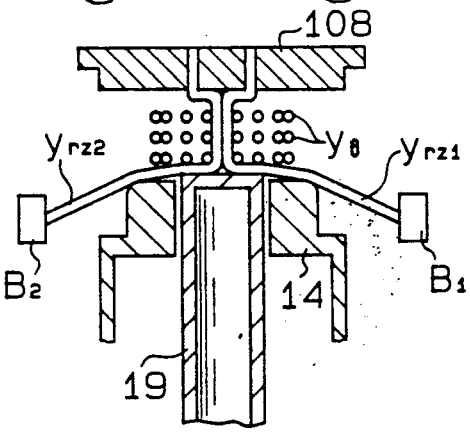
Fig.20 (h2)
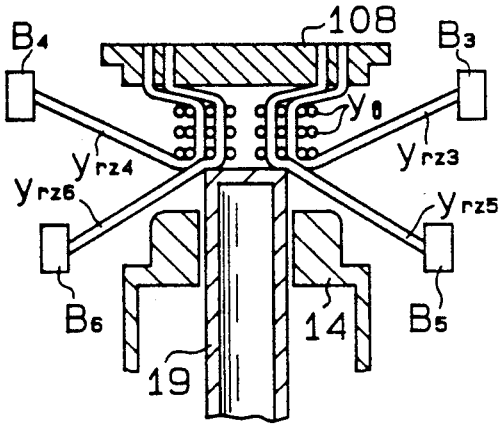
Fig.20 (g2)
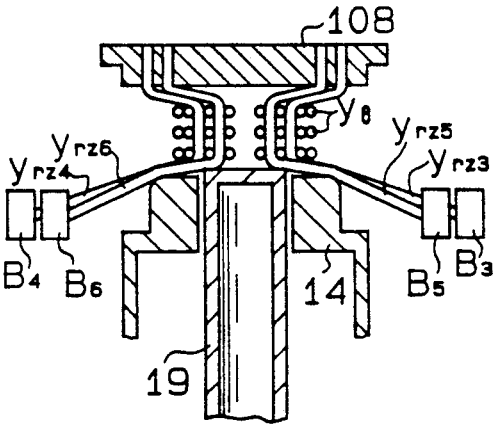
Fig.20 (h3)
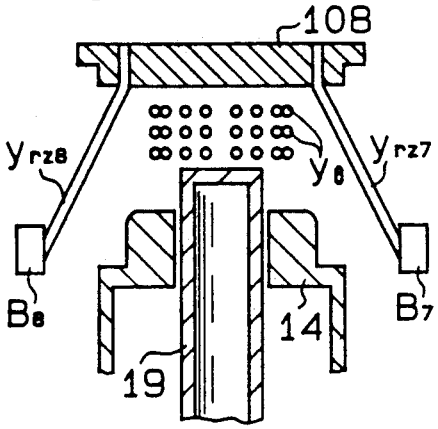
Fig.20 (g3)
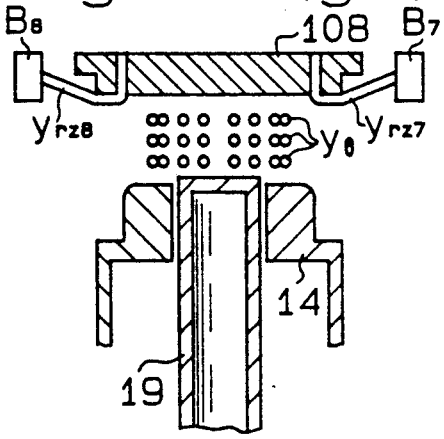

Fig. 20 (ℓ1)
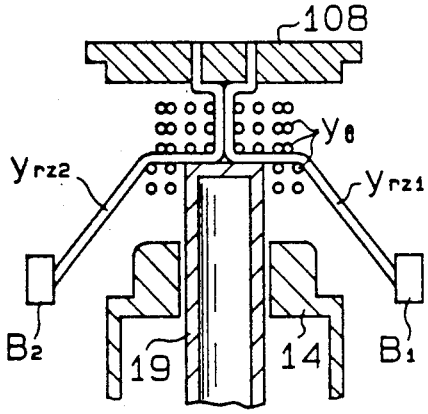
Fig. 20 (k1)
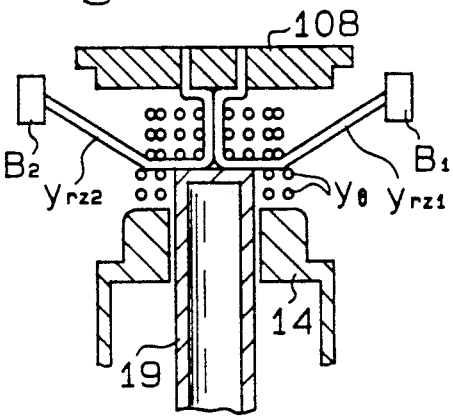
Fig. 20 (ℓ2)
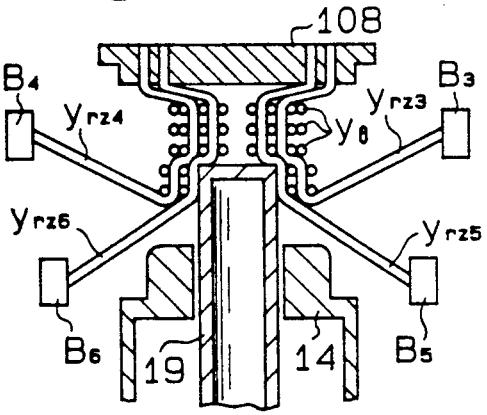
Fig. 20 (k2)
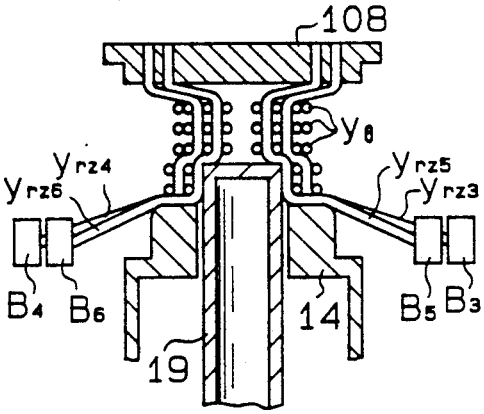
Fig. 20 (ℓ3)
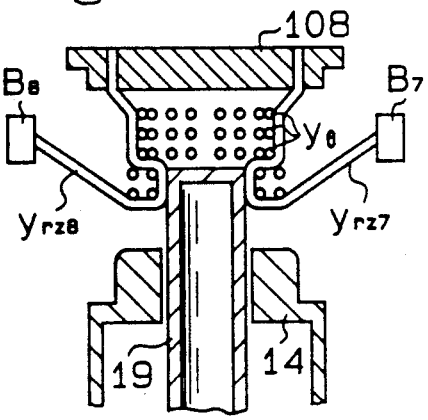
Fig. 20 (k3)
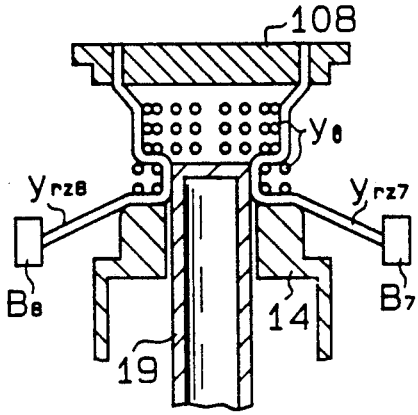

Fig. 20 (n1)
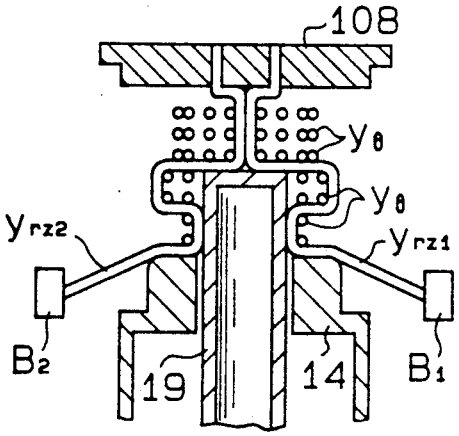
Fig. 20 (m1)
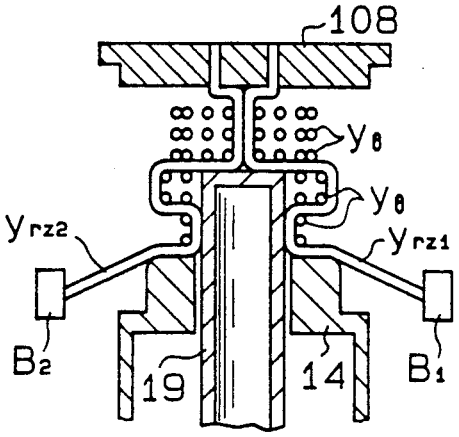
Fig. 20 (n2)
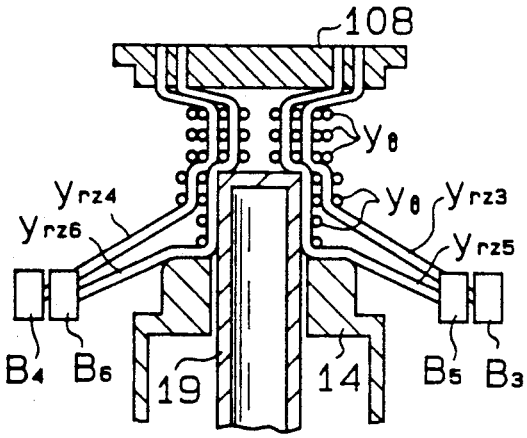
Fig. 20 (m2)
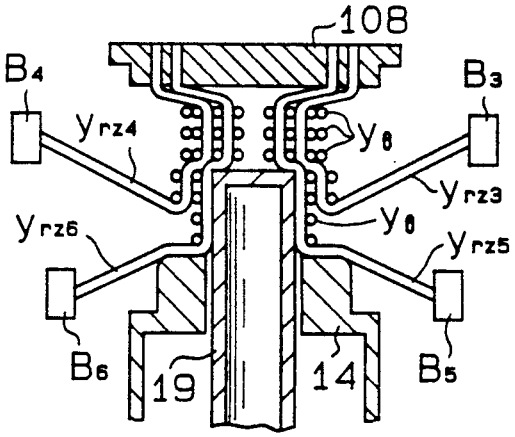
Fig. 20 (n3)
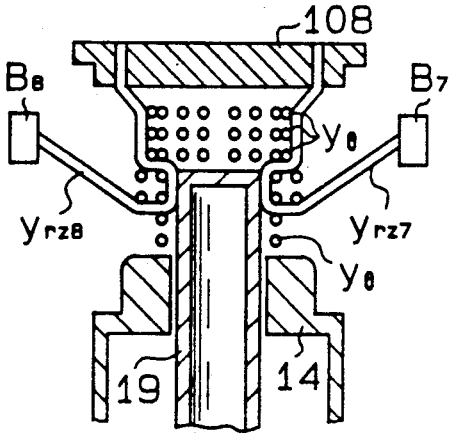
Fig. 20 (m3)
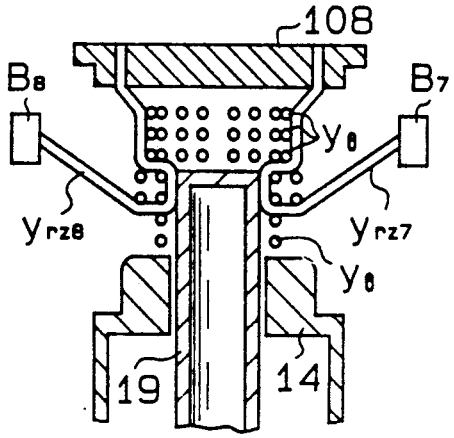

Fig. 20 (o1)
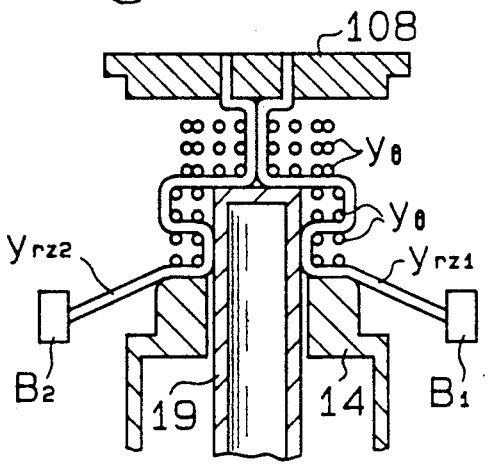
Fig. 20 (o2)
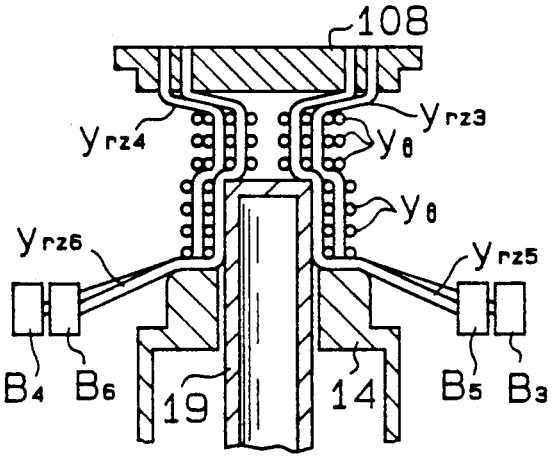
Fig. 20 (o3)
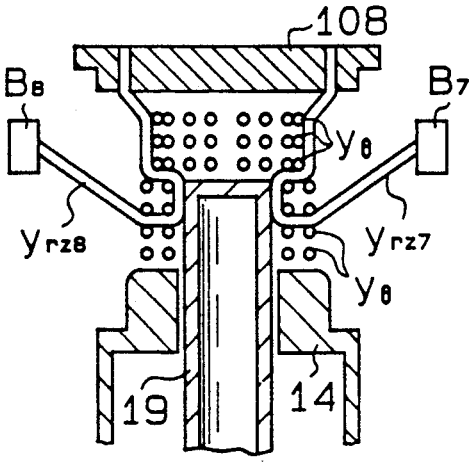

Fig.29 (a2)
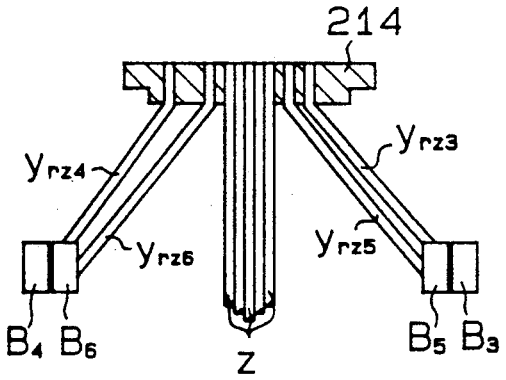
Fig.29 (a1)
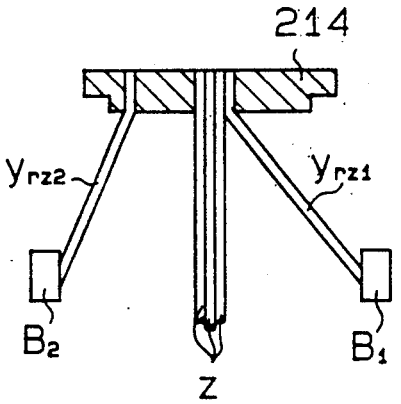
Fig.29 (b2)
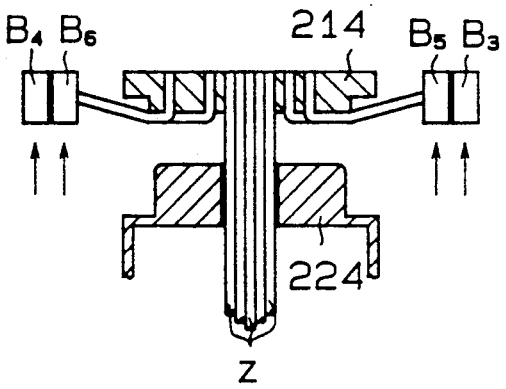
Fig.29 (b1)
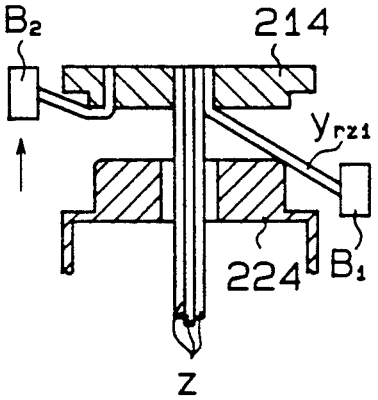
Fig.29 (c2)
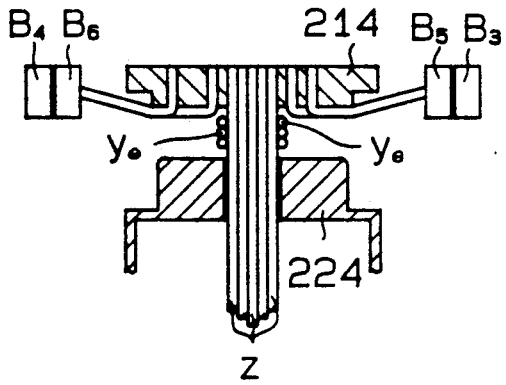
Fig.29 (c1)
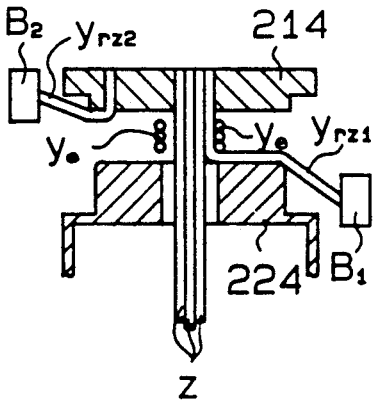

Fig. 29 (g2)
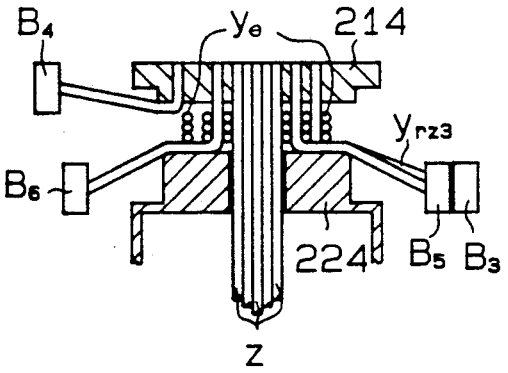
Fig. 29 (g1)
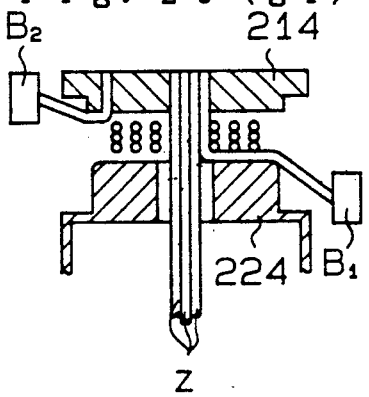
Fig. 29 (h2)
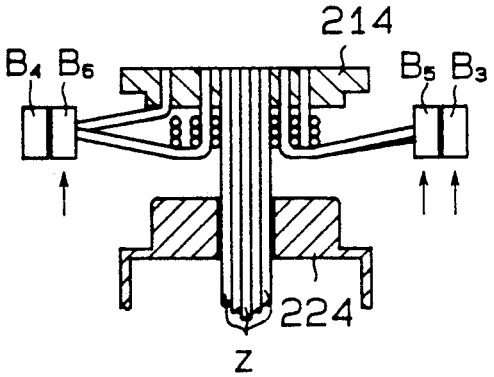
Fig. 29(h1)
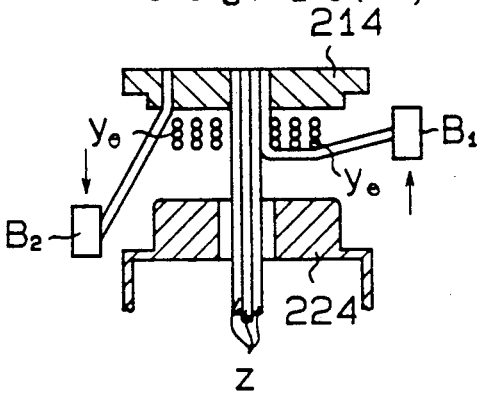
Fig. 29 (i2)
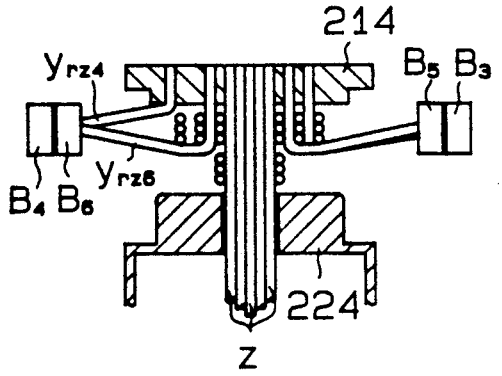
Fig. 29 (i1)
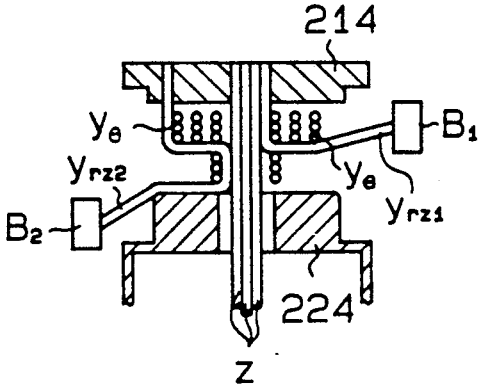

Fig. 29 (j2)
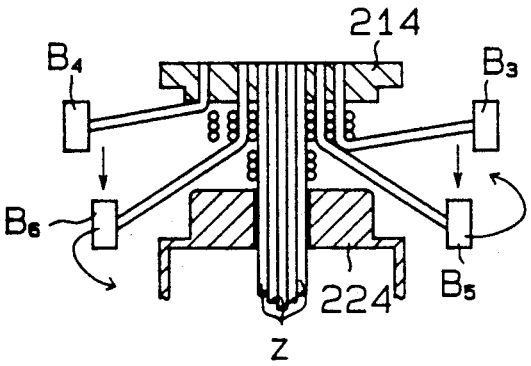
Fig. 29 (j1)
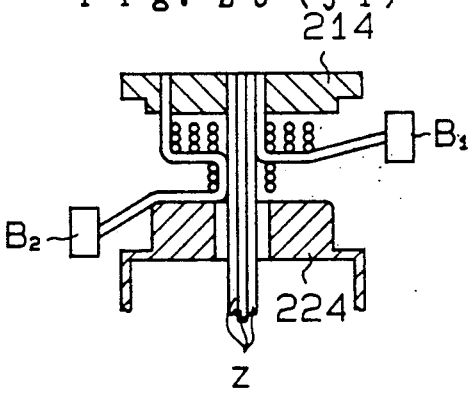
Fig. 29 (k2)
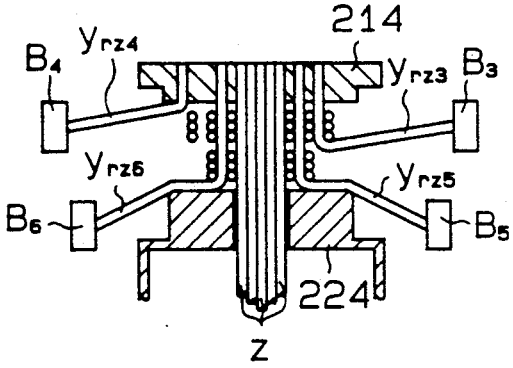
Fig. 29 (k1)
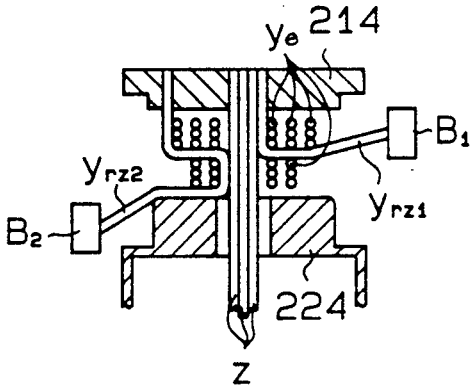
Fig. 29 (ℓ2)
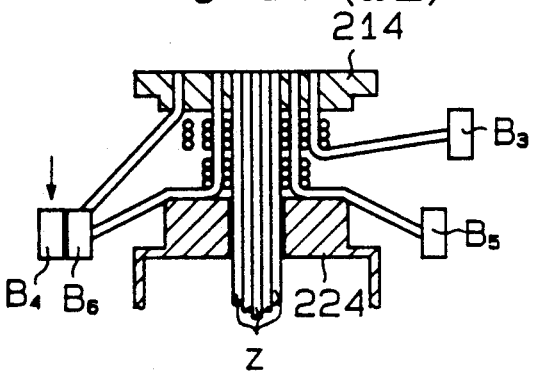
Fig. 29 (ℓ1)
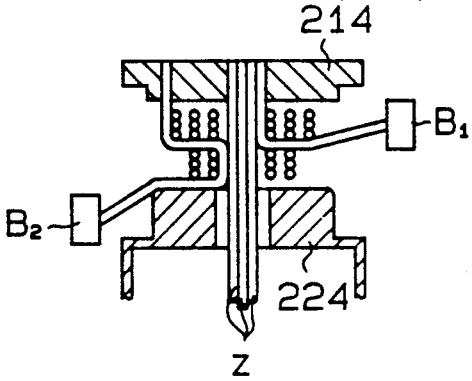

Fig. 29 (m2)
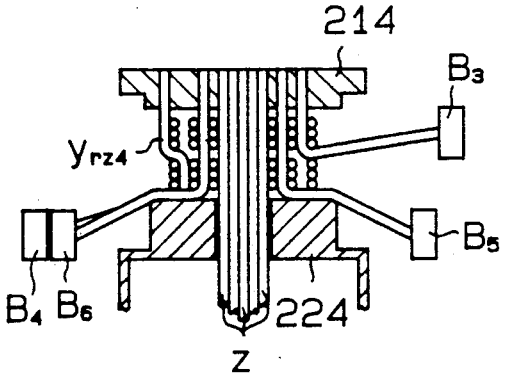
Fig. 29 (m1)
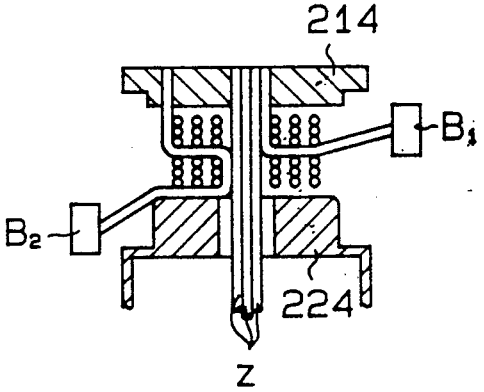
Fig. 29 (n2)
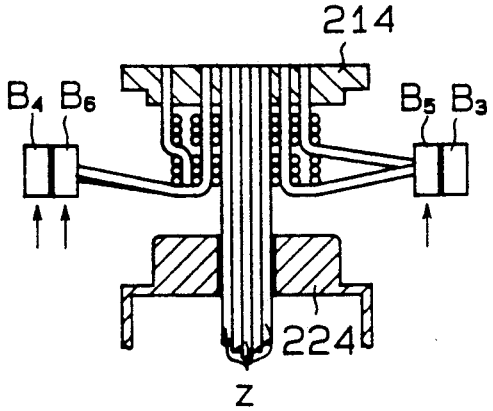
Fig. 29 (n1)
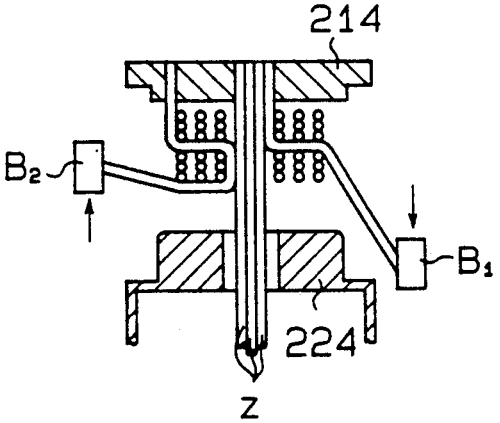
Fig. 29 (o2)
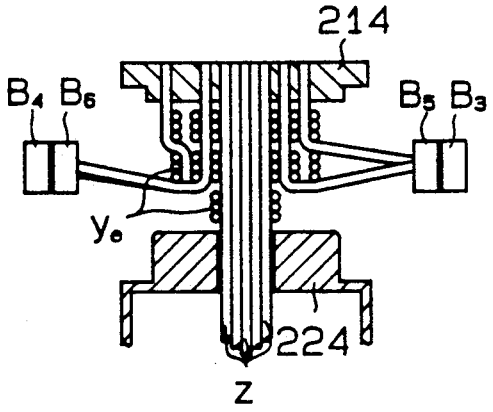
Fig. 29 (o1)
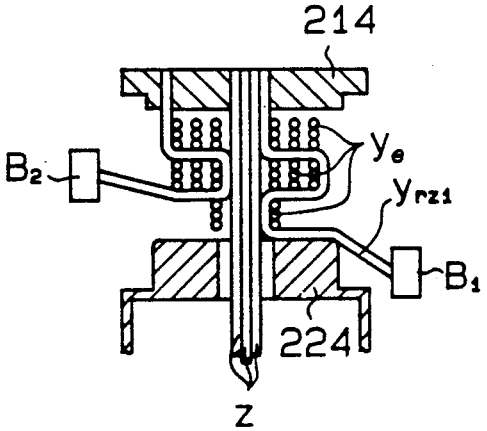

Fig. 29 (p2)
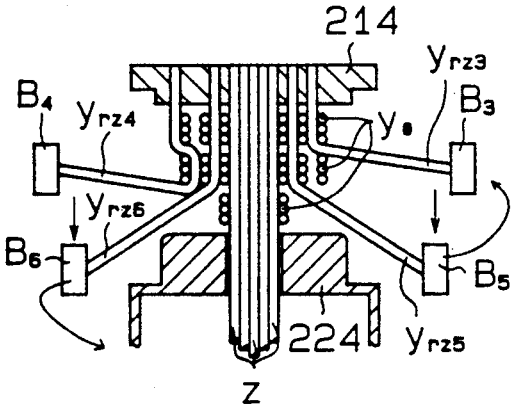
Fig. 29 (p1)
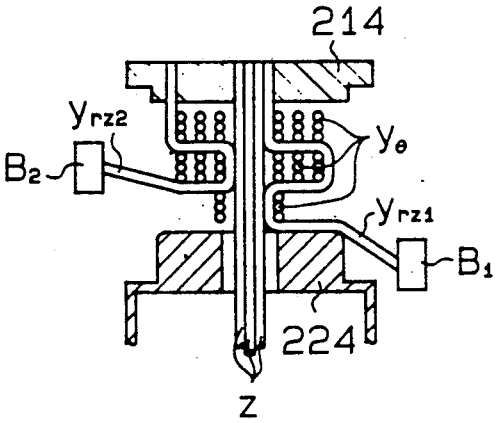
Fig. 29 (q2)
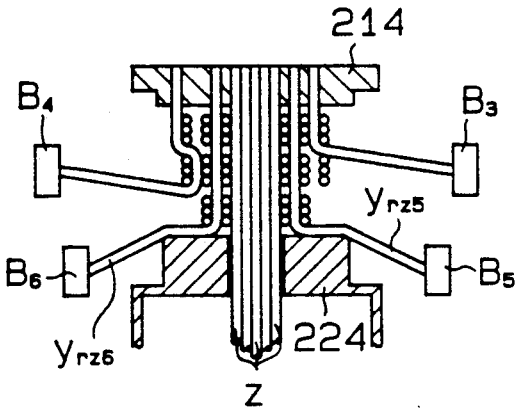
Fig. 29 (q1)
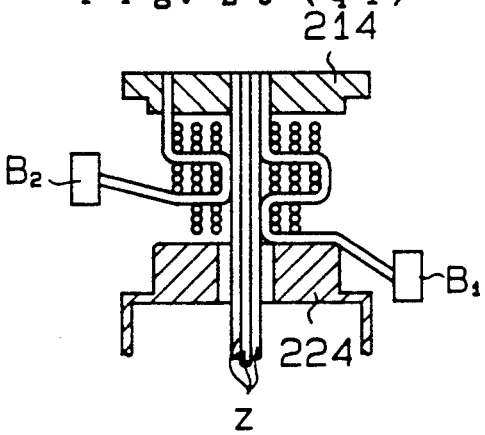
Fig. 29 (r2)
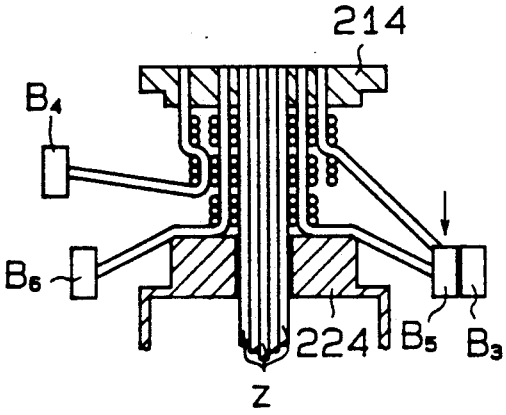
Fig. 29 (r1)
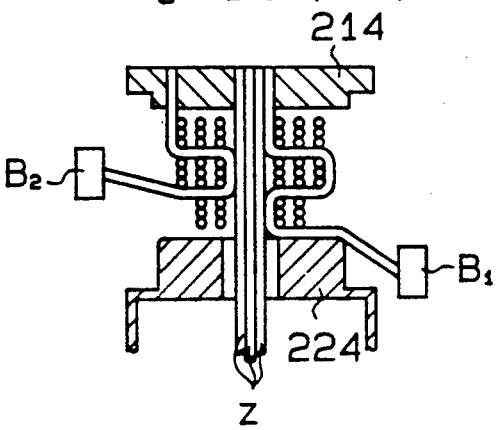

Fig. 29 (s2)
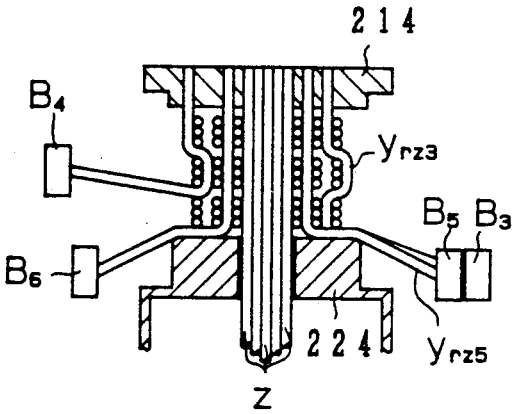
Fig. 29 (s1)
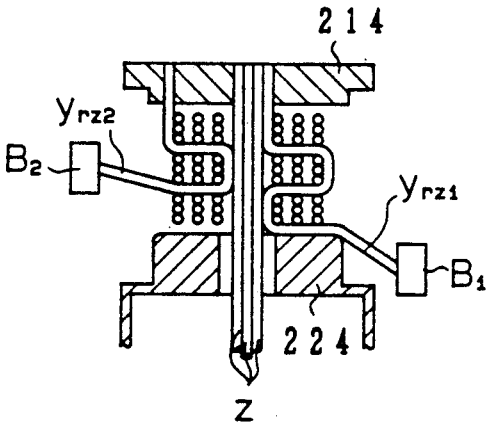
Fig. 30
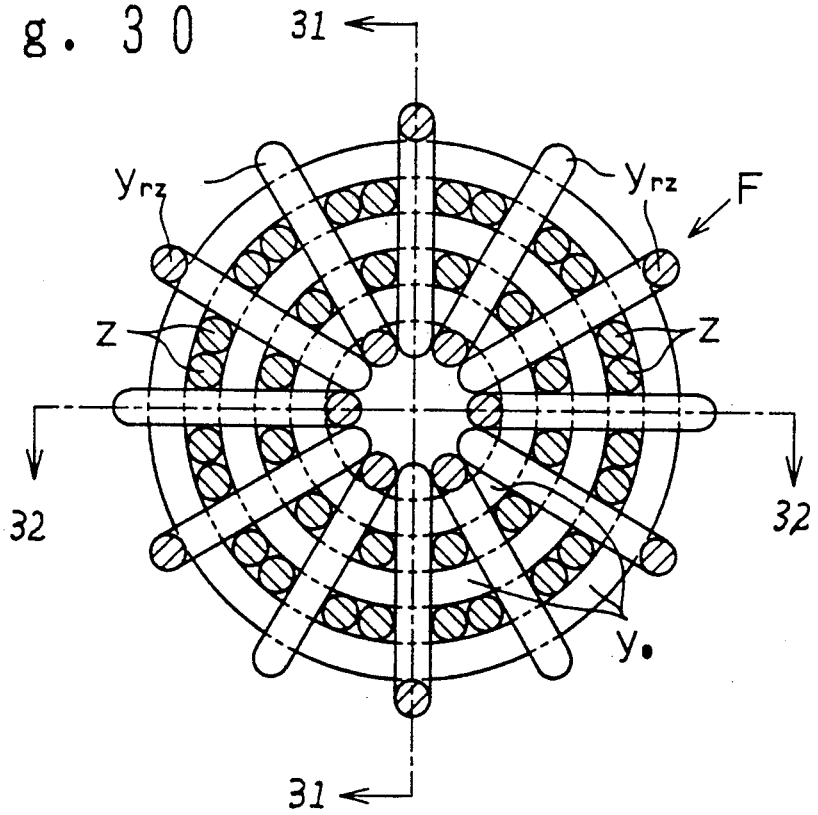

THREE DIMENSIONAL FABRIC AND METHOD FOR MAKING THE SAME

FIELD OF THE INVENTION

The present invention relates generally to a three dimensional fabric and a method for making the same. More particularly, a cylindrical fabric structure is described which is formed from axial yarns, circumferential yarns and radial yarns.

DESCRIPTION OF THE PRIOR ART

There are a wide variety of composite materials currently available that utilize three dimensional fabrics as their cores and are impregnated with a matrix of inorganic material. Such composite materials are expected to be used widely as structural materials for various devices including rockets, airplanes, automobiles, ships and buildings. Conventionally, three dimensional fabrics have taken a wide variety of shapes including square, cylindrical, flat and annular shapes.

A conventional three dimensional fabric is, for example, disclosed in Japanese Laid Open Patent Publication No. 56-142053. Namely, as shown in FIG. 35 (corresponding to FIG. 2 of the Japanese Publication), a mandrel (core material) M has a multiplicity of holes formed around its peripheral surface, and a multiplicity of rods R of carbon fiber reinforced plastic are protudingly inserted thereinto as radial yarn elements of the three dimensianal fabric. In this state, yarns hc are wound successively between the rods R around the mandrel M. The yarns hc are arranged in planes substantially perpendicular to the axis of the mandrel M. Yarns hd are wound about the mandrel M as shown such that they slant across the hc yarns. Yarns hg slant across the hc yarns in the direction opposite the yarns hd. These various yarns are successively woven to form an annular three dimensional fabric.

Another known annular three dimensional fabric comprises radial yarns arranged radially of the annular fabric, longitudinal yarns arranged substantially parallel to the fabric's axis, and circumferential yarns arranged circumferentially about the fabric's axis. The radial yarns are turned about the inner and outer sides of the annular fabric, to prevent the circumferential yarns placed at the innermost and outermost perimeter of the annular fabric from separating. A method for manufacturing the three dimensional fabric of the above structure is disclosed, for example, in Japanese Laid Open Patent Publication No. 61-201063. In the method shown in FIGS. 36 and 37 (corresponding, respectively, to FIGS. 3 and 2 of the Japanese Publication), a multiplicity of yarn guiding pipes 62 are radially inserted in a tubular base plate 61 so as to be movable outward in the radial direction. Plate like spacers 63 are disposed radially between adjacent yarn guiding pipes 62 around the surface of the base plate 61. The three dimensional fabric is manufactured using a core member with the spacers fixed by wires 64. The wires 64 are wound around along the free ends of the spacers 63 to extend in an annular way between the yarn guiding pipes 62.

In this method, a first endless yarn 65 is initially wound along the circumference of the base plate 61 on a layer of another first endless yarns 65. The same layer is obtained by disposing zigzag the first endless yarn 65 along the yarn guiding pipes 62 while looping it at the opposite ends of the core member in the axial direction of the base plate 61 or the direction perpendicular to the paper of FIG. 37. The same operation is repeated a predetermined number of times (n times), to form layers of first endless yarn 65 on the spacer 63. Next, loops of a second endless yarn 66 are inserted into the yarn guiding pipes 62 from inside the base plate 61. Thereafter, the yarn guiding pipes 62 are pulled outward beyond the outer surface of the layers of first endless yarn 65 and removed. Thus, the loops of the second endless yarn 66 extend outside of the outer surface of the layers of first endless yarn 65. A third endless yarn 67 is inserted as a tacking yarn into the pulled out loops of the second endless yarn 66. Then the layers of first endless yarn 65 are tightened by the second and third endless yarns 66 and 67, thus forming a three dimensional fabric.

The method shown in the Laid Open Patent Publication No. 56-142053 as described above, has the drawbacks of requiring the insertion of the rods R into the mandrel M before the yarns are wound. Moreover, gaps are apt to be formed between the yarns themselves and between the yarn and rod R, so that it is hard to increase the density of the fibers contained in the fabric. An additional disadvantage is that removing the work from the mandrel M after the fabric has been wound is also a bother. Another problem is that the density of the radial yarns decreases towards the outer surface of the three dimensional fabric in the radial direction, since the interval between the rods R is wider as it goes outward. Furthermore, the described method is only capable of producing tubular shaped structures. That is, it is impossible to make up a cylindrical fabric with its center filled up with fibers.

On the other hand, the method disclosed in the Laid Open Patent Publication No. 61-201063 requires very delicate and complicated works. Namely, it requires: the insertion of the second endless yarn 66 (which constitutes the yarns arranged radially within the annular fabric) into the yarn guiding pipes 62; the removal of the yarn guiding pipes 62 from the base plate 61; and the insertion of the third endless yarn 67 as a tacking yarn into the loops of the second endless yarn 66. As these steps must be done by hand, the fabrics produced according to the method have little reproducibility and reliability as industrial products. In addition, the density of the yarns forming the annular fabric may be limited by the thickness of the yarn guiding pipes 62. Although the yarn density may be increased a little by tightening the endless yarns 66 and 67, such efforts can create additional problems. Specially, yarn materials with low elasticity, like carbon, may be damaged due to the strong squeezing effect induced by tightening and may be subject to the occurance of fluffs. Moreover, fabric produced according to this method has a problem similar to fabric produced according to the previously mentioned method in that it is limited to a tubular structure which has a lower density of radial yarns towards its outer periphery.

In recent years, fiber reinforced plastics (FRP) have been extensively substituted for metal members due to their lighter weight. One application where FRP has been used is in tubular piping. However, pipes or the like, which are manufactured by impregnating conventional three dimensional fabrics of tubular shape as described above with resin, are disadvantageous in that it is hard to get the inner surface formed with high dimensional accuracy and/or it is difficult to maintain good air tightness. Further, such prior art FRP pipes are not well suited for applications which strictly require resistance to oil and/or chemicals. In such applications metal remains the material of choice.

Yet another proposed method for making an annular composite structure, is the so-called filament winding technique, in which reinforcing materials of continuous filaments (such as glass, boron, silicone carbide, etc.) are wound around a rotating core in tension while impregnating the same materials with a matrix material. The impregnation may be carried out in anticipation to the winding or at the time of winding.

However, composite structures made by filament winding do not have any fiber-like reinforcing materials that penetrate each layer of the continuous filaments, which are wound in a multiplicity of layers. That is, they lack means for securing each of the layers. Consequently, slippage can easily occur between the layers, thereby lessening the composite material's strength.

SUMMARY OF THE INVENTION

It is an object of the present invention to provide a three dimensional fabric with a novel structure which is able to be woven in a easier way than conventional three dimensional fabrics having annular shapes, and which solves most of the problems of the prior art, and to provide a method for making the same.

It is independent object of the invention to provide a three dimensional fabric which is suitable for use as framework of a three dimensional fabric composite, and which is applicable to fields which strictly require dimensional accuracy of the inner surface, oil resistance and/or chemical resistance.

In order to achieve the above objects, the three dimensional fabric of the present invention is woven using three types of yarns. That is axial yarns, circumferential yarns and radial yarns. A plurality of tubular axial yarn layers are arranged concentrically about and outward from the fabric's axis. Each of the axial yarn layers has a plurality of axial yarns extending longitudinally relative to the axis. A circumferential yarn is wound circumferentially around the axis and its turns are disposed in several positions including an outside of an outermost axial yarn layer, inside of an innermost axial yarn layer, and between the inner and outer axial yarn layers. A plurality of radial yarns are provided with each radial yarn being woven between the circumferential yarns to extend zigzag successively in the longitudinal and radial directions relative to the axis, while being substantially perpendicular to the circumferential yarns. The radial yarns are each woven in a particular plane that extends through the axis.

The three dimensional fabric may be woven to form a hollow portion to the inside of the innermost axial yarn layer. The hollow portion may be cylindrical in shape. In such embodiments a tubular member is inserted into the hollow portion.

In a method aspect of the invention for making the three dimensional fabric, a plurality of steps are followed to weave the fabric. Initially a center member having an axis is placed at a prescribed position. In a second step, the first ends of a plurality of first yarns are fixed around a first end of the center member, so as to define a plurality of layers concentrically arranged about the axis of the center member. In a third step, one end of a second yarn is fixed near the axis of the center member. In a fourth step, the second end of a first selected group part of the first yarns is positioned to the side of a second end of the center member so as to tighten the selected yarns in a radially extending state. The second yarn is then wound around the center member and the tightened first selected group of first yarns so as to urge the first selected group of the first yarns toward the axis, thereby turning the wound second yarn into circumferential elements while making the portions of the first selected group of first yarns inside the circumferential elements into axial elements. In a fifth step, the second ends of a second group of the first yarns are positioned to the side of the first end of the center member so as to tighten the second group of the first yarns while keeping them radially extending. The second yarn is then wound around the center member such that the second group of the first yarns remain free of the second yarn turns. And the second yarn is wound into first circumferential elements. In a sixth step, which follows the fifth step, the second ends of a selected portion of the first yarns are positioned to the side of the second end of the center member so as to tighten the selected yarns in a radially extending state. The second yarn is then wound around the center member and the selected portion of first yarns so as to urge the selected portion of first yarns toward the axis, thereby turning the wound second yarn into second circumferential elements while making portions of the selected portion of first yarns between the first and second circumferential elements into radial elements. The fourth through sixth steps are selectively repeated so as to weave axial yarns, radial yarns and circumferential yarns around the outer periphery of the center member.

Other and further objects of this invention will become obvious upon understanding the illustrative embodiments about to be described or will be indicated in the appended claims, and various advantages not referred to herein will occur to those skilled in the art upon employment of the invention in practice.

BRIEF DESCRIPTION OF THE DRAWINGS

FIGS. 7 (*a*2) to (*s*2) are sequential schematic cross sectional views showing the progression of the weaving operation as seen along the line 3—3 of FIG. 1.

FIG. 8 is a sectional view of a three dimensional fabric of a second embodiment.

FIGS. 16 (*a*1) to (*m*1) are sequential schematic cross sectional views showing the progression of the weaving operation as seen along the line 16*a*—16*a* of FIG. 14.

FIGS. 16 (*a*2) to (*m*2) are sequential schematic cross sectional views showing the progression of the weaving operation as seen along the line 16*b*—16*b* of FIG. 14.

FIG. 17 is a sectional view of a three dimensional fabric of a fourth embodiment.

FIGS. 29 (*a*2) to (*s*2) are sequential schematic cross sectional views showing the progression of the weaving operation as seen along the line 25—25 of FIG. 23.

FIG. 30 is a sectional view of a three dimensional fabric of an eighth embodiment.

DETAILED DESCRIPTION OF THE PREFERRED EMBODIMENTS

First Embodiment

A first embodiment characterizing this invention will be hereafter described referring to FIGS. 1 to 7.

Figure 5:
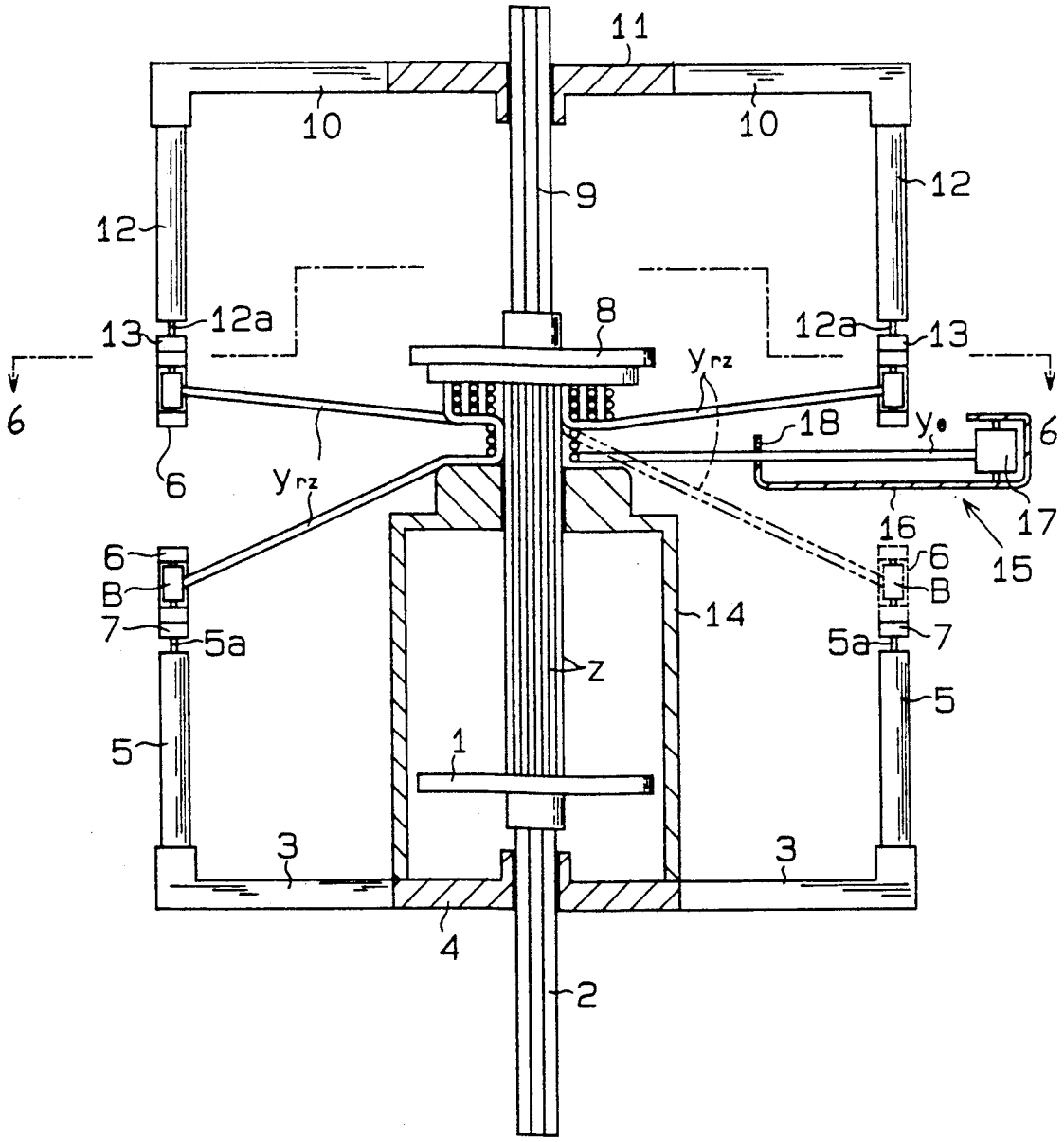
FIG. 5 is partially broken schematic front view of a three dimensionally weaving machine.

As shown in FIG. 5, a three dimensionally weaving machine has a vertically divided structure with a weaving portion therebetween. A yarn fixing table 1, for holding one end of center axial yarns, is disposed at the center of the lower side of the weaving machine. The table 1 is carried by a splined shaft 2 and is rotatable therewith. The table is also vertically movable. A support 4 has a multiplicty of radially extending arms 3 and is fitted to the splined shaft 2 so as to be rotatable integrally with the splined shaft 2 at a prescribed height position. The splines shaft 2 is arranged to move up and down vertically in relation to the support 4. The vertical movement of the splined shaft 2 is controlled by a drive mechanism (not shown). An air cylinder 5 is fixed at the free end of each arm 3 and extends upward. A holder support 7 coupled to an air cylinder 5 carries a bobbin holder 6, that is formed from a magnetic substance, by the action of an electromagnet. The support 7 is mounted on the free end of a piston rod 5*a* of the air cylinder 5. A bobbin B with a radial yarn yrz would therearound is detachably fitted to the bobbin holder 6.

A yarn fixing table 8, which functions as a yarn support, holds the other ends of the center axial yarns and anchors all three kinds of yarns that will constitute the fabric. The table 8 is arranged symmetrically above the yarn fixing table 1 and is carried by a splined shaft 9 just as yarn fixing table 1 is carried by the shaft 2. Thus, the table 8 is vertically movable and rotatable together with a splined shaft 9. A support 11 has a multiplicity of radially extending arms 10 like the support 4. It is fitted on the splined shaft 9 such as to be rotatable integrally therewith at a predetermined height position. Both the splined shafts 2 and 9 are completely separated, but adapted to rotate and vertically move in fixed directions in synchronization with each other. An air cylinder 12 is fixed to the free end of each arm 10 and extends downward. A holder support 13 coupled to the air cylinder 12 also has an electromagnet suitable for carrying the bobbin holder 6, as previously mentioned with respect to the holder supports 7. The support 13 is mounted on the free end of a piston rod 12*a* of the air cylinder 12. The various holder supports 7 and 13 are placed opposite one another at such positions that each individual support is vertically aligned with a particular one of the opposing supports. Each pair of the supports 7 and 13 cooperate to transfer a single bobbin holder 6 back and forth between themselves. Vertical movement is accomplished by the operation of the air cylinders 5 and 12 and through magnetization and demagnetization of the respective electromagnets.

A guide frame 14 is provided on the upper surface of the center of the support 4 for the purpose of regulating the weaving position. A circumferential yarn supplier 15 is arranged outside the bobbin holder 6, at substantially the same height position as the upper end surface of the guide frame 14. The circumferential yarn supplier 15 includes a support frame 16 that is disposed in the radial direction about the splined shafts 2 and 9. A circumferential yarn bobbin 17 is detachably coupled to the outer perimeter of the support frame 16, and has a circumferential yarn y$\theta$ wound thereon. A yarn guide 18 is provided for guiding the circumferential yarn y$\theta$ drawn out of the circumferential yarn bobbin 17 to the weaving position. When desired, a yarn tensioning device (not shown) may also be provided. The yarn guide 18 is made of an abrasion resistant material.

Now, a weaving operation of a typical three dimensional fabric will be explained using the above mentioned machine as well as a plurality of radial yarns and a circumferential yarn.

Figure 6:
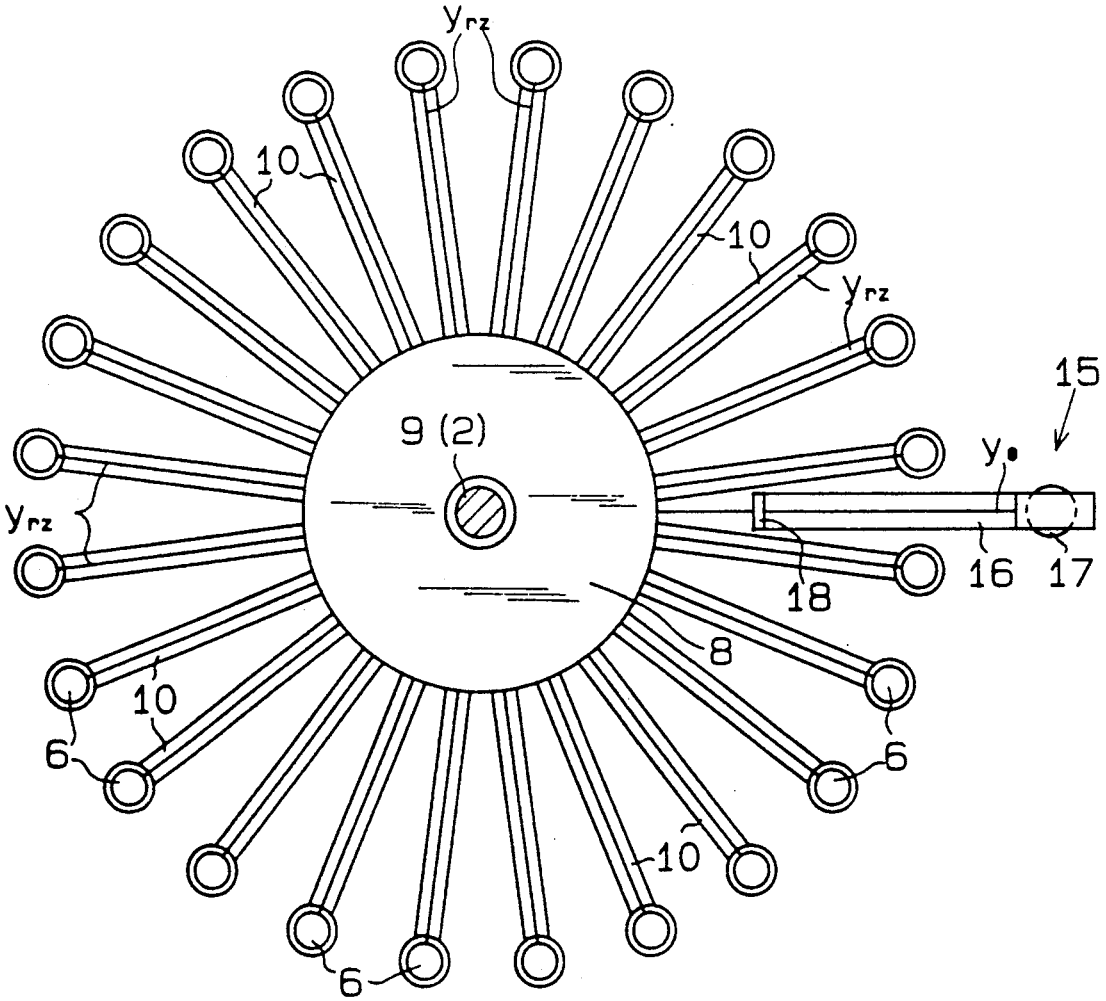
FIG. 6 is a sectional view taken along the line 6—6 of FIG. 5.

Axial yarns z are tightly strung between the centers of both the yarn fixing tables 1 and 8 before the weaving operation of the three dimensional fabric. One end of each of the radial yarns yrz is drawn out of the bobbins B fitted respectively into the bobbin holders 6. The drawn ends of radial yarns yrz are fixed to the upper yarn fixing table 8 so as to define a multiplicity of strands extending radially outward from the center of the table. Thereby, as shown in FIG. 6, the radial yarns yrz are radially disposed about the splined shafts 2 and 9. One end of the circumferential yarn y$\theta$, which is drawn out of the circumferential yarn bobbin 17, is fixed to the upper yarn fixing table 8. Once all of the lines are appropriately fixed, the weaving operation may start with the bobbin holders 6 being held by either the upper or lower holder supports 7 and 13 in accordance with a weaving condition.

As shown in FIG. 5, the radial yarns yrz are positioned above the circumferential yarn y$\theta$, when the bobbin holders 6 are held by the upper holder supports 13 and placed at upper positions. The radial yarns yrz cross the circumferential yarn y$\theta$ (as shown by the two-dot chain line in FIG. 5), when the bobbin holders 6 are held by the lower holder supports 7 and placed at lower positions. When the holder supports 7 and 13 are rotated about the center axial yarns, the radial yarns yrz that are held in the lowered position crossing the circumferential yarn y$\theta$ are pressed longitudinally along the peripheral surface of the three dimensional fabric on the way of weaving by the action of the circumferential yarn y$\theta$.

Figure 2:
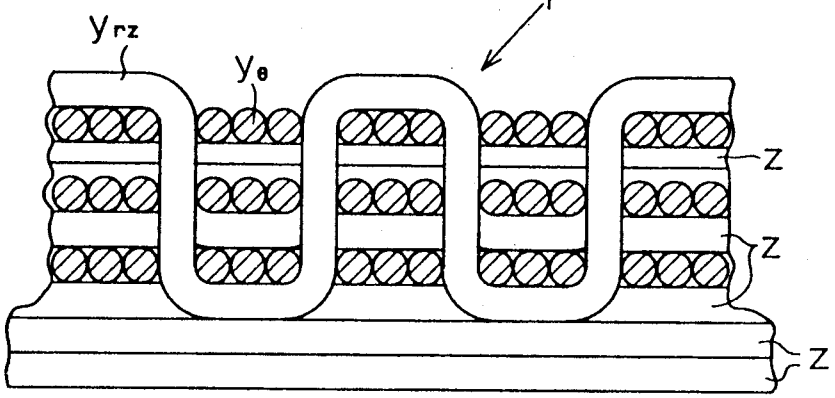
FIG. 2 is a sectional view taken along the line 2—2 of FIG. 1.
Figure 3:
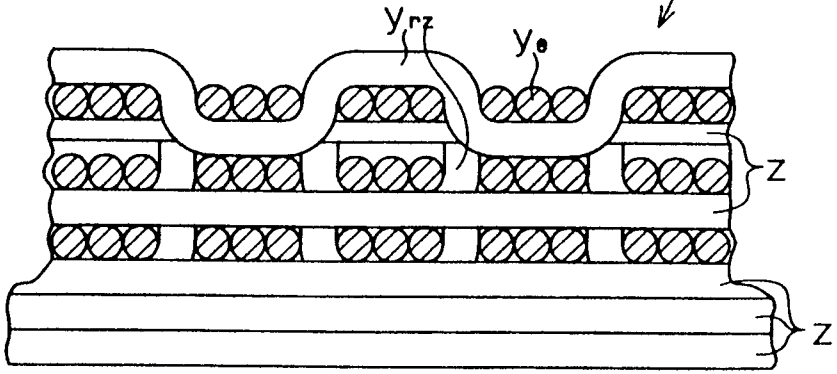
FIG. 3 is a sectional view taken along the line 3—3 of FIG. 1.
Figure 1:
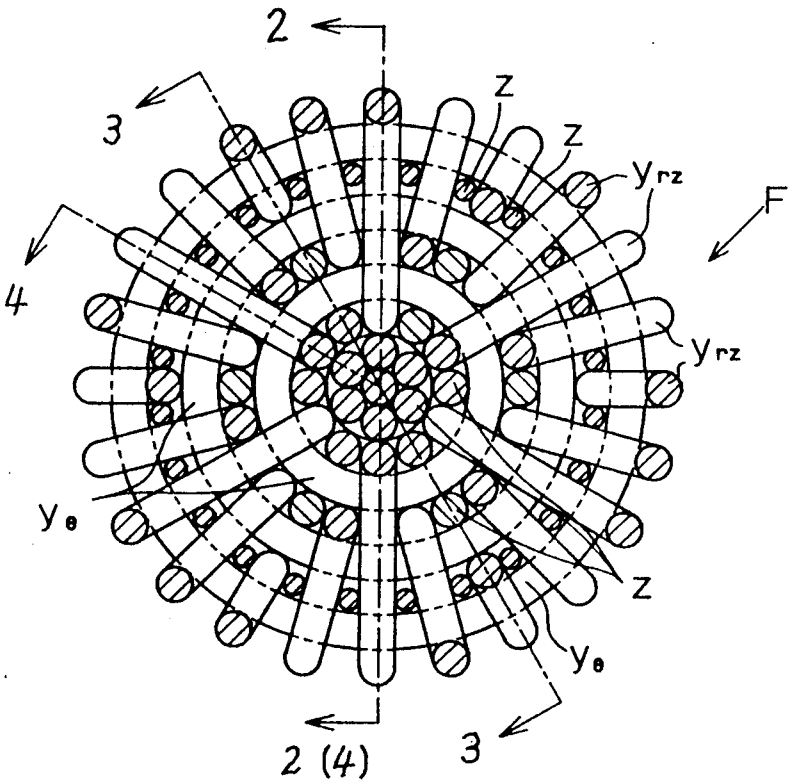
FIG. 1 is a sectional view of a first embodiment of a three dimensional fabric of the present invention.
Figure 4:
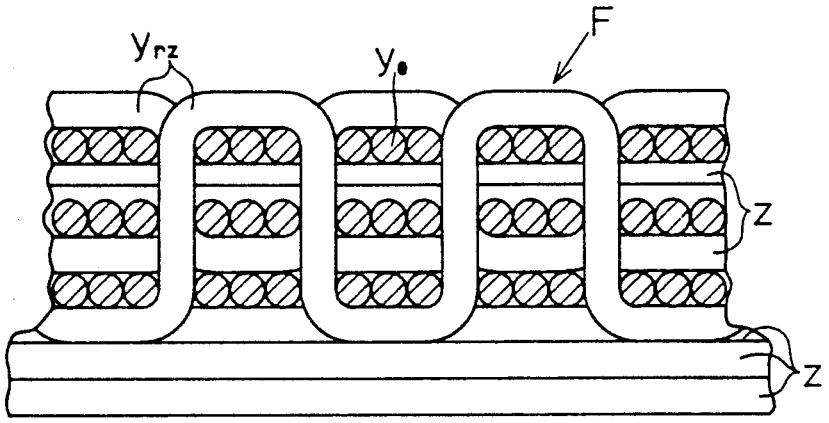
FIG. 4 is a sectional view taken along the line 4—4 of FIG. 1.
Figure 7:
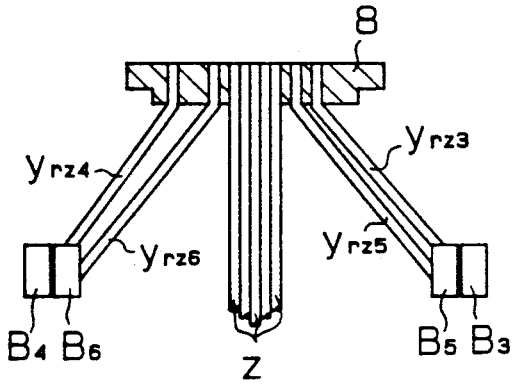
FIGS. 7(*a*1) to (*s*1) are sequential schematic cross sectional views showing the progression of the weaving operation as seen along the line 2—2 of FIG. 1.
Figure 7:
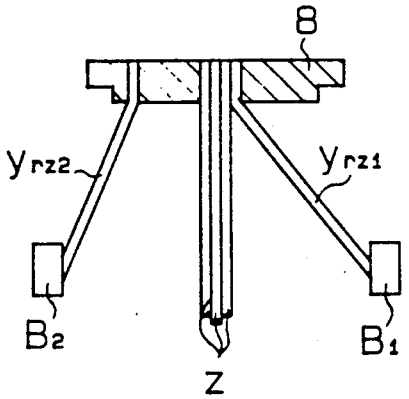
Figure 7:
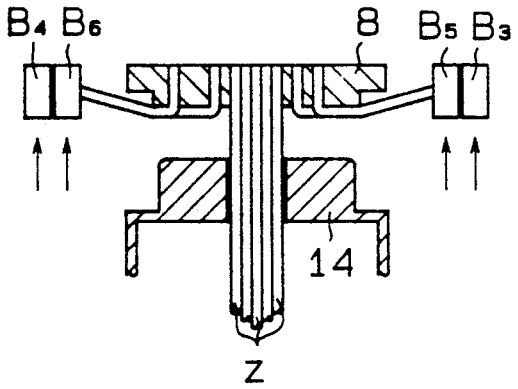
Figure 7:
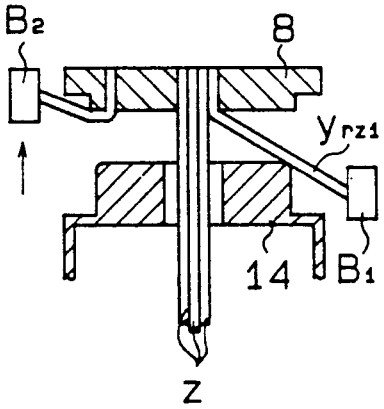
Figure 7:
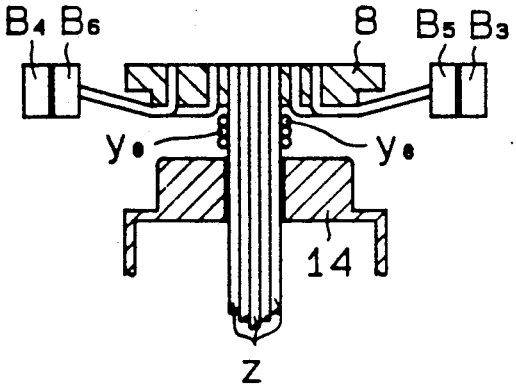
Figure 7:
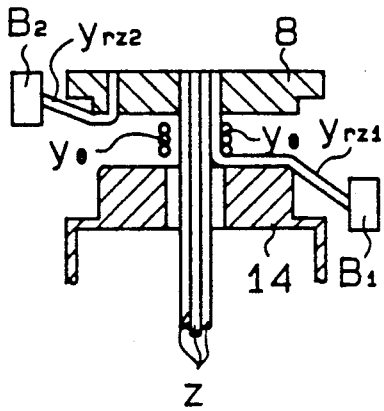
Figure 7:
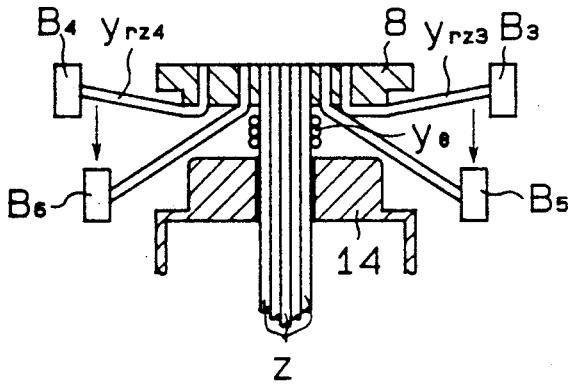
Figure 7:
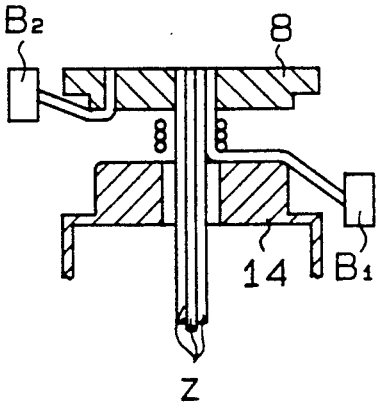
Figure 7:
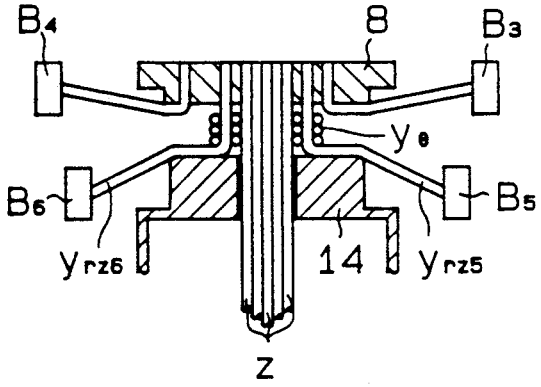
Figure 7:
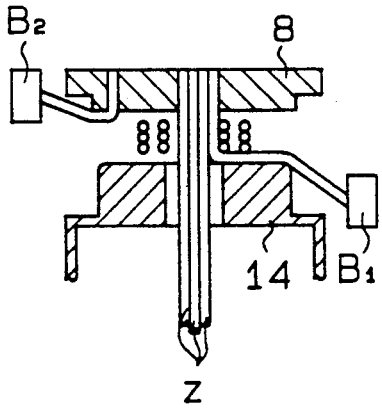
Figure 7:
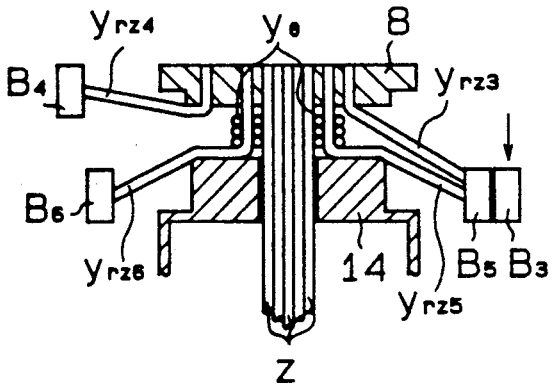
Figure 7:
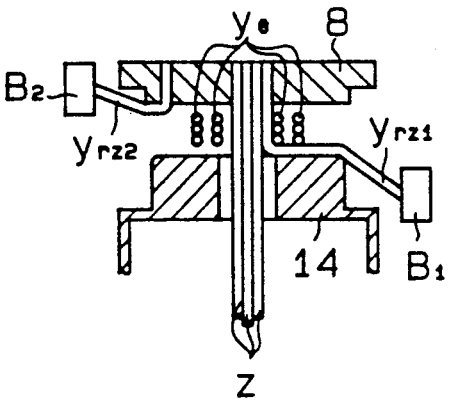
Figure 7:
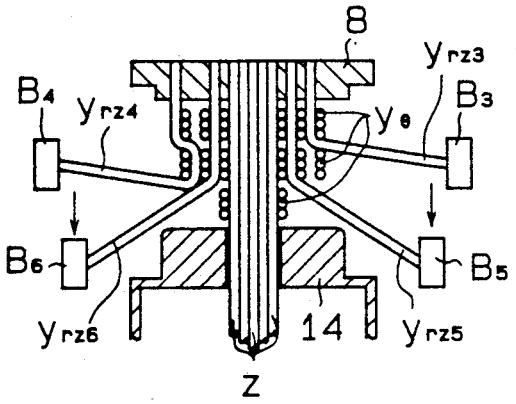
Figure 7:
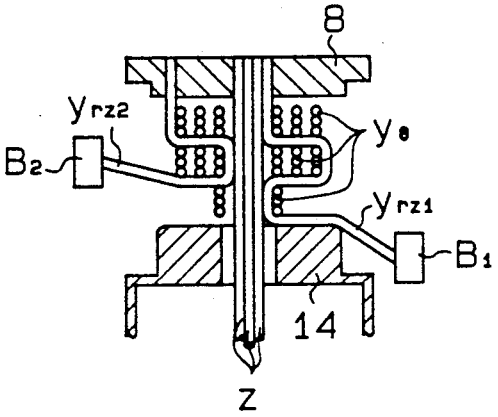
Figure 7:
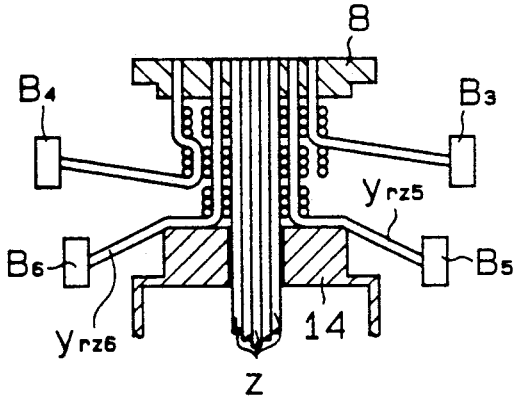
Figure 7:
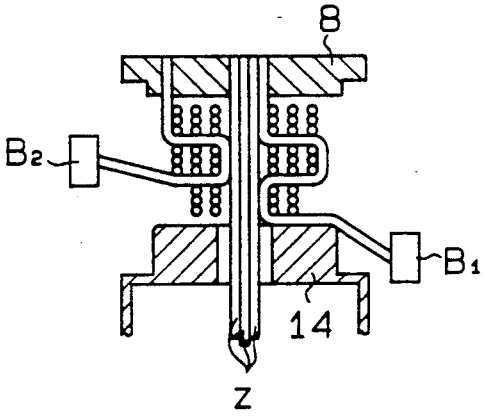
Figure 7:
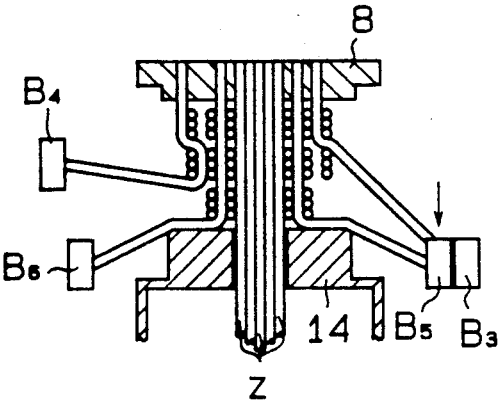
Figure 7:
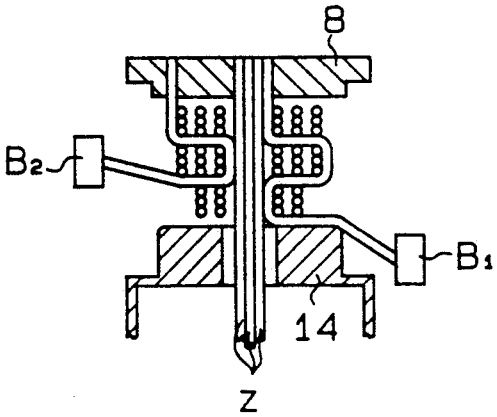

FIGS. 7 (*a*1) and (*a*2) illustrate the state, as viewed in the sections taken along the lines 2—2 and 3—3 of FIG. 1, from which weaving the three dimensional fabric shown in FIGS. 1 to 4 begins. From this state, as shown in FIGS. 7 (*b*1) and (*b*2), the radial yarn yrz1 from the bobbin B1 is extended to approach the upper end surface of the guide frame 14 by means of being maintained by the holder support 7 a the lower position. Five radial yarns yrz2, yrz3, yrz4, yrz5 and yrz6 from the other bobbins B2, B3, B4, B5 and B6 are shifted to the upper position where they are held by the holder supports 13, respectively, thereby to become near the yarn fixing table 8. Thereafter, the splined shafts 2 and 9 are rotated three revolutions, so that the circumferential yarn y$\theta$ is wound to define a first layer around the axial yarns z which are stretched between the centers of both the yarn fixing tables 1 and 8. In this manner, the radial yarn yrz1 from the bobbin holder B1 (at the lower position) is woven inside the circumferential yarn y$\theta$. This creates the state shown in FIGS. 7 (*c*1) and (*c*2) wherein the circumferential yarn y$\theta$ has been wound three turns around the axial yarns z. Thus, the radial yarn yrz1 is urged toward the axis inside the first layer of circumferential yarns y$\theta$ while the other five radial yarns which are bent outwardly remain unrestricted.

Next, as shown in FIGS. 7 (*d*1) and (*d*2), the bobbins B5 and B6 are transfered from the holder support 13 at the upper position to the holder support 7 at the lower position, so that the radial yarns yrz5 and yrz6 approach the upper end surface of the guide frame 14. In this state, the splined shafts 2 and 9 are again rotated three revolutions to deposit a second layer of circumferential yarns y$\theta$. The radial yarns yrz5 and yrz6 are pressed toward the axis. On the other hand, the radial yarns yrz2, yrz3 and yrz4 remain unrestricted. Thus, the state shown in FIGS. 7 (*e*1) and (*e*2) is obtained. Then, as shown in FIGS. 7 (*f*1) and (*f*2), the bobbin B3 is delivered from the upper position to the lower position in the same manner as described before. Thereafter, the winding of the circumferential yarn y$\theta$ is performed by the rotation of the splined shafts 2 and 9. This results in the state shown in FIGS. 7 (*g*1) and (*g*2), thereby completing the first stage of weaving.

Next, the splined shafts 2 and 9 move upward so as to draw up the three dimensional fabric by a specified amount. The bobbins B1, B3, B5 and B6 at the lower position are transfered to the upper position, while the bobbin B2 is moved to the lower position so that the radial yarns take the positions shown in FIGS. 7 (*h*1) and (*h*2). Then, the winding of the circumferential yarn y$\theta$ is carried out by rotating the splined shafts 2 and 9. Thereby, the radial yarn yrz2 from the bobbin B2 extends, as shown in FIG. 7 (*i*1), from the outermost layer of the fabric at this point to the inside of the first layer of circumferential yarns y$\theta$. Sequentially, as shown in FIG. 7 (*j*2), the bobbins B5 and B6 are carried from the upper position to the lower position, thereby placing the radial yarns yrz5 and yrz6 adjacent to the guide frame 14. The splined shafts 2 and 9 are again rotated thereby causing the circumferential yarn y$\theta$ to press the radial yarns yrz5 and yrz6 inward to obtain the state shown in FIGS. 7 (*k*1) and (*k*2). Thus, the radial yarns yrz5 and yrz6, which both extended axially between the first and second layers of the circumferential yarns y$\theta$ in the first stage of weaving, are both extended axially as before. Thereafter, as shown in FIG. 7 (*l*2), the bobbin B4 is conveyed from the upper position to the lower position, and successively the winding of the circumferential yarn y$\theta$ is conducted via the rotation of the splined shafts 2 and 9. Accordingly, as shown in FIGS. 7 (*m*1) and (*m*2), the radial yarn yrz4 from the bobbin B4 is transposed from the outermost position to a sandwitched position between the second and third layers of the circumferential yarns y$\theta$. Thus it defines radial elements as well as axial elements of short size, thereby completing the second stage of weaving.

Next, as shown in FIGS. 7 (*n*1) and (*n*2), the splines shafts 2 and 9 are moved upward to lift the three dimensional fabric F a predetermined amount. The bobbin B1 is transfered to the lower position and the bobbins B2, B4, B5 and B6 to the upper position. Then, the splined shafts 2 and 9 rotate so as to perform the winding of the circumferential yarn y$\theta$. In accordance therewith, the radial yarn yrz1 from the bobbin B1 is transposed from the outermost position to the inner layer of the fabric F in the radial direction. The radial yarn yrz1 is then laid axially adjacent the central axial yarns z thereby producing the yarn arrangement shown in FIGS. 7 (*o*1) and (*2*2). Thereafter, as shown in FIG. 7 (*p*2), the bobbins B5 and B6 are transfered to the lower position. Then, the splined shafts 2 and 9 are rotated so as to perform the winding of the circumferential yarn y$\theta$. In the resulting yarn arrangement, the radial yarns yrz5 and yrz6 from the bobbins B5 and B6 extend axially through the woven fabric as shown in FIGS. 7 (*q*1) and (*q*2). Next, as shown in FIG. 7 (*r*2), the bobbin B3 is carried to the lower position, and the winding of the circumferential yarn y$\theta$ is performed through the rotation of the splined shafts 2 and 9. Accordingly, as shown in FIGS. 7 (*m*1) and (*m*2), the radial yarn yrz3 from the bobbin B3 is pressed between the second and third layers of the circumferential yarns y$\theta$. Thereby, the radial yarn yrz3 defines radial elements as well as axial elements of short size. This results in the arrangement of the yarns shown in FIGS. 7 (*s*1) and (*s*2), and is the completion of the third stage of weaving. Hereafter the weaving is repeated step by step as described above, thereby forming a columnar three dimensional fabric F with the axial yarns z at the center.

FIGS. 1 to 4 show the sections of the three dimensional fabric obtained by this weaving method. In this weaving method, at least one of the bobbin holders 6 is always disposed at the lower position for each revolution of the supports 4 and 11. The radial yarns yrz5 and yrz6 are woven to unchangedly extend longitudinally the axis. Thus they form the axial yarns z of the three dimensional fabric F after the weaving. The other radial yarns yrz follow three distinct patterns that are repeatedly woven into the fabric. A first radial yarn pattern is alternately turned between the inside of the first layer and the outside of the third layer of the circumferential yarn y$\theta$, a second yarn pattern is alternately turned between the inside of the second layer and the outside of the third layer, and the third pattern is alternately turned between the inside and the outside of the third layer.

Second Embodiment

Figure 9:
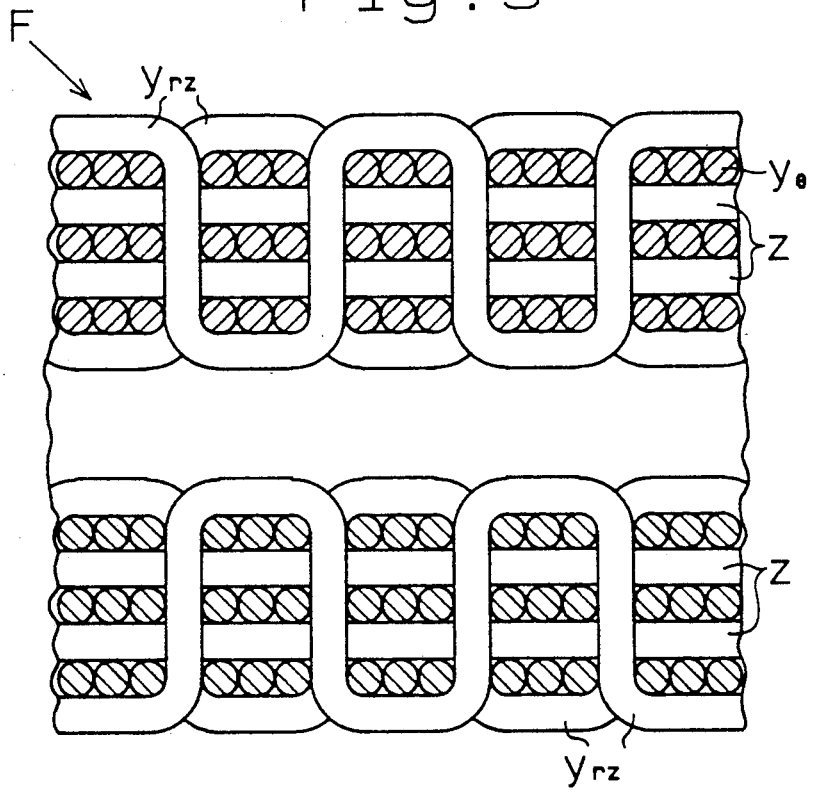
FIG. 9 is a sectional view taken along the line 9—9 of FIG. 8.
Figure 10:
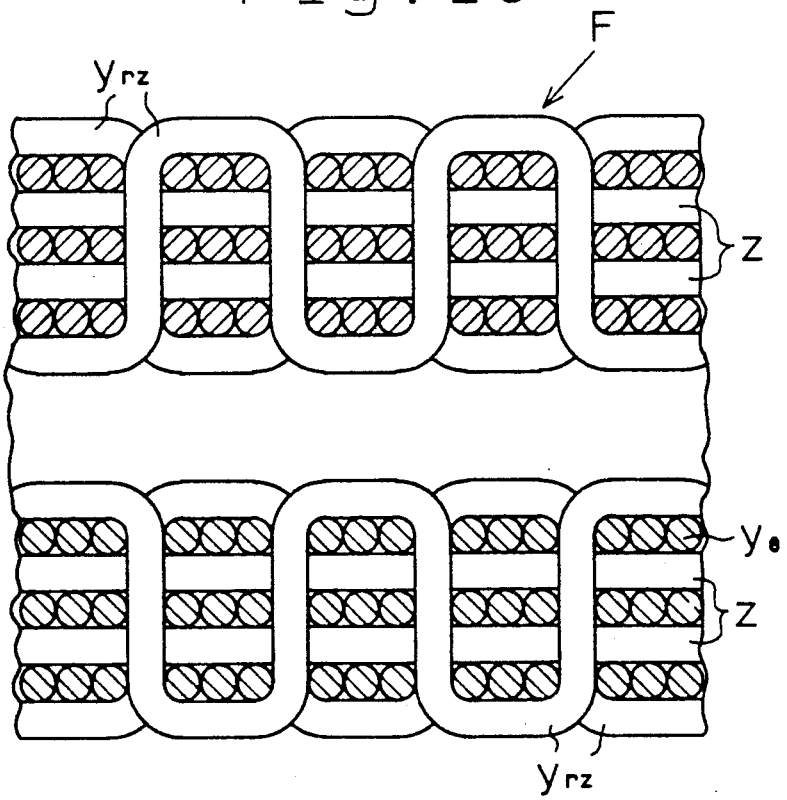
FIG. 10 is a sectional view taken along the line 10—10 of FIG. 8.

Next, a second embodiment will be described referring to FIGS. 8 to 10. A three dimensional fabric F of this embodiment is different from that of the above embodiment in that it does not have any axial yarns z at its center and that all of the radial yarns yrz are alternately turned between the inside of the innermost layer and the outside of the outermost layer of the circumferential yarn y$\theta$. In this structure, since the space between adjacent radial yarns yrz gets larger towards the outer perimeter of the fabric, the number of the axial yarns z woven between the radial yarns yrz is larger in the outer axial yarn layers.

To facilitate weaving this three dimensional fabric F, the radial yarns yrz are prepared as described in the above embodiment. And a columnar or cylindrical core metal is mounted between the centers of the yarn fixing tables 1 and 8 instead of the axial yarns Z. After that, a weaving as described below is carried out. The vertical position of the radial yarns yrz in relation to the guide frame 14 is changed regularly between the upper and lower positions, while the circumferential yarn y$\theta$ is wound as previously described. Accordingly, some of the radial yarns yrz are woven longitudinally in between the first and second layers of the circumferential yarn y$\theta$ to define the inner layer of axial yarns z. These axial yarns z of the inner layer are alternated one by one with the actual radial yarn yrz. All of the actual radial yarns yrz are turned interchangeably between the inside of the innermost layer and the outside of the outermost layer of the circumferential yarn y$\theta$. In addition, some other radial yarns yrz are woven longitudinally in between the second and third layers of the circumferential yarn y$\theta$ to define the outer layer of axial yarns z. Within the outer axial yarn layer, two axial yarns z are disposed between adjacent actual radial yarns yrz which are woven and looped interchangeably between the inside of the innermost layer and the outside of the outermost layer of the circumferential yarn y$\theta$.

The aforementioned embodiments may be modified as follows.

For example, each radial yarn yrz may be arranged to be bent step by step as it travels inwardly or outwardly between the various yarn layers and turns.

Figure 11:
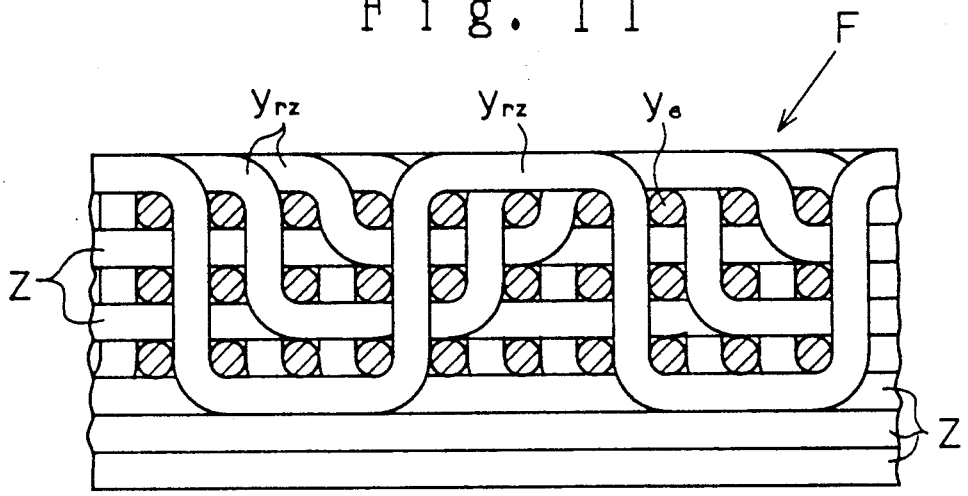
FIGS. 11 and 12 respectively show sectional views of modified three dimensional fabrics.

In an alternative embodiment of the three dimensional fabric shown in FIG. 11, the radial yarns yrz are woven to follow three separate repeating paths in the manner described in the first embodiment. They include: 1) yarns yrz10 alternately turned between the inside of the first layer and the outside of the third layer of the circumferential yarn y$\theta$; 2) yarns yrz11 alternately turned between the inside of the second layer and the outside of the third layer; and yarns yrz12 alternately turned between the inside and the outside of the third layer. In this modification, each radial yarn yrz has its turning position shifted by one circumferential yarn turn so that the circumferential yarn y$\theta$ and radical yarn yrz are alternated one by one in the axial direction.

Figure 12:
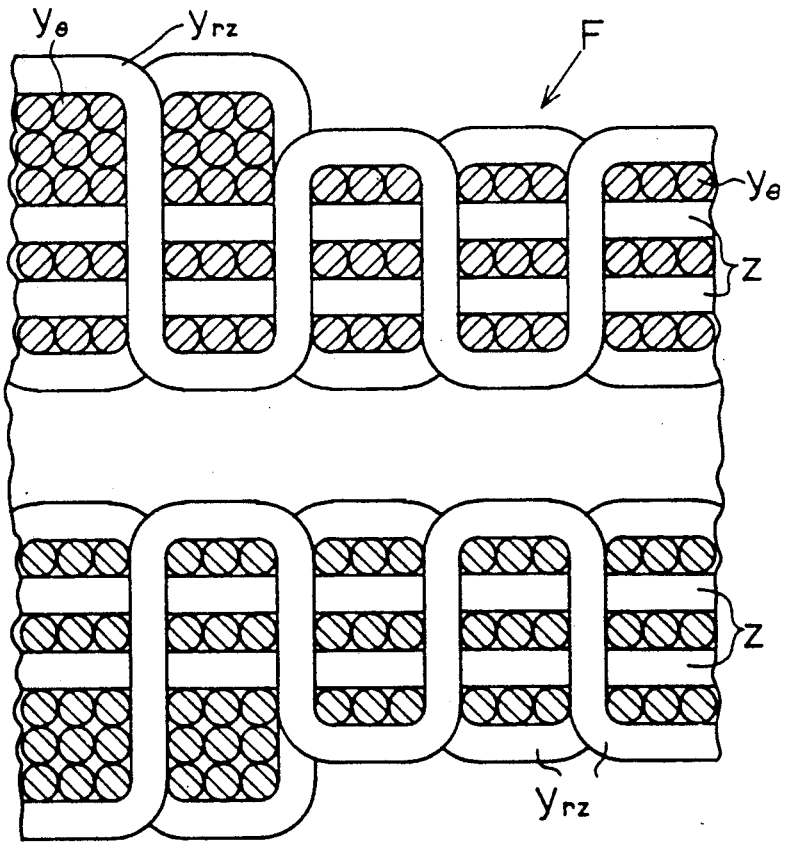

As shown in FIG. 12, it is possible to manufacture a three dimensional fabric with the thickness thereof changed along the axis. This structure can be readily attained by changing the number of the layers of circumferential yarns y$\theta$ which are wound between the axial yarns z and radial yarns yrz.

A three dimensional fabric having an elliptical shape may be produced by weaving the fabric about an elliptical core. The core may be formed by tightly arranging axial yarns in an elliptical way between the centers of the yarn fixing tables 1 and 8. Alternatively, an elliptic core metal may be used during fabrication instead of the axial yarns z. After the weaving is completed, the core metal is removed. The weaving machine may also be widely varied in accordance with the present invention. For example, it is possible to utilize a structure in which only one of the holder supports 7 and 13 is vertically movable, as opposed to the previously described machine wherein both the holder supports 7 and 13 were vertically movable. Moreover, the circumferential yarn supplier 15 may be revolved about the axial yarns instead of rotating the supports 4 and 11, in order to wind the circumferential yarn y$\theta$. Furthermore, a plurality of circumferential yarn suppliers 15 may be provided. The free end of the circumferential yarn y$\theta$ may also be fixed by another device, e.g. by grasping it between the axial yarns z.

Each of the cylindrical three dimensional fabrics described above comprises three kinds of yarn groups. Among them, a multiplicity of radial yarns yrz are woven between specified layers of the circumferential yarns y$\theta$ which are wound into a multiplicity of circumferential layers. Thus, the radial yarns are inserted to extend zigzag successively in the longitudinal and radial directions while being perpendicular to the circumferential yarns y$\theta$. Therefor, it is possible to make the yarn density at the outer peripheral portion of the fabric the same as the yarn density at the inner peripheral portion. This is accomplished by changing the inserting position as well as the turning position of the various radial yarns yrz relative to the circumferential yarns y$\theta$. As a result, the materials used to form the three kinds of yarns, as well as the shape of the fabric may be widely varied.

In accordance with the above manufacturing method, the three kinds of yarns, that is, the axial yarns z, the radial yarns yrz and the circumferential yarns y$\theta$ are inserted successively in the axial, radial and circumferential directions. This improves the productivity of and facilitates automatization of the weaving process. Further, the turning position in the radial direction of the radial yarns yrz may be shifted to any desired position. So it is possible to easily change the meandering state of the radial yarns yrz and the number of turns of the circumferential yarns y$\theta$ arranged between the radial elements of the radial yarns. Thus realized is a weaving procedure for three dimensional fabrics which allows a variety of weaving structures, and the selection of diverse materials as the yarns. Moreover, it is possible to produce a three dimensional fabric having its radius changed along the fabric's axial direction. Such design flexibility allows the fabrication of three dimensional fabrics for an increased number of applications. These fabrics are capable of being used as a component of a composite material together with resin or inorganic substance. In addition, the three dimensional fabric may be used standing alone in a wide variety of applications. For example, a filter can be constructed wherein a fluid is passed through the fiber structure constructed in multi-layers.

Third Embodiment

Figure 13:
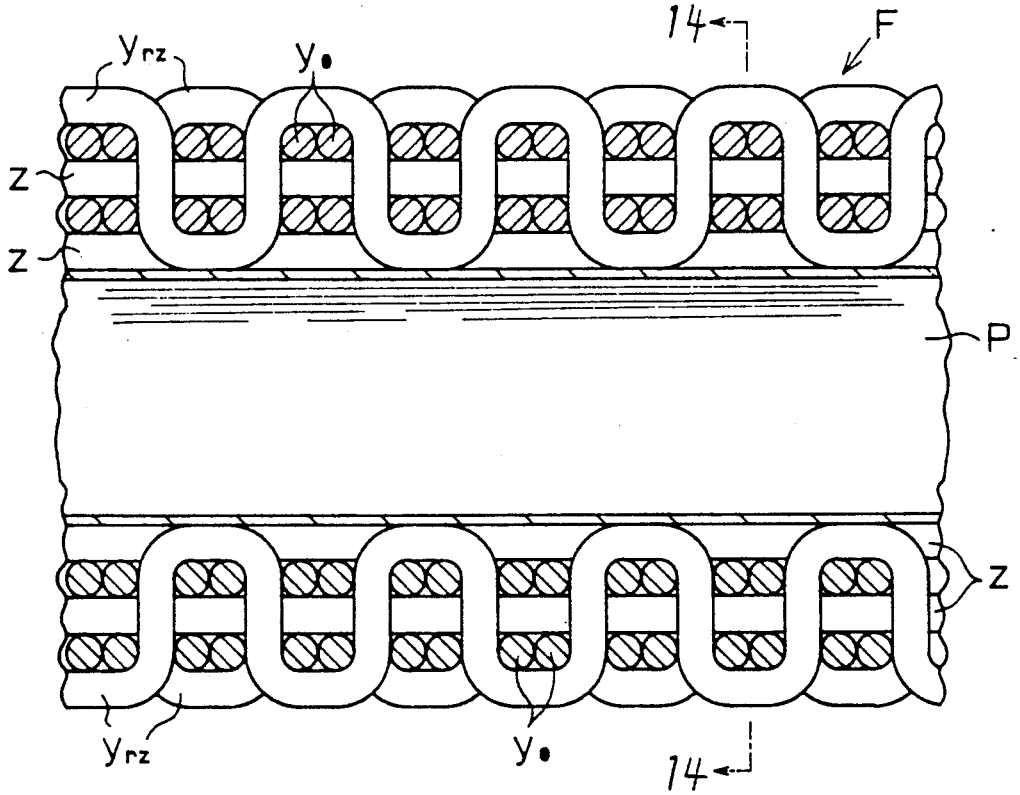
FIG. 13 is a sectional view of a three dimensional fabric of a third embodiment.
Figure 14:
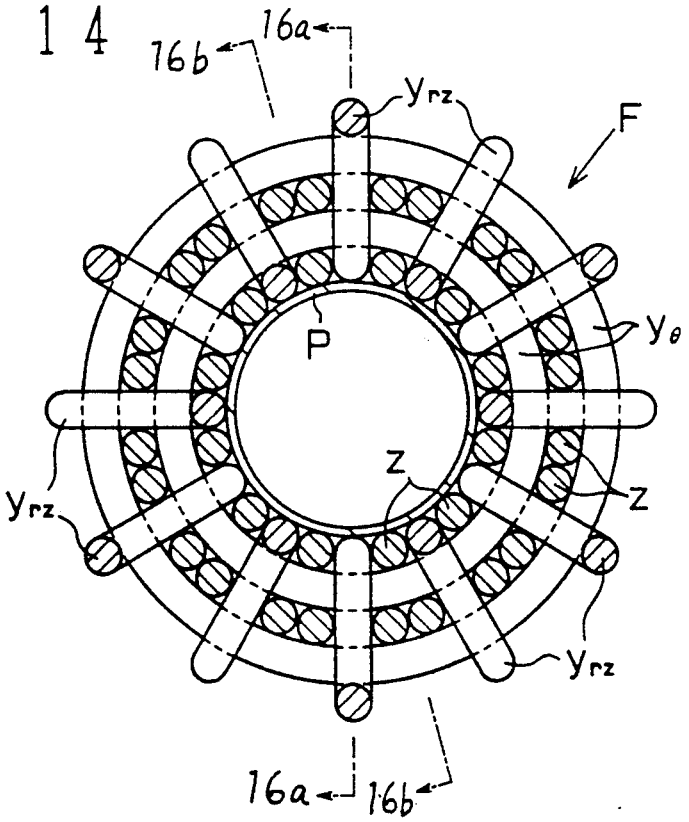
FIG. 14 is a sectional view taken along the line 14—14 of FIG. 13.

Next, a third embodiment of this invention will be described referring to FIGS. 13 to 16. As shown in FIGS. 13 and 14, a three dimensional fabric F has a pipe P formed from a solid member such as metal or ceramic as a cylindrical core. The pipe P is disposed at the center, and the various yarns (that is, axial yarns z, radial yarns yrz and circumferential yarns y$\theta$) are woven therearound to form the cylindrical fabric. Two layers of longitudinally extending axial yarns z are laid to form concentrical cylinders about the pipe P as can best be seen in FIG. 14. Two layers of circumferential yarns y$\theta$ are also inserted such that they lay perpendicular to the axial yarns z and extend annularly about the circumference of pipe P. A first layer lies between the two axial yarn layers and the second circumferential yarn layer lies to the outside of the layers of axial yarns z. As can be readily seen in the drawings, each layer is formed from a multiplicity of individual yarn strands. A multiplicity of radial yarns yrz are inserted meandering successively in the axial and radial directions, while being perpendicular to the circumferential yarns y$\theta$. The meandering turns of the radial yarns are arranged such that each strand extends in a particular plane which includes the axis of the pipe P. The radial yarns yrz are inserted to alternately turn between the inside of the innermost circumferential yarn y$\theta$ and outside of the outermost one. The phases of the radial yarns are shifted such that the turns of adjacent radial yarns oppose each other. Since the space between the adjoining radial yarns yrz becomes larger towards the outside of the three dimensional fabric F, the number of the axial yarns z woven between the radial yarns yrz is made larger towards the outside surface. This three dimensional fabric F is impregnated with resin to make a pipe-shaped composite material.

The composite material with a framework of this three dimensional fabric F may be used as piping for oil or gas, or as a transport pipe for chemicals. Most of the fluid pressure inside the pipe P is supported by the three dimensional fabric F, so that there is little need for the pipe P to bear the fluid pressure. As a result, the pipe P needs only to possess the required accuracy in size and/or smoothness along its inner surface. The pipe material may be selected to provide the required properties of oil or chemical resistance, or the like. The described structure enables the pipe P to have lighter weight since its walls may be very thin.

Figure 15:
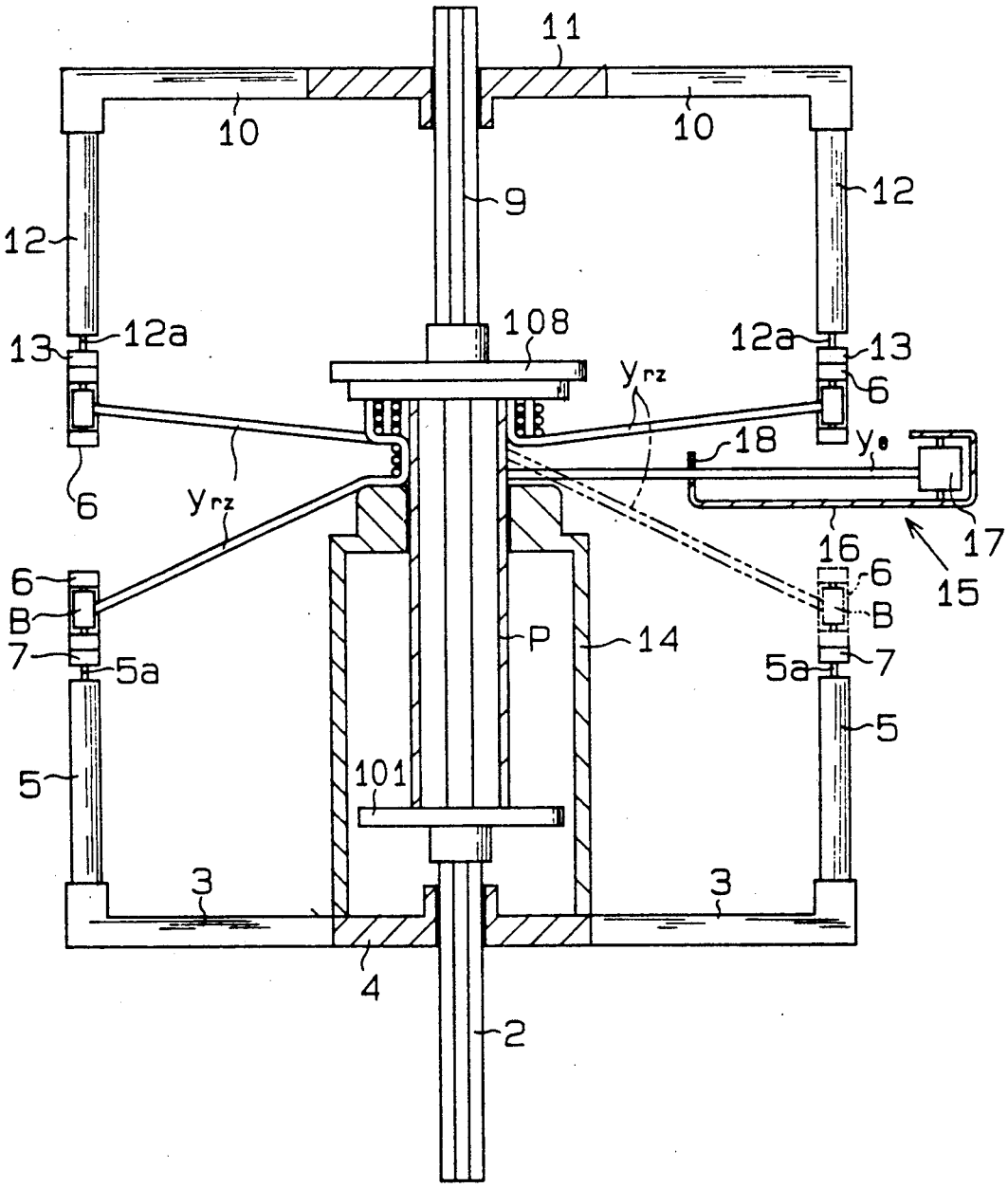
FIG. 15 is a partially broken schematic front view of a three dimensionally weaving machine.

Next, a method for making the three dimensional fabric F with the pipe P inside will be explained. A device for weaving this three dimensional fabric is somewhat different than that of the first embodiment in that the pipe P is able to be fixed between a yarn support table 101 and yarn fixing table 108, as shown in FIG. 15.

Prior to the weaving the three dimensional fabric, the pipe P is secured between the centers of both the tables 101 and 108 with the axis thereof in line with the axis of the splined shafts 2 and 9. One end of each of the radial yarns yrz and axial yarns z is drawn from the the bobbins B fitted respectively to the bobbin holders 6. These ends are fixed to the upper yarn fixing table 108 so as to define a muliplicity of layers (three layer in this embodiment) about the pipe P. Thereby, the axial yarns z and radial yarns yrz are extended radially about the pipe P with the splined shafts 2 and 9 as their center. One end of a circumferential yarn y0, drawn from the circumferential yarn bobbin 17, is attached to the upper yarn fixing table 108. Then, a weaving starts from the state in which the bobbin holders 6 are held respectively by the specified upper and lower holder supports 7 and 13 in accordance with the desired weaving pattern.

As in the first embodiment, the axial yarns z and radial yarns yrz from the bobbin holders 6 are disposed selectively at the upper and lower position as required to accomplish the desired weaving pattern. In the upper position, the yarn extending from a particular bobbin lies above the circumferential yarn y0, while in the lower position, the yarn crosses the circumferential yarn y$\theta$. As before, when a bobbin holder 6 is located at the lower position, in the revolution of the holder supports 7 and 13, cause the circumferential yarn y$\theta$ to secure the end portions of the particular yarn carried by that bobbin to extend longitudinally along the axis on the peripheral surface of the three dimensional fabric being woven.

FIGS. 16 (*a*1) and (*a*2) illustrate the state, as viewed in the sections taken along the lines Y—Y and Z—Z of FIG. 14, from which the weaving starts for the three dimensional fabric shown in FIGS. 13 and 14. From this state, as shown in FIG. 16 (*b*1) and (*b*2), the radial yarns yrz5 and yrz6 from the bobbins B5 and B6 are extended to approach the upper end surface of the guide frame 14 by means of the corresponding bobbins B5 and B6 being held by the holder support 7 at the lower position. Four radial yarns yrz1, yrz2, yrz3 and yrz4 from the other bobbins B1, B2, B3 and B4 are transposed to the upper position where they are retained by the holder supports 13. In this position they are bent upward such that they are near the yarn fixing table 108. The splined shafts 2 and 9 are then rotated twice to wind a first layer of circumferential yarns y$\theta$ around the pipe P between the yarn fixing tables 101 and 108. With these rotations, the radial yarns yrz5 and yrz6 from the bobbin holders B at the lower position are woven inside the circumferential yarn y0, thereby making the state as shown in FIGS. 16 (*c*1) and (*c*2). Accordingly, the circumferential yarn y$\theta$ is wound twice around the pipe P, hereby pushing the radial yarns yrz5 and yrz6 against the pipe. The other four radial yarns, yrz5 and yrz6 against the pipe. The other four radial yarns, which were bent outwardly remain unrestricted as described above. Next, as shown in FIG. 16 (*d*2), the bobbins B3 and B4 are transferred from the holder support 13 at the upper position to the holder support 7 at the lower position, so that the radial yarns yrz3 and yrz4 approach the upper end surface of the guide frame 14. In this state, the splined shafts 2 and 9 are rotated two turns to wind a second layer of circumferential yarns y$\theta$ about the first. The radial yarns yrz3 and yrz4 are thus pressed toward the axis, whereby the state shown in FIGS. 16 (*e*1) and (*e*2) is obtained to terminate the first stage of weaving.

Next, as shown in FIGS. 16 (*f*1) and (*f*2), the splined shafts 2 and 9 move upward so as to draw up the three dimensional fabric by a specified amount. The bobbins B3 and B4 at the lower position are transferred to the upper position. This causes a resultant state shown in FIGS. 16 (*f*1) and (*f*2). Thereafter, the winding of the circumferential yarn y0 is carried out by the rotation of the splined shafts 2 and 9. As a result, the radial yarns yrz5 and yrz6, that are drawn from the bobbins B5 and B6 and have been run longitudinally inside the first layer of the circumferential yarns y$\theta$, are arranged to further extend longitudinally as before. The radial yarns yrz1 and yrz2 are routed from the outermost layer of the fabric to the inside of the first layer of circumferential yarns y$\theta$, as shown in FIG. 16 (*g*1).

Then, the bobbins B3 and B4 are conveyed from the upper position to the lower position, and the radial yarns yrz 3 and yrz 4 drawn respectively from those bobbins are positioned near the guide frame 14. Thus, the state of arrangement of the radial yarns shown in FIGS. 16 (*h*1) and (*h*2) is obtained. After that, the winding of the circumferential yarn y$\theta$ is conducted via the rotation of the splined shafts 2 and 9. Accordingly, as shown in FIGS. 16 (*i*1) and (*i*2), the radial yarns yrz3 and yrz4, which were extended longitudinally between the first and second layers of the circumferential yarns y$\theta$ in the first stage of weaving, are both further extended in the axial direction. And the state shown in FIGS. 16 (*i*1) and (*i*2) is obtained, thereby completing the second stage of weaving.

Next, the splined shafts 2 and 9 are moved upward to draw up the three dimensional fabric F. The bobbins B1 to B4 are also all transfered to the upper position, thus resulting in the state of arrangement of the radial yarns shown in FIGS. 16 (*j*1) and (*j*2). Then, the splined shafts 2 and 9 rotate so as to perform the winding of the circumferential yarn y$\theta$. In accordance therewith, the radial yarns yrz5 and yrz6 from the bobbins B5 and B6 are further extended longitudinally inside the first layer of the circumferential yarns y$\theta$, as shown in FIG. 16 (*k*2). Sequentially, as shown in FIGS. 16 (12), the bobbins B3 and B4 are delivered from the upper position to the lower position, whereby the radial yarns yrz3 and yrz4, drawn from the bobbins B3 and B4 respectively, are placed adjacent to the guide frame 14. The splined shafts 2 and 9 are again rotated to wind two more turns of circumferential yarn. Thus, the radial yarns yrz3 and yrz4 are pressed inward by the circumferential yarn y$\theta$. As a result, the radial yarns yrz3 and yrz4, which have been longitudinally extended between the first and second circumferential yarn layers, are both further axially extended as before. This results in the state of arrangement of the yarns, as shown in FIGS. 16 (*m*1) and (*m*2), and thereby completes the third stage of weaving. The weaving continues successively as described above to weave the cylindrical three dimensional fabric F with the pipe P at the center.

In this weaving method, the radial yarns yrz3, yrz4, yrz5 and yrz6 are woven such that they extend longitudinally parallel to the axis, thereby forming the axial yarns z of the three dimensional fabric F. The other radial yarns yrz1 and yrz2 are repeatedly woven into the fabric by alternately being turned between the inside of the first layer and the outside of the second layer of the circumferential yarn y$\theta$.

Fourth Embodiment

Next, a fourth embodiment will be described referring to FIG. 17. This embodiment differs from the three dimensional fabric F of the third embodiment in that a pipe P with flanges Pa at both ends is woven into the three dimensional fabric F, and that a thick pipe is used as the pipe P. In such a structure, the end of each yarn is prevented from slippage in the axial direction of the pipe P by the action of the flanges Pa. Therefore, each yarn is held in place until impregnation of the resin. This improves the connection between each yarn and the pipe P. Moreover, the pipe P is thick walled, so that, after being made into a composite material through the impregnation of resin, the material is able to be finished by machine work. This construction is particularly useful for parts which will need a fitting of high accuracy.

This three dimensional fabric F may be obtained via the same weaving pattern as the above embodiment, while fixing the pipe P with the flanges Pa between both tables 101 and 108 of the device of the third embodiment.

Fifth Embodiment

Figure 18:
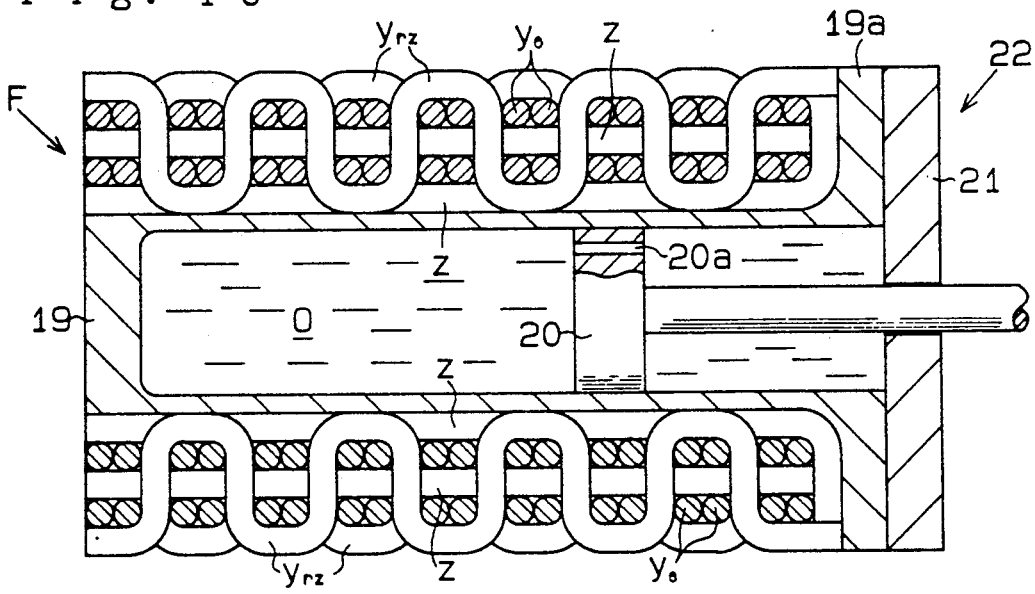
FIG. 18 is a sectional view of a three dimensional fabric of a fifth embodiment.

Next, a fifth embodiment will be described referring to FIG. 18. A three dimensional fabric of this embodiment is applied for cylinders of oil dampers. The three dimensional fabric F has woven at its center a bottomed cylindrical member 19 with a flange 19*a* at the opened end. After the three dimensional fabric F is made into a composite material by impregnating resin thereto, a piston 20 with a hole 20*a* and oil O are fitted into the cylindrical member 19. And a cap 21 is fitted to the flange 19*a*, thereby to assemble an oil damper 22. This three dimensional fabric F may be obtained via the same weaving pattern as the above embodiment, while fixing the cylindrical member 19 between both tables 101 and 108 of the device of the third embodiment.

Sixth Embodiment

Figure 19:
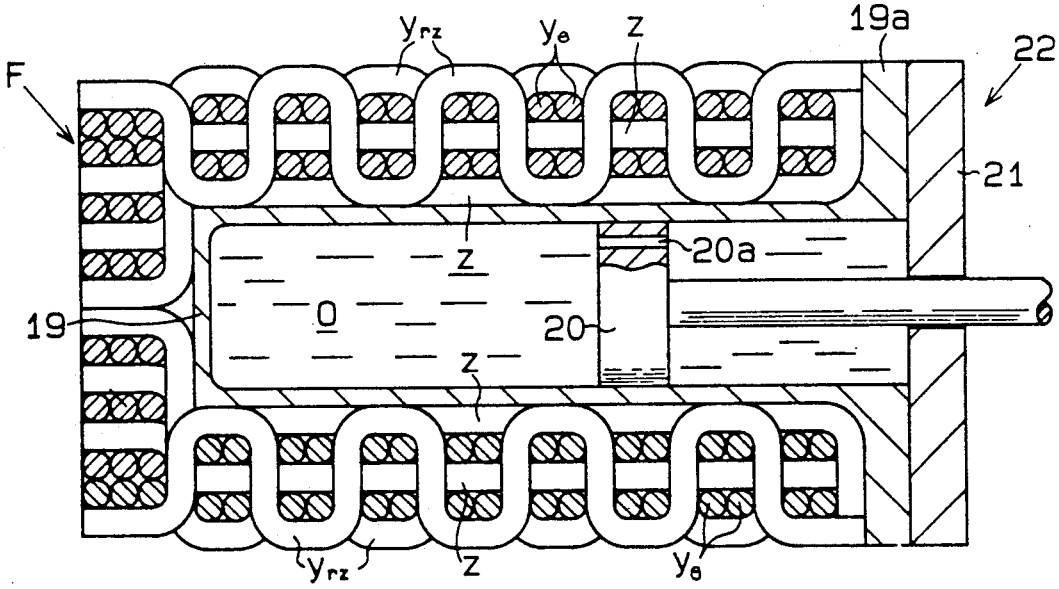
FIG. 19 is a sectional view of a three dimensional fabric of a sixth embodiment.

Next, a sixth embodiment will be described referring to FIGS. 19 and 20. A three dimensional fabric F of this embodiment is also used for cylinders of oil dampers, but differs from the fifth embodiment in that the cylindrical member 19 has its bottom covered by the fabric in addition to the outer peripheral portion. In the case of this embodiment, the bottom wall of the cylindrical member 19 can be thinner than the previously described embodiment so as to enable the products to be far lighter.

This three dimensional fabric F may be made by use of the device of the third embodiment. However, the cylindrical member 19 has its flanged side 19*a* fixed to the support table 101 while the bottom side is spaced a predetermined distance from the yarn fixing table 108. One ends of each of the radial yarns yrz and axial yarns z is drawn out of their associated bobbins B respectively mounted on the bobbin holders, the free ends are attached to the yarn fixing table 108 such that they form four concentrical circles or layers. Then, a weaving is performed in the order shown in FIG. 20.

Figure 20:
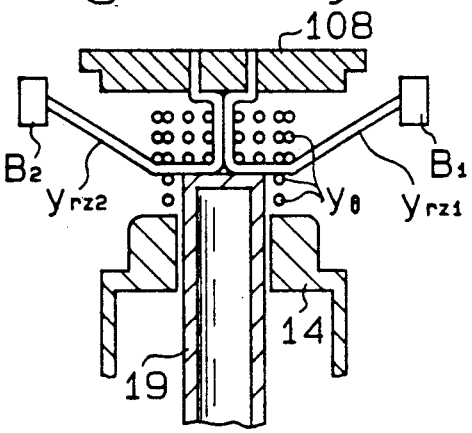
FIGS. 20 (*a*1) to (*o*1), (*a*2) to (*o*2) and (*a*3) to (*o*3) are sequential schematic cross sectional views showing the progression of the weaving operation of the sixth embodiment.
Figure 20:
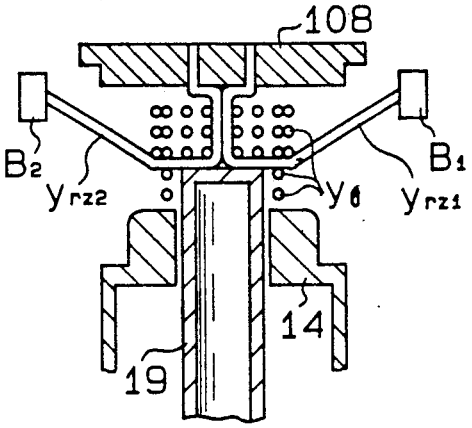
Figure 20:
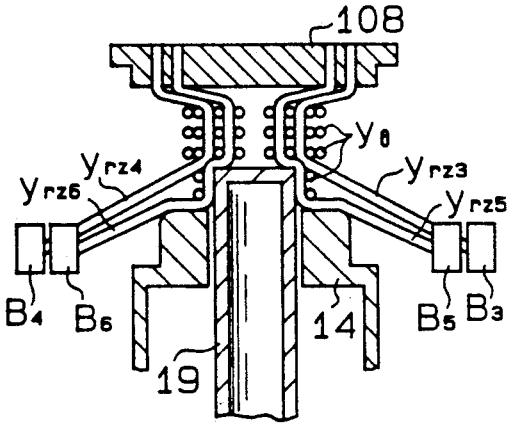
Figure 20:
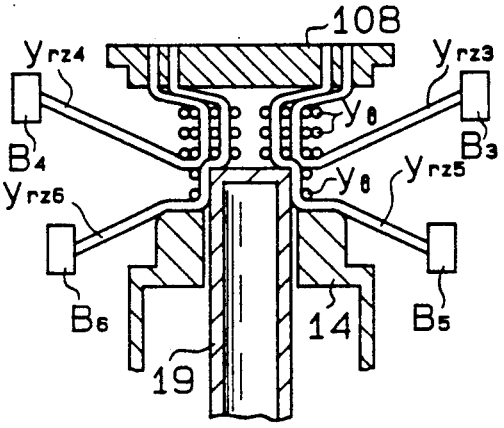
Figure 20:
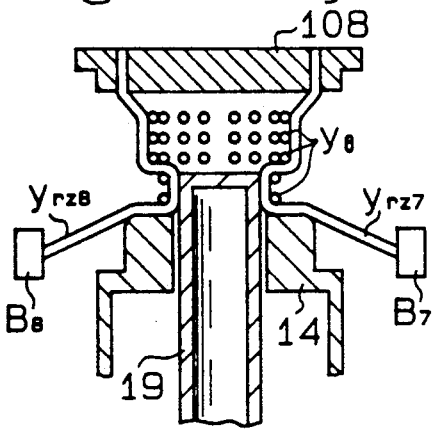
Figure 20:
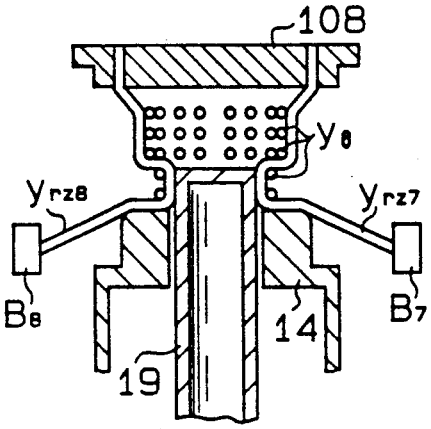

FIGS. 20 (*a*1) to (*o*1), (*a*2) to (*o*2) and (*a*3) to (*o*3) are sectional views respectively showing the sequential progression of the woven state of the radial yarns yrz, which are turned alternately between the inside of the innermost circumferential yarn y$\theta$ and the outside of the outermost one, and the axial yarns z. FIGS. 20 (*a*1), (*a*2) and (*a*3) illustrate the state to start weaving the three dimensional fabric. From this state, as shown in FIGS. 20 (*b*1), (*b*2) and (*b*3), the radial yarns yrz1 and yrz2 from the bobbins B1 and B2 are extended to approach the upper end surface of the guide frame 14 by means of having their corresponding bobbin holders 6 being maintained by the holder supports 7 at the lower position. Six radial yarns yrz3 to yrz8 from the other bobbins B3 to B8 are transfered to their upper positions adjacent the yarn fixing table 8. Thereafter, the splined shafts 2 and 9 are rotated three times, so that the circumferential yarn yθ is wound to define a first layer. In accordance therewith, the radial yarns yrz1 and yrz2 from the bobbin holders B1 and B2 at the lower position are woven inside the circumferential yarn yθ. Thereby, as shown in FIGS. 20 (*c*1), the radial yarns yrz1 and yrz2 extend axially with three turns of the circumferential yarn yθ being wound thereabout. The radial yarns yrz1 and yrz2 are then bent perpendicularly along the bottom surface of the cylindrical member 19. The other six radial yarns, which were bent outwardly remain unrestricted.

Next as shown in FIG. 20 (*d*2), the bobbins B5 and B6 are transferred from the holder support 13 at the upper position to the holder support 7 at the lower position, so that the radial yarns yrz5 and yrz6 approach the upper end surface of the guide frame 14. In this state, the splined shafts 2 and 9 are rotated to wind a second layer of circumferential yarns y0. Accordingly, as shown in FIG. 20 (*e*2), the radial yarns yrz5 and yrz6 are pressed toward the axis and extend longitudinally while three turns of the circumferential yarns yθ are wound thereabout. Thereby they are perpendicularly bent along the bottom surface of the cylindrical member 19. The other four radial yarns which remain bent outwardly are still unrestricted, whereby the state shown in FIGS. 20 (*e*1), (*e*2) and (*e*3) is obtained. Then, as shown in FIG. 20 (*f*2), after the bobbins B3 and B4 are moved from the upper position to the lower position, the splined shafts 2 and 9 are again rotated. Thereby, the third and fourth layers of circumferential yarns yθ are wound to create the state shown in FIGS. 20 (*g*1), (*g*2) and (*g*3), thereby completing the first stage of weaving.

Next, as shown in FIGS. 20 (*h*1), (*h*2) and (*h*3), the splined shafts 2 and 9 move upward so as to draw up the three dimensional fabric F by a specified amount. The bobbins B1, B2, B3 and B4 at the lower position are transferred to the upper position. On the other hand, the bobbins B7 and B8 at the upper position are delivered to the lower position so that the radial yarns take the positions as shown in FIGS. 20 (*h*1), (*h*2) and (*h*3). Then, two turns of the circumferential yarn yθ are wound by rotating the splined shafts 2 and 9. As a result, the radial yarns yrz5 and yrz6, which are drawn from the bobbins B5 and B6 and which have been extending longitudinally outside of the first layer of circumferential yarns yθ, are disposed, as shown in FIG. 20 (*i*2), to extend longitudinally along the outer peripheral surface of the cylindrical member 19. The radial yarns yrz7 and yrz8 are transposed from the outermost layer of the fabric to the inside of the first layer of circumferential layers yθ along the outer peripheral surface of the cylindrical member 19, as shown in FIG. 20 (*i*3).

Next, as shown in FIG. 20 (*j*2), the bobbins B3 and B4 are transfered from the upper position to the lower position, thereby placing the radial yarns yrz3 and yrz4 adjacent to the guide frame 14. The splined shafts 2 and 9 are then rotated pressing the radial yarns yrz3 and yrz4 inward so that they extend longitudinally between the first and second layers of circumferential yarns yθ on the outer peripheral surface of the cylindrical member 19. With these actions, the state shown in FIGS. 20 (*k*1), (*k*2) and (*k*3) is obtained, thereby completing the second stage of weaving.

Next, as shown in FIGS. 20 (*l*1), (*l*2) and (*l*3), the splined shafts 2 and 9 move upward to draw up the three dimensional fabric F by a fixed amount. The bobbins B3, B4, B7 and B8 at the lower position are transfered to the upper position. On the other hand, the bobbins B1 and B2 are delivered to the lower position. The circumferential yarn yθ is then wound by rotating the splined shafts 2 and 9. Thereby, the radial yarns yrz1 and yrz2 from the bobbins B1 and B2 are transposed from the outermost layer of the fabric to the inside of the first layer of circumferential yarns yθ, as shown in FIG. 20 (*m*1). The radial yarns yrz5 and yrz6 from the bobbins B5 and B6 are arranged to extend longitudinally as before inside the first layer of circumferential yarns yθ, as shown in FIG. 20 (*m*2). Then, the bobbins B3 and B4 are conveyed from the upper position to the lower position, and the radial yarns yrz3 and yrz4 are placed near the guide frame 14, as shown in FIG. 20 (*n*2). After that, the splined shafts 2 and 9 are rotated to lay two more turns of the circumferential yarn yθ. Accordingly, as shown in FIGS. 16 (*m*1) and (*m*2), the radial yarns yrz3 and yrz4, which have been extending longitudinally between the first and second layers of the circumferential yarns yθ, are further extended in the longitudinal direction as before. Thereby, the state of arrangement of the yarns is obtained as shown in FIGS. 20 (*o*1) and (*o*2), so as to complete the third stage of weaving. The three dimensional fabric continues to be successively woven around the cylindrical member 19 in the same manner as the third to fifth embodiments.

The third to sixth embodiments may be modified as follows.

Figure 21:
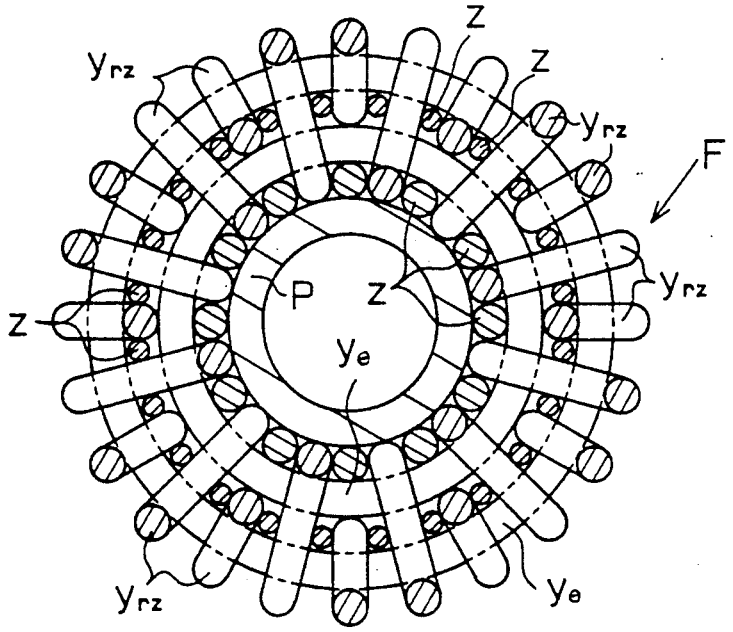
FIG. 21 is a sectional view of a modified three dimensional fabric.

For example, a three dimensional fabric illustrated in FIG. 21 comprises radial yarns yrz which include two kinds: one being turned alternately between the inside of the first layer of circumferential yarns yθ and the outside of the second layer, the other being turned alternately between the inside and outside of the second layer. These two kinds of radial yarns yrz are alternately woven into the fabric as seen in FIG. 21.

The number of the yarn layers may be increased with respect to the axial yarns z, the circumferential yarns and/or the radial yarns yrz. Moreover, the weaving may be carried out while fixing a core metal to the support table 101 and fitting the pipe P or cylindrical member 19 to the core metal, in lieu of directly securing the pipe P or cylindrical member 19 to the support table 101. In this case, the core metal bears the force applied to the pipe P or cylindrical member 19 during weaving. With this arrangement, the pipe P or cylindrical member 19 will not deform during the weaving procedure even if they are thin-walled. Alternately, the weaving may start in the state where the ends of the axial yarns z or radial yarns yrz are attached to the end of the pipe P or cylindrical member 19. Moreover, only one of the holder supports 7 and 13 needs to be vertically movable, instead of both being vertically movable as described above. Further, the side of the circumferential yarn supplier 15 may be revolved about the support table 1 for the purpose of winding the circumferential yarn yθ, in place of the supports 4 and 11 being rotated. Additionally, it is possible to provide a plurality of circumferential yarn suppliers.

The device used to hold the bobbin holder 6 for the radial yarns yrz may be pneumatic or hydraulic in place of the described magnet. Further, the pipe P may have a rectangular or elliptic section.

As mentioned above, in the three dimensional fabric of the third to sixth embodiments, the cylindrical member disposed at the center is covered by the fabric composed of the three kinds of yarns, axial, radial and circumferential yarns z, yrz and y$\theta$, respectively. Therefor, when used in a composite material impregnated with a matrix like resin, the three dimensional fabric of each embodiment can be used in applications that strictly require size accuracy of the inner surface and/or oil or chemical resistance, by using a cylindrical member which satisfies such requirements. In such arrangement, the composite member holds most of the stress applied to the interior of the cylindrical member. In other words, there is little need for the cylindrical member itself to posses mechanical strength. As a result, it becomes possible to use a thin-walled cylindrical member with a precisely sized inner surface and/or having the desired oil or chemical resistance, thereby enabling the fabrication of lighter weight products. In addition, the three dimensional fabrics are constructed by three types of yarn elements. So, even in case wherein stresses deform the composite material, separation between the inner and outer layers is prevented since each yarn layer contributes to the protection of the cylindrical member.

SEVENTH EMBODIMENT

A seventh embodiment will be hereafter described referring to FIGS. 22 to 29.

Figure 27:
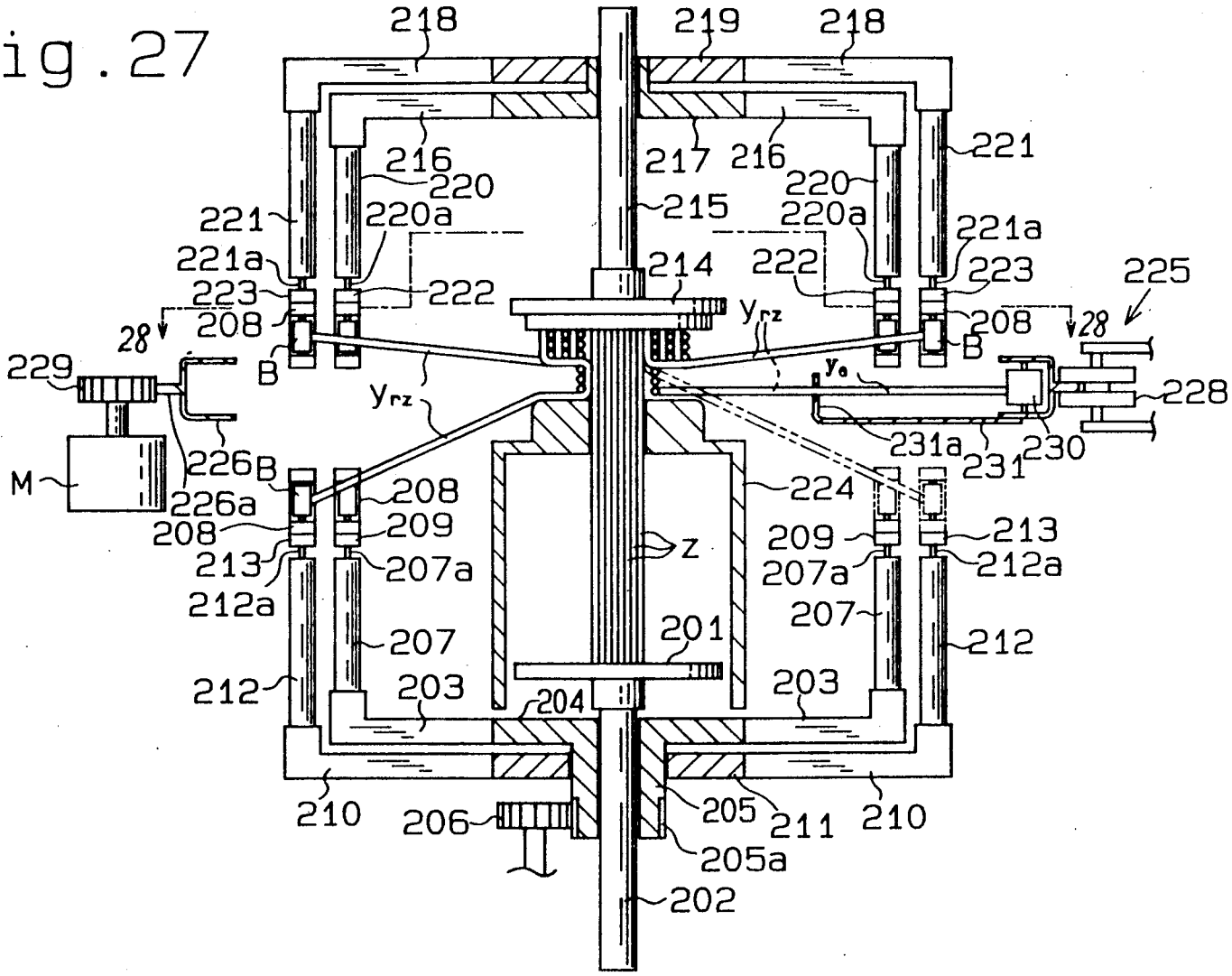
FIG. 27 is a partially broken schematic front view of a three dimensionally weaving machine suitable for weaving the fabric shown in FIG. 22.

As shown in FIG. 27, a three dimensionally weaving machine has a vertically divided structure with a weaving portion therebetween. A support shaft 202 is constructed to be vertically movable by a drive mechanism (not shown). A yarn fixing table 201 is mounted at the upper end of the support shaft 202 so as to be vertically movable and rotatable together therewith. A support 204 has a multiplicity of radially extending arms 203 and is positioned below the yarn fixing table 201. The support 204 is rotatable and has a boss portion 205 that is journaled about and is vertically movable relative to the shaft 202. The boss 205 has an external geared portion 205*a* that meshes with a gear 206. The gear 206 is reversibly rotatable and is driven by a motor (not shown). The gear 206 rotates the support 204 about the splined shaft 202. An independent air cylinder 207 is fixed at the free end of each arm 203 and extends upward. A holder support 209 is mounted on the free end of a piston rod 207*a* of the air cylinder 207. The holder support 209 has an electromagnet provided thereon that cooperate with a bobbin holder 6 formed of a magnetic material to couple the bobbin holder to the holder support 209. A bobbin B with a radial yarn yrz wound therearound is detachably fitted to the bobbin holder 208.

Figure 28:
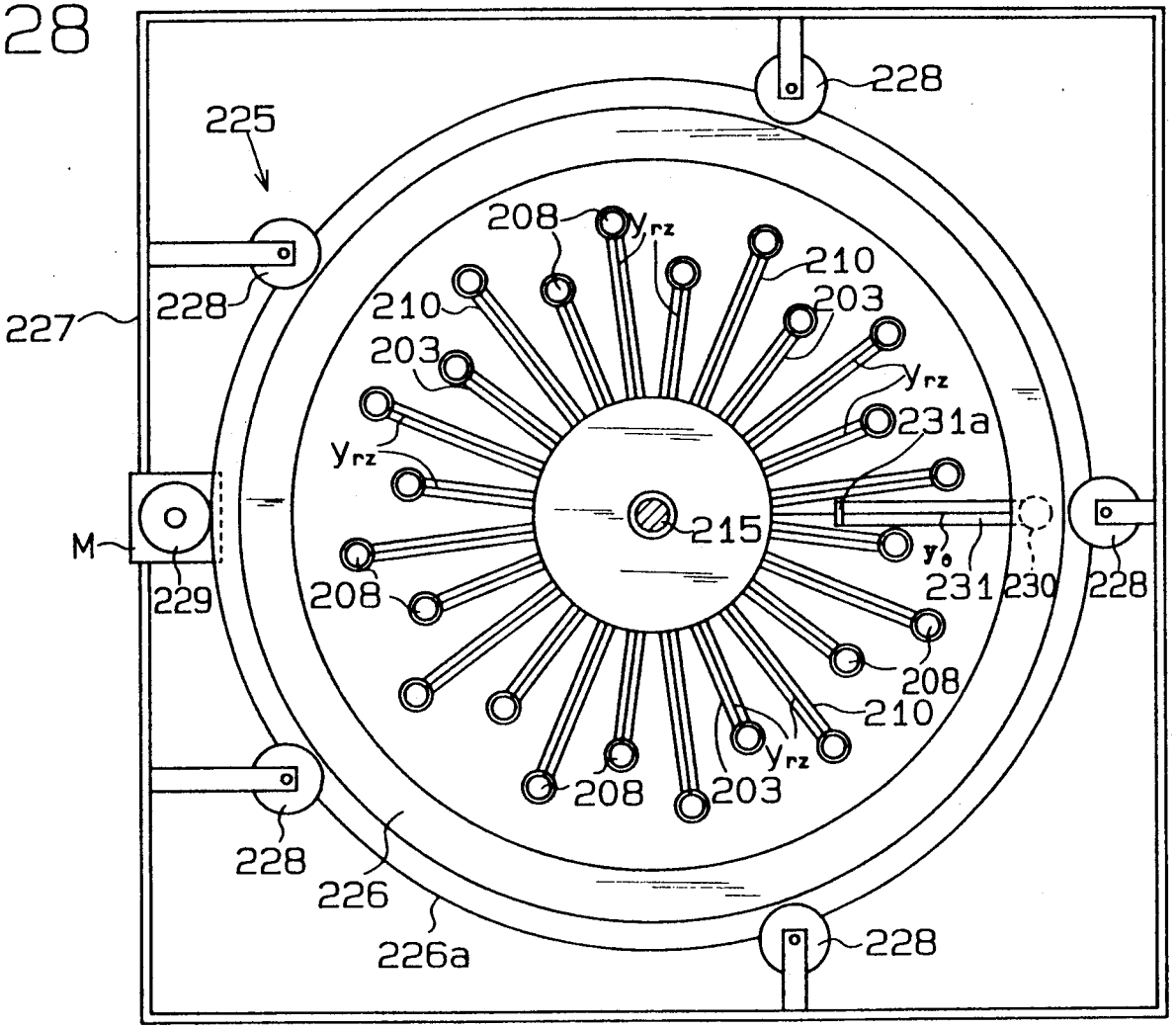
FIG. 28 is a sectional view taken along the line 28—28 of FIG. 27.

A support 211 has a multiplicity of arms 210 like the support 204. It is held by the boss portion 205 of the support 204 so as to be rotatable therewith. As shown in FIG. 28, each arm 210 extends beyond the free end of the adjacent arms 203 of the support 204. Each arm 210 is shifted relative to the adjacent arms 203 such that when viewed from the top as in FIG. 28, the arms 203 and 210 alternate. An air cylinder 212 is mounted on the free end of each arm 210 so as to extend upward. A holder support 213, similar to the one previously mentioned, is fitted to the free end of a piston rod 212*a* of the cylinder 212.

A yarn fixing table 214 functions as a yarn support and holds all three kinds of yarns which constitute the fabric. The table 214 is secured to the lower end of a support shaft 215 and is positioned above the yarn fixing table 201. The shaft 215 is provided on the same axis as the support shaft 202. Both the splined shafts 202 and 215 are completely separated, but are adapted to vertically move in fixed directions in synchronization with each other. A support 217 has the same number of the radially extending arms 216 as the support 204. The support 217 is mounted on the shaft 215 in a symmetrical way relative to the support 204 and is slidable relative thereto at a fixed position. A support 219 has the same number of the radially extending arms 218 as the support 211. The support 219 is mounted on a boss portion of the support 217 in a symmetrical way relative to the support 211. Air cylinders 220 and 221 are fixed respectively to the free ends of the arms 216 and 218 so as to extend downward. Holder supports 222 and 223 are mounted on the free ends of piston rods 220*a* and 221*a* of the cylinders 220 and 221. They support bobbin holders 208 by the action of electromagnets as previously mentioned. The holder supports 209 and 222 as well as 213 and 223 oppose one another. They transfer the bobbin holders 208 between the holder supports 209, 222, 213 and 223 by the operation of the air cylinders 207, 220, 212 and 221 and through magnetization and demagnetization of the associated electromagnets.

A guide frame 224 is provided on the upper surface of the support 204 in order to regulate the weaving position. A circumferential yarn supplier 225 is disposed at substantially the same height position as the upper surface of the guide frame 224. As shown in FIG. 28, a plurality of guide rollers 228 are attached rotatably to a support frame 227 through brackets. They support an annular rotor 226 of the circumferential yarn supplier 225. Thus, the rotor 226 is rotatable about the axis of the shaft 202 outside the holder supports 213 and 223. A gear 226*a* is formed integrally on the outer periphery of the rotor 226 and meshes with a drive gear 229 fitted to a drive shaft of a motor M. The motor M drives the gear 229 to rotate the rotor 226. A circumferential yarn bobbin 230 with a circumferential yarn y$\theta$ wound therearound is detachably fitted to the inside of the rotor 226. A support bracket 231 is fixed to the lower surface of a fitted portion of the circumferential yarn bobbin 230 so as to extend radially relative to the shafts 202 and 215. A yarn guide 231*a* is secured to the inner end of the bracket 231. The guide 231*a* is made of a wear resistant material and guides the circumferential yarn y$\theta$ drawn out of the bobbin 230 to the weaving position. A yarn tensioning device may be provided on the support bracket 231 as desired.

Hereunder explained is a weaving operation performed by the above mentioned machine.

As shown in FIG. 27, axial yarns z are tightly extended between the centers of both the yarn fixing tables 201 and 214 before the weaving operation of the three dimensional fabric. The radial yarns yrz are drawn out of the bobbins B fitted respectively to the bobbin holders 208, and one end of each is fixed to the upper yarn fixing table 208 so as to define a multiplicity of layers in the radial direction about the axial yarns z. Thereby, as shown in FIG. 28, the radial yarns yrz are radially disposed about the splined shafts 202 and 215. A circumferential yarn y$\theta$ is drawn out of the circumferential yarn bobbin 230, and one end thereof is fixed to the upper yarn fixing table 214. Then, the weaving operation starts with the bobbin holders 208 being held by either of the upper and lower holder supports 209, 213, 222 and 223 in accordance with a desired weaving condition.

As shown in FIG. 27, the radial yarns yrz drawn out of the bobbin holders 208 held by the upper holder supports 222 and 223 in their upper positions remain positioned above the circumferential yarn y0. The radial yarns yrz held by the lower holder supports 209 and 213 in their lower positions cross the circumferential yarn y$\theta$, as shown by the two-dot chain line in the same figure. When the circumferential yarn holder 230 is rotated past a bobbin holder 208 located at its lower position, then, the radial yarn yrz held thereby is secured by the circumferential yarn y$\theta$ so as to extend along the axis on the peripheral surface of the three dimensional fabric being woven.

Figure 23:
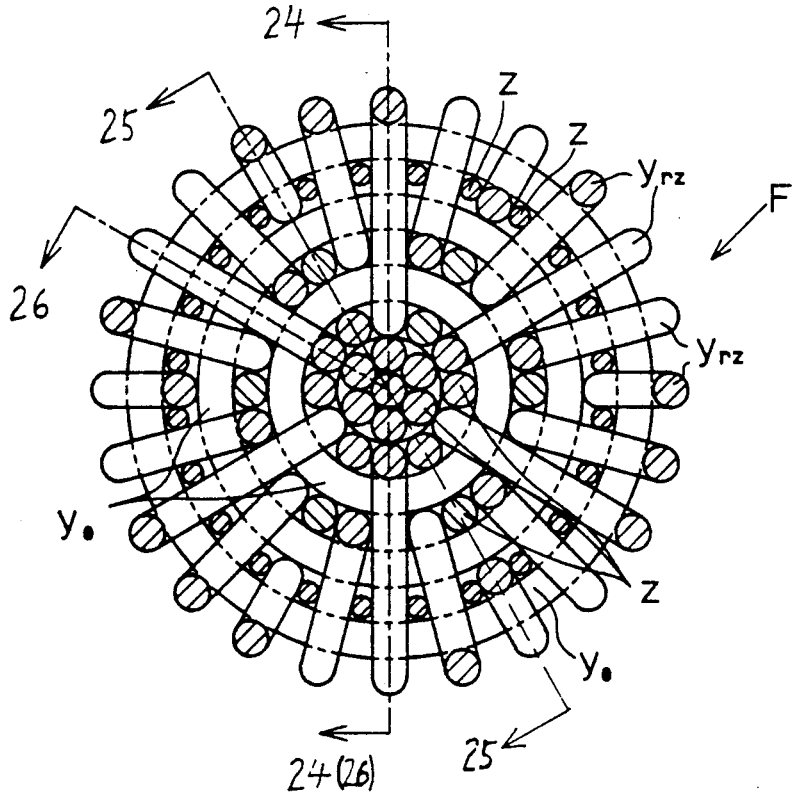
FIG. 23 is a sectional view of the three dimensional fabric shown in FIG. 22.
Figure 29:
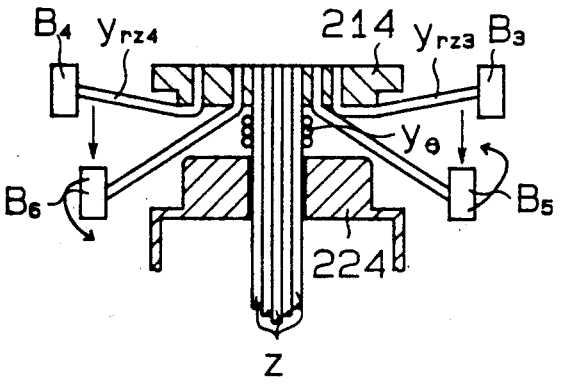
FIGS. 29 (*a*1) to (*s*1) are sequential schematic cross sectional views showing the progression of the weaving operation as seen along the line 24—24 of FIG. 23.
Figure 29:
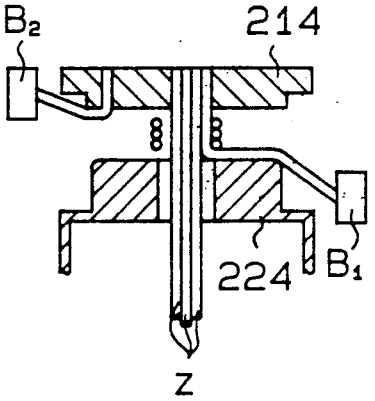
Figure 29:
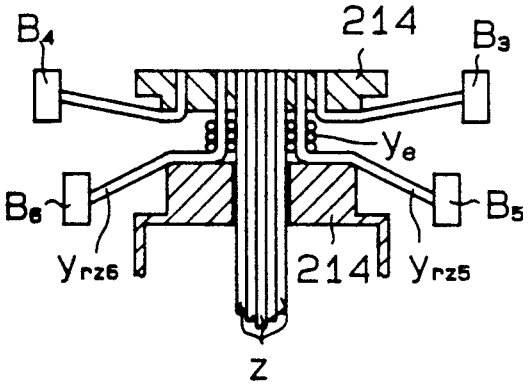
Figure 29:
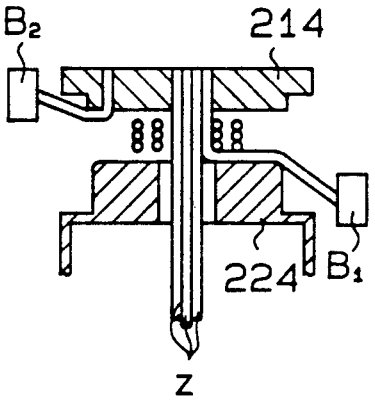
Figure 29:
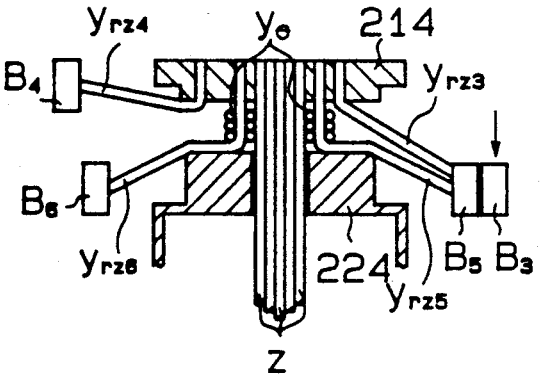
Figure 29:
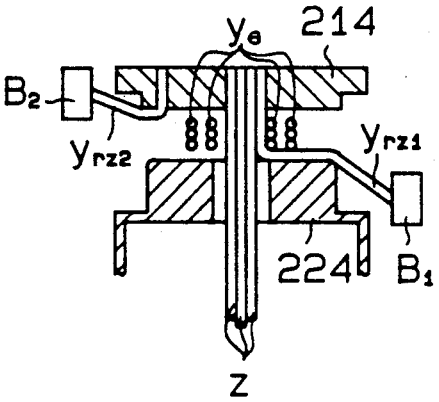

FIGS. 29 (*a*1) and (*a*2) illustrate the state, as viewed in the sections taken along the lines 24—24 and 25—25 of FIG. 23, from which a weaving starts to create the three dimensional fabric as shown in FIGS. 22 to 26. From this state, as shown in FIG. 29 (*b*1) and (*b*2), the radial yarn yrz1 from the bobbin B1 is extended to approach the upper end surface of the guide frame 224 by means of being maintained by the holder support 213 at the lower position. Five radial yarns yrz2, yrz3, yrz4, yrz5 and yrz6 from the other bobbins B2, B3, B4, B5 and B6 are bently retained at the upper position via the holder supports 222 and 223, such that they extend adjacent the yarn fixing table 214. Thereafter, the motor M drives the gear 229 to rotate the rotor 226 three times, so that the circumferential yarn y$\theta$ is wound to define a first layer around the axial yarns z between both the yarn fixing tables 201 and 214. In accordance therewith, the radial yarn yrz1 from the bobbin holder B1 at the lower position is woven inside the circumferential yarn y$\theta$ which has been wound three turns around the axial yarns z, thereby making the state shown in FIGS. 29 (*c*1) and (*c*2). Thereby, the radial yarn yrz1 is urged toward the axis inside the first layer of circumferential yarns y$\theta$. The other five radial yarns bent outwardly remain unrestricted.

Next, as shown in FIGS. 29 (*d*1) and (*d*2), the bobbins B5 and B6 are transfered from the holder support 222 at the upper position to the holder support 209 at the lower position. Thereby, the radial yarns yrz5 and yrz6 approach the upper end surface of the guide frame 224. In this state, the support 204 rotates and the bobbins B5 and B6 rotate together therewith a fixed angle in the circumferential direction. Thus, the radial yarns yrz5 and yrz6 from the bobbins B5 and B6 are disposed aslant the axis. After that, the rotor 226 rotates three times and a second layer of circumferential yarns y$\theta$ is wound to form three turns. Consequently, the radial yarns yrz5 and yrz6 are tightly pressed to the outside of the first layer of circumferential yarns y$\theta$ while extending aslant relative to the axis. The radial yarns yrz2, yrz3 and yrz4 which are bent outwardly remain unrestricted, whereby the state shown in FIGS. 29 (*e*1) and (*e*2) is obtained. Then, the support 204 rotates inversely a prescribed angle, and the holder support 209 is placed at such a position that the radial yarns from the bobbins B5 and B6 run vertically along the axis from the end fixed by the second layer of circumferential yarns y$\theta$. Thus, the holder support 209 at the lower position faces the holder support 222 at the upper position. Next, as shown in FIGS. 29 (*f*1) and (*f*2), the bobbin B3 is moved from the upper position to the lower position in the same manner as mentioned above. Then, the circumferential yarn y0 is wound by the rotation of the rotor 226, with a resultant state shown in FIGS. 29 (*g*1) and (*g*2), thereby completing the first stage of weaving.

Next, the shafts 202 and 215 move upward so as to draw up the three dimensional fabric by a specified amount. The bobbins B1, B3, B5 and B6 at the lower position are transfered to the upper position. On the other hand, the bobbin B2 is moved to the lower position so that the radial yarns take the positions as shown in FIGS. 29 (*h*1) and (*h*2). Then, the winding of the circumferential yarn y$\theta$ is carried out by the rotation of the rotor 226. Thus, the radial yarn yrz2 from the bobbin B2 is transposed, as shown in FIG. 29 (*i*1), from the outermost layer of the fabric to the inside of the first layer of circumferential yarns y$\theta$. Sequentially, as shown in FIG. 29 (*j*2), the bobbins B5 and B6 are carried from the upper position to the lower position, whereby the radial yarns yrz5 and yrz6 are placed adjacent to the guide frame 224. The bobbins B5 and B6 are rotated a specified angle in the circumferential direction in the same manner as previously described, so that the radial yarns yrz5 and yrz6 are placed aslant the axis. After that, the rotor 226 rotates three times and the radial yarns yrz5 and yrz6 are pressed inward as in the same manner as mentioned previously by the circumferential yarn y$\theta$. Thus, the state shown in FIGS. 29 (*k*1) and (*k*2) is obtained. In this case, the radial yarns yrz5 and yrz6, that have been in axially extending state between the first and second layers of the circumferential yarns y$\theta$ at the first stage of weaving, are both extended downward while keeping their inclined orientation. After the support 204 is rotated inversely a fixed angle in the above mentioned manner, as shown in FIG. 29 (*l*2), the bobbin B4 is conveyed from the upper position to the lower position. Then, the rotor 226 rotates to wind the circumferential yarn y0. Accordingly, as shown in FIGS. 29 (*m*1) and (*m*2), the radial yarn yrz4 from the bobbin B4 is transposed from the outermost position to a position sandwitched between the second and third layers of the circumferential yarns y$\theta$. Thus, they define radial elements as well as axial elements of short size, thereby completing the second stage of weaving.

Next, as shown in FIGS. 29 (*n*1) and (*n*2), the shafts 202 and 215 are moved upward to draw up the three dimensional fabric F a predetermined amount. The bobbin B1 is transferred to the lower position and the bobbins B2, B4, B5 and B6 to the upper position. Then, the rotor 226 rotates so as to perform the winding of the circumferential yarn y$\theta$. In accordance therewith, the radial yarn yrz1 from the bobbin B1 is transposed from the outermost position to the inner layer of the fabric F so as to extend in the radial direction. It runs consecutively in the longitudinal direction, thereby to obtain the state of the arrangement of the yarns as shown in FIGS. 29 (*o*1) and (*o*2). In succession thereto, as shown in FIG. 29 (*p*2), the bobbins B5 and B6 are transferred to the lower position and rotated a predetermined angle in the circumferential direction as in the same manner as before. Thus, the radial yarns yrz5 and yrz6 from the bobbins B5 and B6 are arranged aslant relative to the axis. Then, the rotor 226 rotates so as to perform the winding of the circumferential yarn y$\theta$, thereby to obtain the state of the arrangement of the yarns in which the radial yarns yrz5 and yrz6 from the bobbins B5 and B6 keep defining the axial yarns as shown in FIGS. 29 (*q*1) and (*q*2). Next, as shown in FIG. 29 (*r*2), the bobbin B3 is carried to the lower position. The circumferential yarn y$\theta$ is again wound by rotating the rotor 226. Accordingly, the radial yarn yrz3 from the bobbin B3 is pressed between the second and third layers of circumferential yarns yθ, so as to define radial elements as well as axial elements of short size. Thus, the yarns are arranged as shown in FIGS. 29 (*s*1) and (*s*2), which shows the completion of the third stage of weaving. Hereafter the weaving is repeated step by step as described above, thereby forming a columnar three dimensional fabric F with the axial yarns z at the center.

Figure 22:
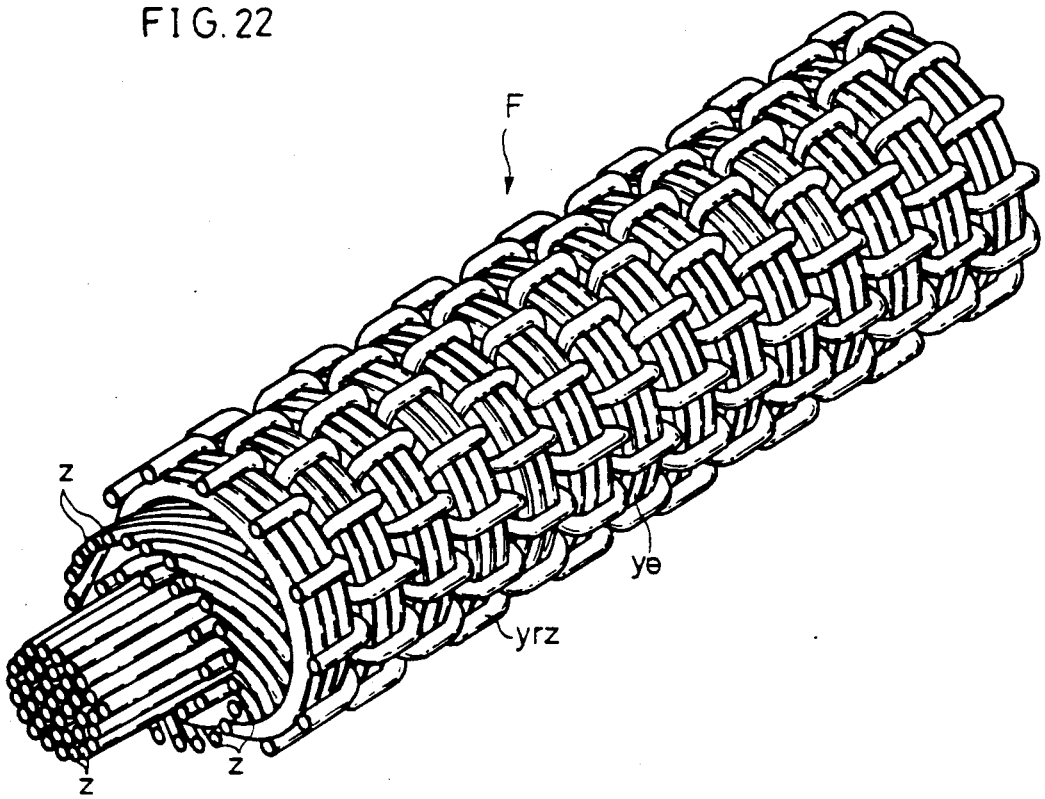
FIGS. 22 is a schematic perspective view of a seventh embodiment of the three dimensional fabric.

FIG. 22 illustrates a schematic perspective view of the three dimensional fabric F obtained by this weaving method. FIGS. 23 to 26 show respectively the section of the same fabric. In this weaving method, the radial yarns yrz5 and yrz6 are woven into the fabric so as to unchangedly extend along the axis, thereby forming the slanted axial yarns z of the three dimensional fabric F. The winding of the circumferential yarns yθ is carried out by the rotation of the rotor 226 in the state that the radial yarns yrz5 and yrz6 are inclined relative to the axis. As a result, the radial yarns yrz5 and yrz6 from the bobbins B5 and B6 rund downward while slanting relative to the axis at any time. In other words, they are spirally woven. The other radial yarns yrz are repeatedly woven into three repeating patterns. They are in order: those alternately turned between the inside of the first layer and the outside of the third layer of the circumferential yarn y0; those alternately turned between the inside of the second layer and the outside of the third layer; those alternately turned between the inside and the outside of the third layer.

In this embodiment, the center axial yarns z are tightened straightly. However, in modified embodiments, the center axial yarns z may be twisted and extended aslant relative to the axis.

Eighth Embodiment

Figure 31:
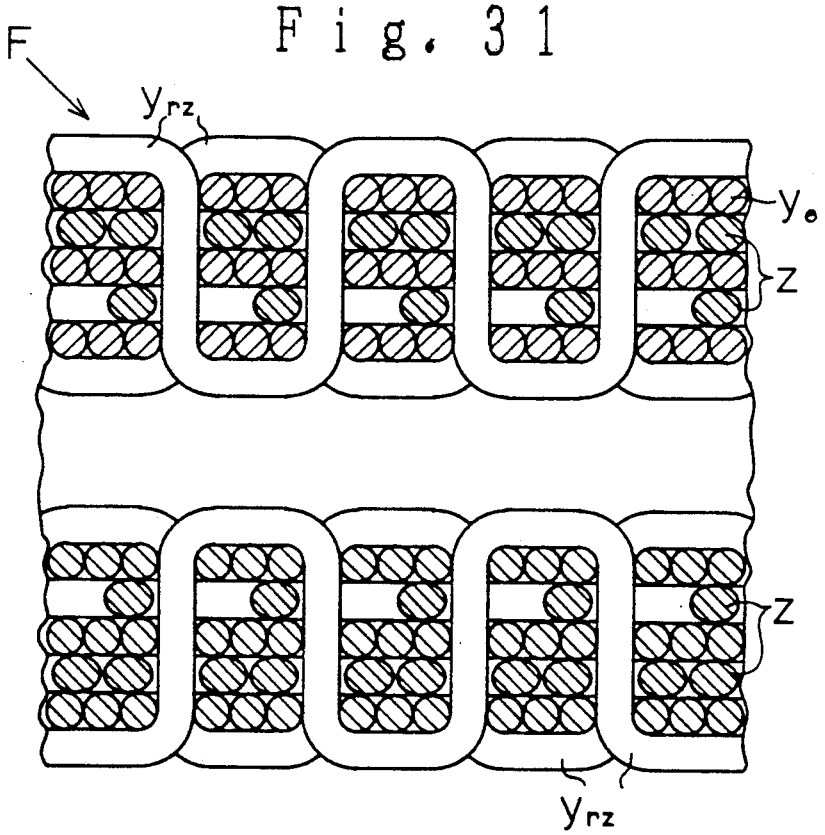
FIG. 31 is a sectional view taken along the line 31—31 of FIG. 30.
Figure 32:
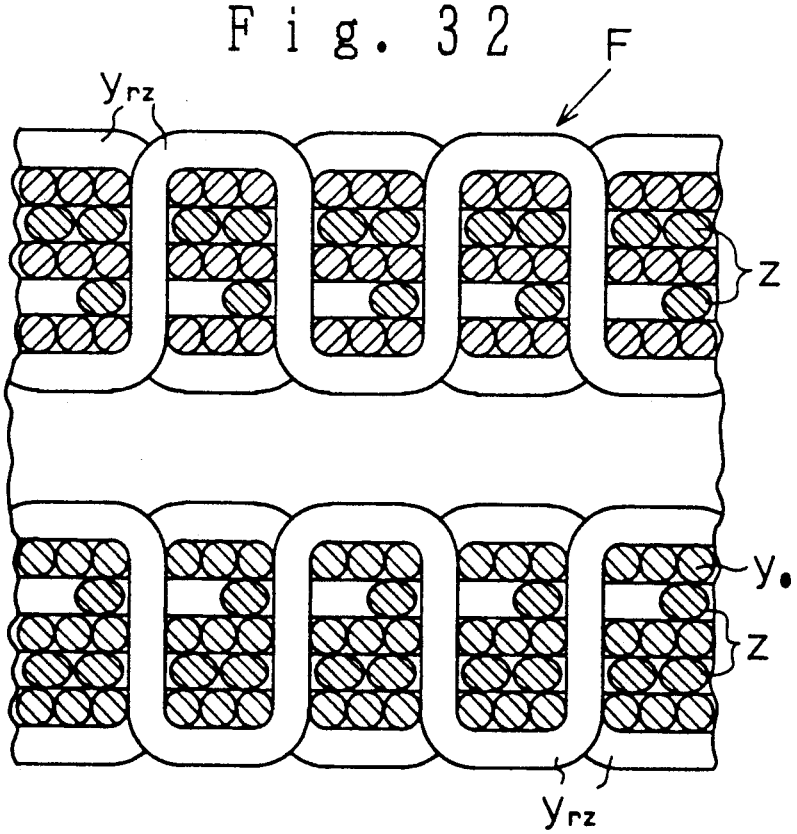
FIG. 32 is a sectional view taken along the line 32—32 of FIG. 30.

Next, an eighth embodiment will be described referring to FIGS. 30 to 32. A three dimensional fabric F of this embodiment has a large difference from that of the seventh embodiment in that it has no axial yarns z at the center and that all radial yarns yrz are alternately turned between the inside of the innermost layer and the outside of the outermost layer of circumferential yarns yθ.

In this embodiment, a columnar or cylindrical core member is disposed between the centers of the yarn fixing tables 201 and 214 in place of the axial yarns Z, and the weaving is performed as the seventh embodiment.

The core member may take the form of a metallic member, a rolled up fabric, or a structure such as a blade. The core member may be retained at the center without removal after weaving.

The seventh and eighth embodiments may be modified as follows.

Figure 33:
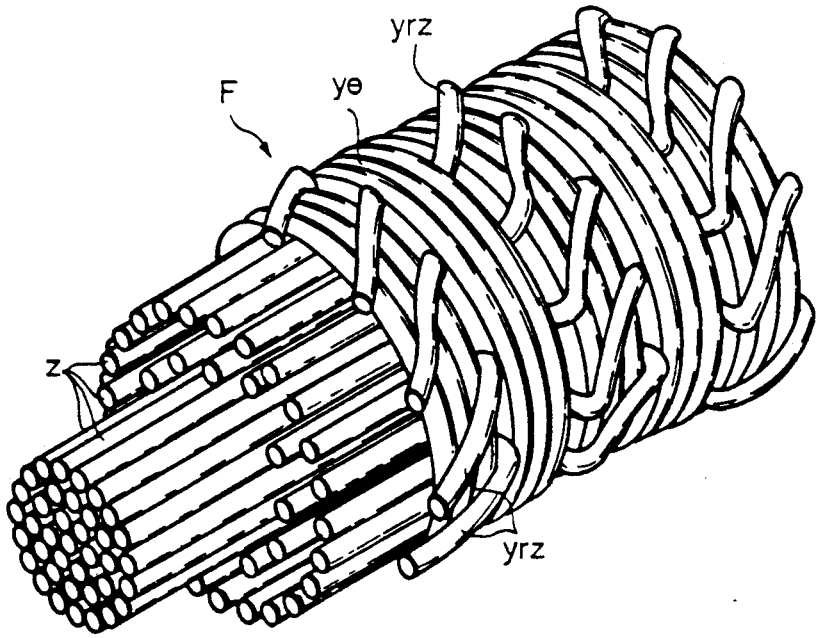
FIG. 33 is a schematic perspective view of a modified three dimensional fabric.
Figure 24:
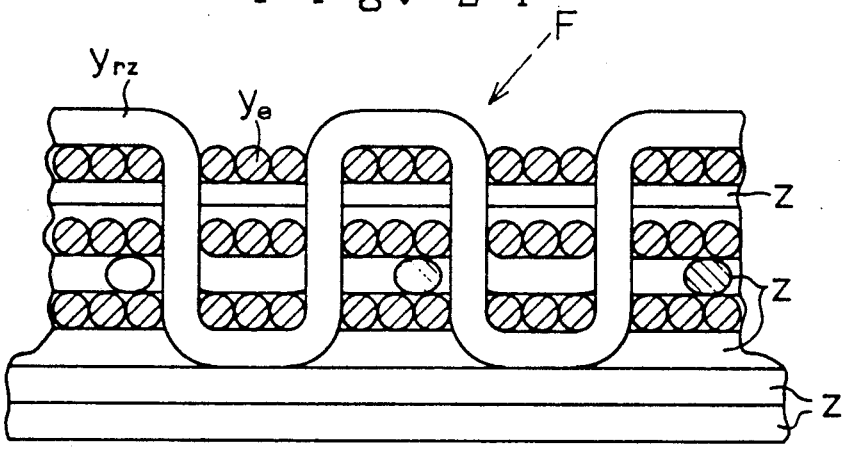
FIG. 24 is a sectional view taken along the line 24—24 of FIG. 23.
Figure 25:
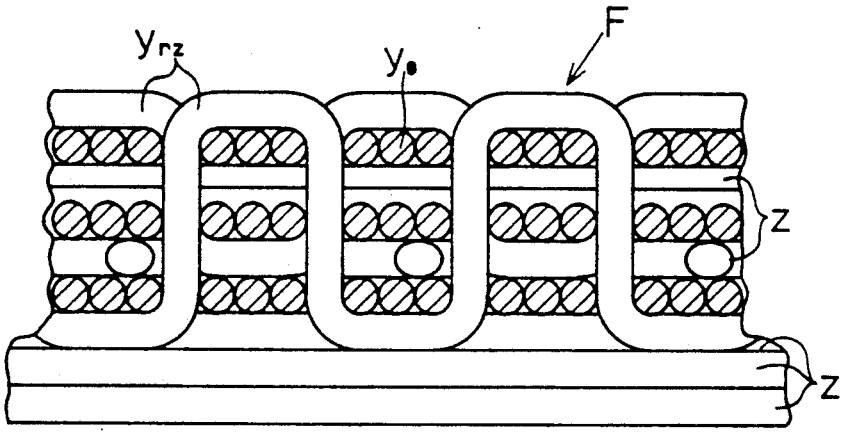
FIG. 25 is a sectional view taken along the line 25—25 of FIG. 23.
Figure 26:
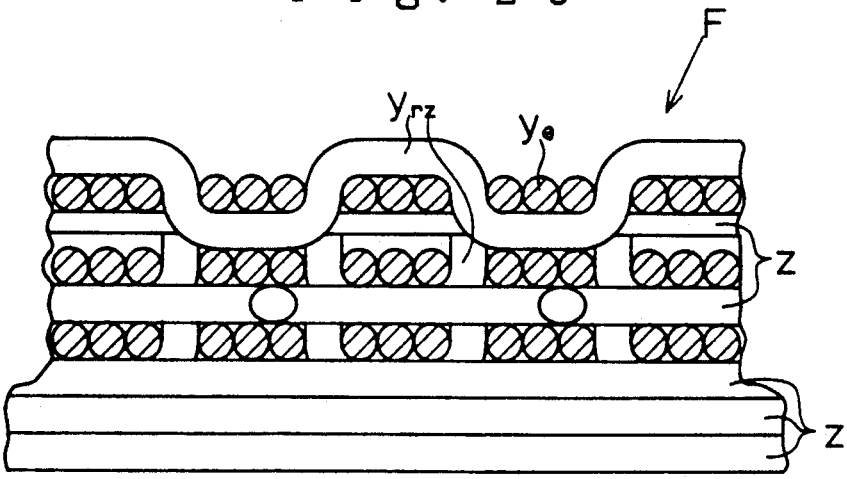
FIG. 26 is a sectional view taken along the line 26—26 of FIG. 23.
Figure 34:
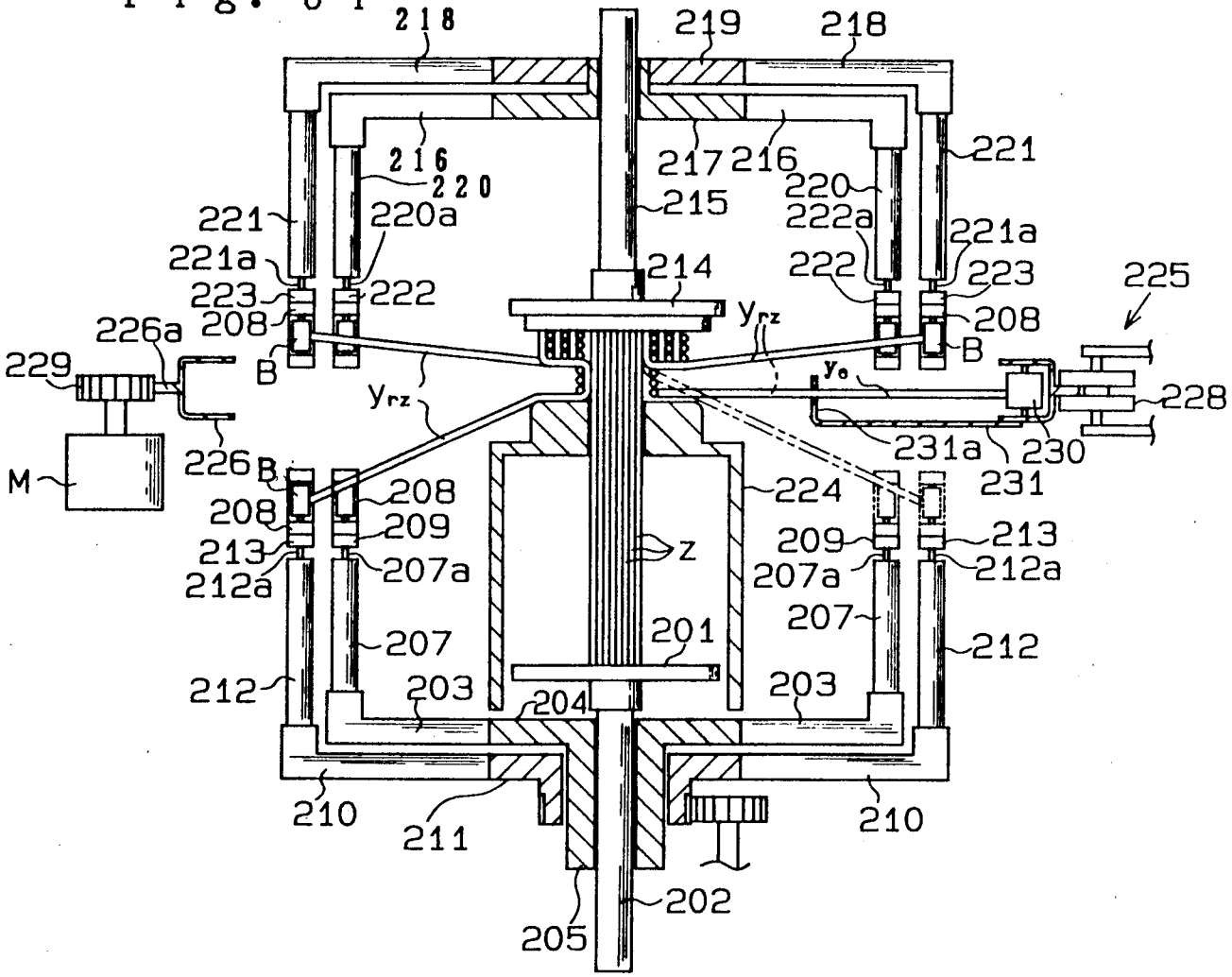
FIG. 34 is a partially broken schematic front view of a three dimensionally weaving machine of the modification.
Figure 35:
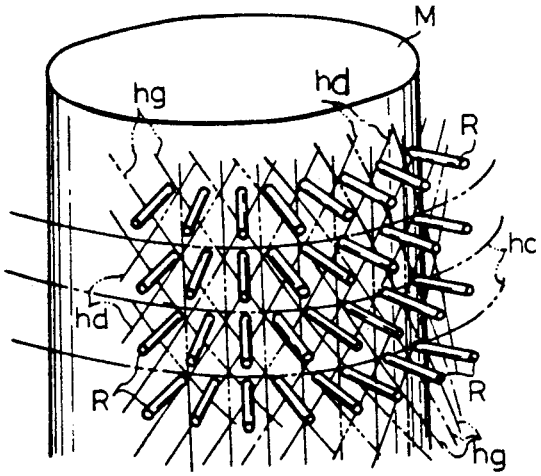
FIG.35 Prior Art
FIG. 35 is a schematic view showing a conventional weaving method.
Figure 36:
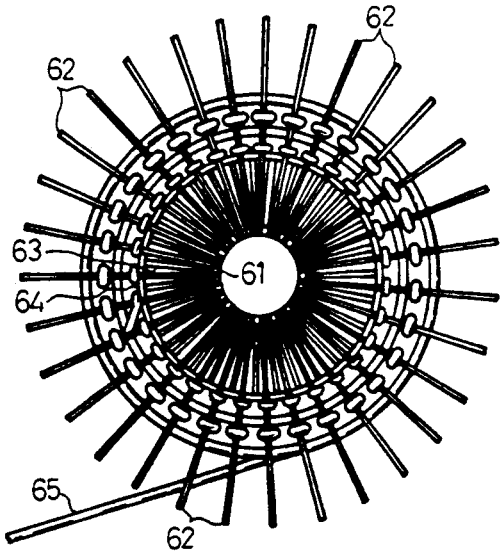
FIG.36 Prior Art
FIG. 36 is a plan view showing another conventional weaving method.
Figure 37:
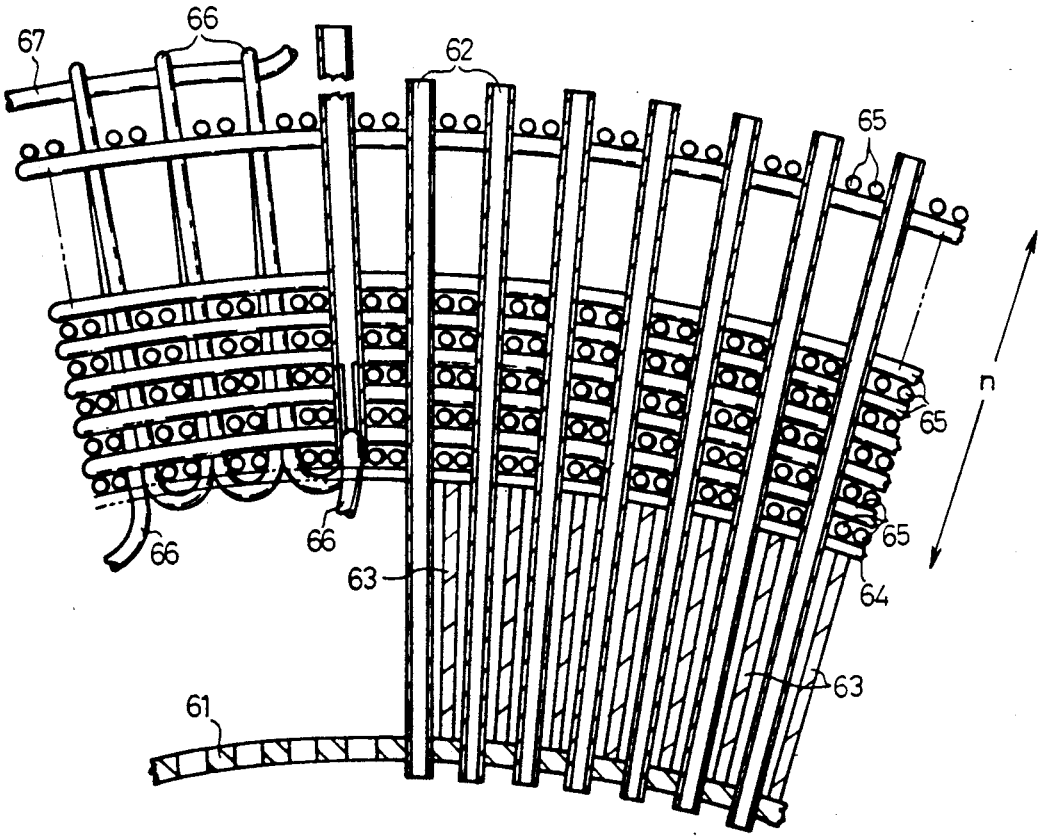
FIG.37 Prior Art
FIG. 37 is a partial sectional view of FIG. 36.

For example, as shown in FIG. 33, the radial yarns yrz may be woven while inclined relative to the axis. In this case, as shown in FIG. 34, the support 211 is made rotatably drivable, and the holder support 209 for holding the bobbin holder 208 at the lower position is adapted to be rotatable about the shaft 202.

Part of the axial yarns z as well as radial yarns yrz may be slanted relative to the axis. Further, the weaving machine may be arranged such that only one of the facing pair of holder supports 209 and 222 or 213 and 223 is vertically movable. Furthermore, pneumatic or hydraulic holders may be used in lieu of the magnets as the devices for retaining the bobbin holders 208. Moreover, a plurality of circumferential yarn bobbins 230 may be furnished on the rotor 226 so as to supply the circumferential yarns yθ from plural positions. In addition, the side of yarn fixing tables 201 and 214 and supports 203, 211, 217 and 219 may be rotated in order to wind the circumferential yarn yθ, instead of the side of the circumferential yarn bobbin 230 being revolved about the shafts 202 and 215.

As described above in detail, the three dimensional fabric of the seventh and eighth embodiments have stronger resistance to a twisting stress, since it has at least one layer of axial yarns z or radial yarns yrz inclined relative to the axis.

As many apparently widely different embodiments of this invention may be made without departing from the spirit and scope of this invention, it is to be understood that the invention is not limited to the specific embodiments described herein, but rather is defined by the scope of the appended claims.

What is claimed is:

1. A three dimensional fabric having an axis, the fabric comprising:

a plurality of tubular axial yarn layers arranged concentrically about and outward from the axis, each of the axial yarn layers including a plurality of axial yarns extending longitudinally relative to the axis;

a circumferential yarn inserted to extend circumferentially around the axis and woven about a selected axial yarn layer; and a plurality of radial yarns, each radial yarn being woven between portions of the circumferential yarn to extend zigzag successively in longitudinal and radial directions relative to the axis, while being substantially perpendicular to the circumferential yarn, the radial yarns each being woven in a particular plane that extends through said axis.

2. A three dimensional fabric according to claim 1, in which the circumferential yarn defines a plurality of tubular circumferential yarn layers, a first circumferential yarn layer being positioned around the outside of the outermost axial yarn layer, a second circumferential yarn layer being positioned inside of the innermost axial yarn layer, and a third circumferential yarn layer being positioned between a pair of adjacent axial yarn layers;

the radial yarns include first and second radial yarns;

each of the first radial yarns having first portions longitudinally extending along the outside of the outermost circumferential yarn layer, second portions longitudinally extending along the inside of the innermost circumferential yarn layer, and third portions radially extending to connect the first and second portions of said first radial yarns; and each of the second radial yarns having first portions longitudinally extending along the outside of the outermost circumferential yarn layer, second portions longitudinally extending between the outermost and innermost circumferential yarn layers, and third portions radially extending to connect the first and second portions of said second radial yarns.

3. A three dimensional fabric according to claim 2, in which each of the circumferential yarn layers has a plurality of circumferential yarn turns between adjacent third portions of the first radial yarns and between adjacent third portions of the second radial yarns.

4. A three dimensional fabric according to claim 2, in which the third portion of at least some of the first radial yarns are positioned circumferentially between adjacent third portions of the second radial yarn.

5. A three dimensional fabric according to claim 1, in which the circumferential yarn defines a plurality of circumferential yarn layers of substantially cylindrical shape including a first circumferential yarn layer positioned around the outside of the outermost axial yarn layer, a second circumferential yarn layer positioned inside of the innermost axial yarn layer, and a third circumferential yarn layer positioned between a pair of adjacent axial yarn layers; and the three dimensional fabric further includes a plurality of axial yarns axially extending along the inside of the innermost circumferential yarn layer; and whereby the three dimensional fabric is shaped into a solid column.

6. A three dimensional fabric according to claim 1, wherein the axial, circumferential and radial yarns are woven to form a hollow portion inside of the innermost axial yarn layer.

7. A three dimensional fabric according to claim 6, further comprising a tubular member positioned within the hollow portion.

8. A three dimensional fabric according to claim 7, in which the tubular member has a pair of flanges at axially opposite ends and each of the yarns is disposed between said flanges.

9. A three dimensional fabric according to claim 6, further comprising a cylindrical member disposed within the hollow portion such that the cylinder extends coaxially with the fabric, the cylindrical member having opposing ends and a body portion.

10. A three dimensional fabric according to claim 9, in which:

the yarns are woven to cover an outer periphery of the body portion of the cylinder and one of the ends; and the cylinder has a cavity opening into its opposite end, the open end of the cylinder being arranged to receive a piston.

11. A three dimensional fabric according to claim 1, in which the circumferential yarn defines at one side in the axial direction, a first plurality of tubular circumferential yarn layers including a first outer circumferential yarn layer positioned around the outside of the outermost axial yarn layer, a first inner circumferential yarn layer positioned inside of the innermost axial yarn layer, and a first middle circumferential yarn layer positioned between two adjacent axial yarn layers;

the circumferential yarn defines, at a second side in the axial direction, a second plurality of tubular circumferential yarn layers, which have a number of layers at least one of which is different from that of the first circumferential yarn layers; and the first and second circumferential yarn layers define first and second columnar portions having different radii.

12. A threew dimensional fabric acording to claim 1, in which at least one of the yarns in a group including the axial yarns and the radial yarns is arranged aslant relative to the axis in the longitudinal direction.

13. A method for making a three dimensional fabric, which has axial yarns, radial yarns and circumferential yarns, the method comprising:

a first step for placing a center member having a longitudinal axis at a prescribed position;

a second step for fixing the first ends of a plurality of first yarns, around a first end of the center member, so as to define a plurality of layers concentrically arranged about the axis of the center member;

a third step for fixing one end of a second yarn near the axis of the center member;

a fourth step for having the second ends of a first selected group of the first yarns positioned to the side of a second end of the center member so as to tighten the selected yarns in a radially extending state, and in this state, for winding the second yarn around the center member and the tightened first selected group of first yarns so as to urge the first selected group of first yarns toward the axis, thereby turning the wound second yarn into circumferential elements while making the portions of the first selected group of first yarns inside the circumferential elements into axial elements;

a fifth step for having the second ends of a second group of the first yarns positioned to the side of the first end of the center member so as to tighten the second group of first yarns while keeping them radially extending, and in this state, for winding the second yarn around the center member, thereby turning the wound second yarn to form first circumferential elements; and a sixth step, in succession to the fifth step, for having the second ends of a selected third group of the first yarns positioned to the side of the second end of the center member so as to tighten the selected third group of first yarns while keeping them radially extending, and in this state, for winding the second yarn around the center member and the selected third group of first yarns so as to urge the selected third group of first yarns toward the axis, thereby turning the wound yarn to form second circumferential elements while making portions of the selected third group of first yarns between the first and second circumferential elements into radial elements, said third group of first yarns including members from said first or second groups;

selectively repeating the fourth through sixth steps so as to weave axial yarns, radial yarns and circumferential yarns around the outer periphery of the center member.

14. A method for making a three dimensional fabric according to claim 13, in which the center member comprises a plurality of axial yarns tightened between two yarn supports.

15. A method for making a three dimensional fabric according to claim 13, in which the center member is a cylindrical one.

16. A method for making a three dimensional fabric according to claim 13, further comprising the step of removing the center member out of the woven yarns so as to obtain a tubular three dimensional fabric after completion of the weaving.

17. A method for making a three dimensional fabric according to claim 13, in which the fourth step includes transposing some of the first selected group of first yarns into a slanted state relative to a plane including the axis, and maintaining the transposed yarns in the slanted state during winding of the second yarn to spirally wind the transposed yarns.

18. A method for making a three dimensional fabric according to claim 13, in which the sixth step includes transposing some of the selected third group of first yarns into a slanting state relative to the radial direction, and maintaining the tranposed yarns in the slanted state during winding of the second yarn to spirally wind the transposed yarns.

* * * * *

UNITED STATES PATENT AND TRADEMARK OFFICE

CERTIFICATE OF CORRECTION

PATENT NO. : 5,091,246

DATED : February 25, 1992

INVENTOR(S) : Yoshiharu Yasui et al.

It is certified that error appears in the above-identified patent and that said Letters Patent is hereby corrected as shown below:

In the Abstract, line 9, "layer. Inside" should read --layer, inside--; line 13, "succesively" should read --successively--; line 14, "axis. The" should read --axis, the--.

Col. 7, line 53, "yθ" should read --y0--.

Col. 8, line 50, "(22)" should read --(o2).--.

Col. 15, line 16, "Next" should read --Next,--.

Col. 21, line 19, "rund" should read --run--.

Col. 23, line 42, "defines" should read --defines,--; line 59, "threew" should read --three--; "acording" should read --according--.

Signed and Sealed this

Twenty-fourth Day of August, 1993

Bruce Lehman

*Attest:*

BRUCE LEHMAN

*Attesting Officer*

*Commissioner of Patents and Trademarks*